US009835962B2

(12) United States Patent
Kamiwaki et al.

(10) Patent No.: US 9,835,962 B2
(45) Date of Patent: Dec. 5, 2017

(54) ELECTROSTATIC IMAGE-DEVELOPING TONER, ELECTROSTATIC IMAGE DEVELOPER, AND TONER CARTRIDGE

(71) Applicant: FUJI XEROX CO., LTD., Tokyo (JP)

(72) Inventors: Satoshi Kamiwaki, Minamiashigara (JP); Akira Matsumoto, Minamiashigara (JP); Tsuyoshi Murakami, Minamiashigara (JP); Satoshi Miura, Minamiashigara (JP); Atsushi Sugawara, Minamiashigara (JP); Yukiaki Nakamura, Minamiashigara (JP); Kana Yoshida, Minamiashigara (JP); Yutaka Saito, Minamiashigara (JP); Sakon Takahashi, Minamiashigara (JP); Yasuaki Hashimoto, Minamiashigara (JP); Koji Sasaki, Minamiashigara (JP); Tsutomu Furuta, Minamiashigara (JP)

(73) Assignee: FUJI XEROX CO., LTD., Tokyo (JP)

( * ) Notice: Subject to any disclaimer, the term of this patent is extended or adjusted under 35 U.S.C. 154(b) by 23 days.

(21) Appl. No.: 14/629,995

(22) Filed: Feb. 24, 2015

(65) Prior Publication Data

US 2016/0085165 A1 Mar. 24, 2016

(30) Foreign Application Priority Data

Sep. 19, 2014 (JP) ..... 2014-190938
Sep. 26, 2014 (JP) ..... 2014-197296
(Continued)

(51) Int. Cl.
*G03G 9/08* (2006.01)
*G03G 9/087* (2006.01)
*G03G 9/09* (2006.01)

(52) U.S. Cl.
CPC ..... *G03G 9/0825* (2013.01); *G03G 9/0819* (2013.01); *G03G 9/0827* (2013.01); *G03G 9/08733* (2013.01); *G03G 9/0918* (2013.01)

(58) Field of Classification Search
None
See application file for complete search history.

(56) References Cited

U.S. PATENT DOCUMENTS

| | | | | |
|---|---|---|---|---|
| 7,056,638 | B1 | 6/2006 | Tomita et al. | |
| 2003/0104296 | A1* | 6/2003 | Hamano | G03G 9/0804 430/107.1 |
| 2007/0166635 | A1* | 7/2007 | Yamamoto | G03G 9/0819 430/108.8 |

FOREIGN PATENT DOCUMENTS

| | | |
|---|---|---|
| JP | 2004-145243 A | 5/2004 |
| JP | 2005-107427 A | 4/2005 |

(Continued)

*Primary Examiner* — Thomas Giampaolo, II
(74) *Attorney, Agent, or Firm* — Oliff PLC

(57) ABSTRACT

There is provided an electrostatic image-developing toner containing a binder resin, a coloring agent and a release agent having a melting temperature of 85° C. to 120° C., the toner having a sea-island structure involving a sea part containing the binder resin and an island part containing the release agent, wherein a mode value of the distribution of the eccentricity degree B of the release agent-containing island part, represented by the specific formula, is from 0.75 to 1.00 and a skewness of the distribution of the eccentricity degree B is from −1.30 to −0.50.

15 Claims, 5 Drawing Sheets

(30) Foreign Application Priority Data

Sep. 26, 2014 (JP) ..... 2014-197297
Sep. 26, 2014 (JP) ..... 2014-197303

(56) References Cited

FOREIGN PATENT DOCUMENTS

| | | | |
|---|---|---|---|
| JP | 2005-173208 | A | 6/2005 |
| JP | 2006-337902 | A | 12/2006 |
| JP | 2011-158758 | A | 8/2011 |

* cited by examiner

ELECTROSTATIC IMAGE-DEVELOPING TONER, ELECTROSTATIC IMAGE DEVELOPER, AND TONER CARTRIDGE

CROSS-REFERENCE TO RELATED APPLICATIONS

This application is based on and claims priority under 35 USC 119 from Japanese Patent Application No. 2014-190938 filed on Sep. 19, 2014, Japanese Patent Application No. 2014-197296 filed on Sep. 26, 2014, Japanese Patent Application No. 2014-197297 filed on Sep. 26, 2014, and Japanese Patent Application No. 2014-197303 filed on Sep. 26, 2014.

BACKGROUND

1. Field

The present invention relates to an electrostatic image-developing toner, an electrostatic image developer, and a toner cartridge.

2. Description of the Related Art

A method for visualizing image information, such as electrophotographic method, is utilized in various fields at present. In the electrophotographic method, an electrostatic image is formed as image information on the surface of an image holding member by charging and electrostatic image formation. Thereafter, a toner image is formed on the image holding member surface by using a developer containing a toner, and the toner image is transferred onto a recording medium and then fixed on the recording medium. Through these steps, the image information is visualized as an image.

For example, JP-A-2006-337902 (the term "JP-A" as used herein means an "unexamined published Japanese patent application") discloses "an electrostatic image-developing toner containing at least a binder resin, a coloring agent and a release agent, wherein the release agent is a hydrocarbon-based wax having a melting point of 50 to 100° C., a plurality of dispersed particles of the release agent are present in the toner, the number average particle diameter of dispersed particles in the toner is from 0.5 μm to 2.0 μm as measured by a binder resin dissolution method, the standard deviation is from 0.05 to 0.5, and the shape factor SF-1 of dispersed particles of the release agent is from 1.0 to 1.4".

For example, JP-A-2004-145243 describes "a dry toner where wax is encapsulated as a particle in the toner, the wax is present throughout the toner from near the surface to the inside, and the concentration of wax present near the surface of the toner is larger than the concentration of wax present in the inside". It is also disclosed in JP-A-2004-145243 to use "an eccentricity control resin having both a moiety close to the polarity of the binder resin and a moiety close to the polarity of the release agent, in a kneading pulverization production method".

JP-A-2011-158758 describes "a toner where the content of wax is from 3.0 parts by mass to 20.0 parts by mass per 100 parts by mass of the binder resin and the degree of wax eccentricity in the depth direction of the toner is controlled". It is also disclosed in JP-A-2011-158758 to arrange the wax at a position near the surface by controlling the hydrophilicity/hydrophobicity difference between the binder resin and the wax dissolved in a solvent".

JP-A-2005-173208 describes a toner comprising at least a binder resin, a colorant, a wax, and hydrophobic titanium oxide particles, wherein the toner shows a peak temperature of a maximum endothermic peak ranging from 50 to 100° C. in the temperature range of from 30 to 150° C. in an endothermic curve by the differential scanning calorimetry (DSC); and the hydrophobic titanium oxide particles are subjected to a surface treatment with at least a silicone oil or a silicone varnish and shows an intensity ratio (Ia/Ib) of a maximum intensity Ia to a minimum intensity Ib in the X-ray diffraction in the range of from 20.0 to 40.0° in terms of 2θ satisfying a relation of ($5.0 \leq Ia/Ib \leq 12.0$).

In addition, JP-A-2005-107427 describes a toner comprising at least a resin, a colorant, a release agent, and inorganic particles, wherein at least the inorganic particles include two or more kinds of titanium oxides; one of the titanium oxides has an anatase type crystal form, and the other has a rutile type crystal form; one of the titanium oxides has a number average particle diameter Da of more than 20 nm and 60 nm or less, and the other has a number average particle diameter Db of 40 nm or more and 100 nm or less; and a relation of ($Da<Db$) is satisfied.

SUMMARY

<1> An electrostatic image-developing toner containing:

a binder resin, a coloring agent and a release agent having a melting temperature of 85° C. to 120° C., the toner having a sea-island structure involving a sea part containing the binder resin and an island part containing the release agent, wherein a mode value of the distribution of the eccentricity degree B of the release agent-containing island part, represented by the following formula (1), is from 0.75 to 1.00 and a skewness of the distribution of the eccentricity degree B is from −1.30 to −0.50:

$$\text{Eccentricity degree } B = 2d/D \qquad \text{Formula (1)}$$

in formula (1), D is an equivalent-circle diameter (μm) of the toner in the cross-sectional observation of the toner, and d is a distance (μm) from the gravity center of the toner to the gravity center of the release agent-containing island part in the cross-sectional observation of the toner.

BRIEF DESCRIPTION OF THE DRAWINGS

In FIGS. 1Y, 1M, 1C, and 1K denote Photoreceptor (one example of the image holding member), 2Y, 2M, 2C, and 2K denote Charging roller (one example of the charging unit), 3 denotes Exposure device (one example of the electrostatic image forming unit), 3Y, 3M, 3C, and 3K denote Laser beam, 4Y, 4M, 4C, and 4K denote Developing device (one example of the developing unit), 5Y, 5M, 5C, and 5K denote Primary transfer roller (one example of the primary transfer unit), 6Y, 6M, 6C, and 6K denote Photoreceptor cleaning device (one example of the cleaning unit), 8Y, 8M, 8C, and

Figure 1:
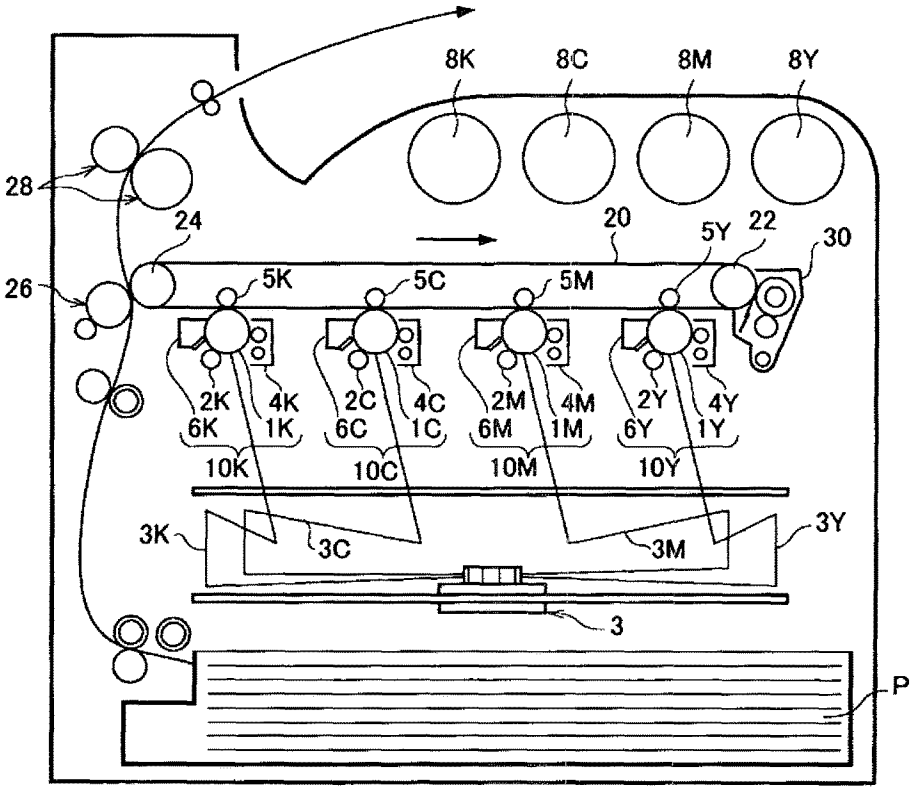
FIG. 1 is a schematic configuration diagram illustrating an example of the image forming apparatus according to an exemplary embodiment of the present invention.

8K denote Toner cartridge, 10Y, 10M, 10C, and 10K denote Image forming unit, 20 denotes Intermediate transfer belt (one example of the intermediate transfer material), 22 denotes Drive roller, 24 denotes Support roller, 26 denotes Secondary transfer roller (one example of the secondary transfer unit), 30 denotes Intermediate transfer material cleaning device, 107 denotes Photoreceptor (one example of the image holding member), 108 denotes Charging roller (one example of the charging unit), 109 denotes Exposure device (one example of the electrostatic image forming unit), 111 denotes Developing device (one example of the developing unit), 112 denotes Transfer device (one example of the transfer unit), 113 denotes Photoreceptor cleaning device (one example of the cleaning unit), 115 denotes Fixing device (one example of the fixing unit), 116 denotes Mounting rail, 118 denotes Opening for exposure, 117 denotes Housing, 200 denotes Process cartridge, 300 denotes Recording paper (one example of the recording medium), P denotes Recording paper (one example of the recording medium).

DETAILED DESCRIPTION

An exemplary embodiment as an example of the present invention is described in detail below.

<Electrostatic Image-Developing Toner According to a First Exemplary Embodiment>

The electrostatic image-developing toner (hereinafter referred to as "toner") according to the first exemplary embodiment of the present invention contains a binder resin, a coloring agent and a release agent having a melting point of 85 to 120° C.

Specifically, the toner according to the first exemplary embodiment contains a toner particle containing a binder resin, a coloring agent and a release agent having a melting point of 85 to 120° C.

In addition, the toner (toner particle) according to the first exemplary embodiment of the present invention has a sea-island structure involving a sea part containing the binder resin and an island part containing the release agent.

In the sea-island structure, the mode value of the distribution of the eccentricity degree B represented by formula (1) of the release agent-containing island part is from 0.75 to 1.00, and the skewness of the distribution of the eccentricity degree B is from −1.30 to −0.50:

$$\text{Eccentricity degree } B=2d/D \qquad \text{Formula (1)}$$

in formula (1), D is the equivalent-circle diameter (μm) of the toner (toner particle) in the cross-sectional observation of the toner (toner particle), and d is the distance (μm) from the gravity center of the toner (toner particle) to the gravity center of the release agent-containing island part in the cross-sectional observation of the toner (toner particle).

The toner according to the first exemplary embodiment of the present invention can prevent a phenomenon (document offset) that when pressure-contact/separation between an image and a resin sheet is repeated in a high temperature environment, the image migrates to the resin sheet.

The reason therefor is not clearly know but is presumed as follows.

An image obtained by an electrophotographic method is known to experience a phenomenon of migration to the contact surface contacted by the image (document offset), giving rise to an image defect. Above all, when an operation of bringing a resin sheet having affinity for the toner into pressure contact with the image and separating the resin sheet is repeated in a high temperature environment (for example, at 60° C. or more), document offset to the contact surface of the resin sheet readily occurs.

Therefore, it is required that, for example, an image defect is hardly generated on a document inserted into a resin-made file even in an automobile subject to a high temperature and document offset to the contact surface is suppressed even under the above-described harsh conditions.

On the other hand, the image formation by an electrophotographic method is known to use a toner containing a release agent.

According to such a toner, the release agent remains in the image formed, whereby the adherence of the image to the contact surface is reduced and document offset to the contact surface is suppressed.

However, even in the case of such a toner containing a release agent, although no problem is incurred by one operation of pressure-contact/separation, when the pressure-contact with/separation from the resin sheet is repeated twice or more in the above-described harsh conditions, document offset to the contact surface of the resin sheet sometimes occurs.

In the first exemplary embodiment of the present invention, the eccentricity degree B of the release agent-containing island part (hereinafter, sometimes referred to as "release agent domain") is an indicator indicating how much distant is the gravity center of the release agent domain from the gravity center of the toner. A larger value of the eccentricity degree B indicates that the release agent domain is present near the toner surface, and a smaller value indicates that the release agent domain is present near the gravity center of the toner. The mode value of the distribution of the eccentricity degree B indicates the region where a largest number of release agent domains are present in the diameter direction of the toner. On the other hand, the skewness of the distribution of the eccentricity degree B indicates a bilateral symmetry of the distribution. Specifically, the skewness of the distribution of the eccentricity degree B indicates the degree of tailing of the distribution from the mode value. That is, the skewness of the distribution of the eccentricity degree B indicates to what extent the release agent domain is distributed in the diameter direction of the toner from the region where a largest number of domains are present.

Figure 4:
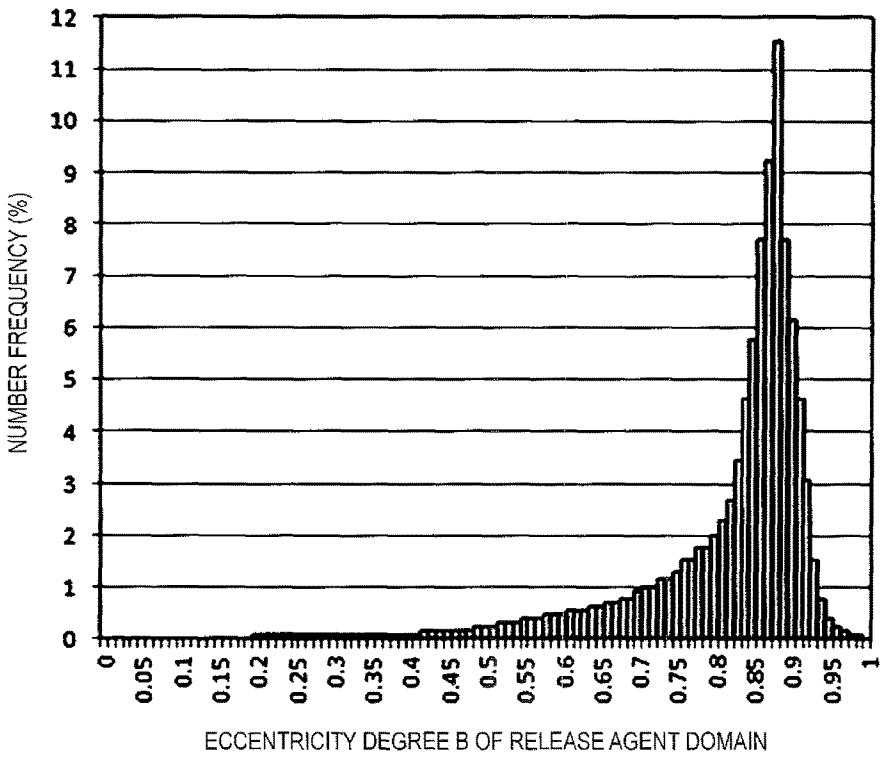
FIG. 4 is a diagram illustrating the distribution of the eccentricity degree B of the release agent domain in the toner according to an exemplary embodiment of the present invention.

More specifically, when the mode value of the distribution of the eccentricity degree B of the release agent domain is from 0.75 to 1.00, this indicates that a largest number of release agent domains are present in the surface layer part of the toner (see, FIG. 4). In addition, when the skewness of the distribution of the eccentricity degree B of the release agent domain is from −1.30 to −0.50, this indicates that the release agent domain is distributed with a gradient from the surface layer part toward the inside of the toner (see, FIG. 4).

In this way, the toner in which the mode value and skewness of the distribution of the eccentricity degree B of the release agent domain satisfy the above-described ranges is a toner where many release agent domains are present in the surface layer part and at the same time, the domains are distributed with a gradient gradually decreasing from the surface layer part toward the inside of the toner.

The toner having such a gradient in the distribution of the release agent domain has a property that the release agent in the surface layer part of the toner bleeds out by pressure during fixing but the release agent existing deeper inside the toner remains in the image after fixing. The release agent remaining in the image after fixing is gradually phase-separated from the resin binder and bleeds out little by little to the image surface over time or by pressure. In particular, when a release agent having a melting point of 85 to 120° C.

is used as the release agent in the release agent domain, control of bleed out in a high temperature environment at 60° C. or more is easy.

As a result, even when pressure-contact/separation between an image and a resin sheet is repeated under the above-described harsh conditions, i.e., in a high temperature environment (for example, at 60° C. or more), the release agent bleeds out little by little to the image surface to keep the state of a release agent being present on the image surface and in turn, document offset to the contact surface of the resin sheet is suppressed.

In this connection, there are conventionally known, for example, a toner in which the position of a release agent is located near the surface by utilizing the difference in the hydrophilicity/hydrophobicity between a binder resin and a release agent which are dissolved in a solvent (JP-A-2004-145243, etc.), and a toner in which the position of a release agent is located near the surface by a kneading pulverization production method using an eccentricity control resin having both a moiety close to the porality of a binder resin and a moiety close to the polarity of a release agent (JP-A-2011-158758, etc.). However, in all of these toners, the release agent position within a toner is controlled by physical properties of the material and a gradient cannot be imparted to the distribution of the release agent domain of the toner.

Details of the toner according to the first exemplary embodiment of the present invention are described below.

The toner according to the first exemplary embodiment of the present invention has, as described above, a sea-island structure involving a binder resin-containing sea part and a release agent-containing island part. That is, the toner has a sea-island structure where a release agent is present like islands in a continuous phase of a binder resin. Incidentally, from the standpoint of suppressing the document offset and reducing the release failure, the release agent domain is preferably not present in the central part (gravity center part) of the toner.

In the toner having a sea-island structure, the mode value of the distribution of the eccentricity degree B of the release agent domain (release agent-containing island part) is from 0.75 to 1.00 and from the standpoint of suppressing the document offset and developing the releasability to reduce the release failure, preferably from 0.85 to 0.95.

Among others, in view of thermal storability of the toner, the mode value of the distribution of the eccentricity degree B of the release agent domain is more preferably 0.98 or less.

The skewness of the distribution of the eccentricity degree B of the release agent domain (release agent-containing island part) is from −1.30 to −0.50 and from the standpoint of suppressing the document offset, preferably from −1.2 to −0.6.

Incidentally, as the mode value is larger (closer to 1.00), the release agent is more likely to bleed out during fixing and therefore, it is preferable to suppress the document offset by making the skewness value small. In this way, a preferable relationship exists between the mode value and the skewness.

For example, when the mode value is from 0.85 to 1.00, the skewness is preferably from −1.3 to −0.9. Also, when the mode value is from 0.75 to 0.85, the skewness is preferably from −0.9 to −0.5.

The method for confirming the sea-island structure of the toner (toner particle) is described below.

The sea-island structure of the toner is confirmed, for example, by a method of observing the cross-section of a toner (toner particle) by a transmission electron microscope, or a method of staining the cross-section of a toner particle with ruthenium tetroxide and observing the cross-section by a scanning electron microscope. From the standpoint that the release agent domain in the cross-section of the toner can be more clearly observed, a method of observing the cross-section by a scanning electron microscope is preferred. The scanning electron microscope may be sufficient if it is a model well-known to one skilled in the art, and examples thereof include SU8020 manufactured by Hitachi High-Technologies Corp., and JSM-7500F manufactured by JEOL Ltd.

Specifically, the observation method is as follows. First, a toner (toner particle) as the measurement target is embedded in an epoxy resin, and the epoxy resin is cured. The cured product is sectioned by a microtome to obtain an observation sample in which the cross-section of the toner is bared. Staining with ruthenium tetroxide is applied to the observation sample slice, and the cross-section of the toner is observed with a scanning electron microscope. By this observation method, a sea-island structure where a release agent having a brightness difference (contrast) is present like islands in a continuous phase of a binder resin, is observed in the cross-section of the toner.

The method for measuring the eccentricity degree B of the release agent domain is described below.

The measurement of the eccentricity degree B of the release agent domain is performed as follows. First, an image is recorded at a magnification high enough to capture the cross-section of one toner (toner particle) in the visual field. The recorded image is subjected to an image analysis under the condition of 0.010000 μm/pixel by using an image analysis software (WinROOF produced by Mitani Corp.). By this image analysis, the cross-sectional profile of the toner is extracted with the aid of brightness difference (contrast) between the epoxy resin used for embedding and the binder resin of the toner. The projected area is determined based on the extracted cross-sectional profile of the toner, and the equivalent-circle diameter is determined from the projected area. The equivalent-circle diameter is calculated according to the formula: $2\sqrt{(\text{projected area}/\pi)}$, and the determined equivalent-circle diameter is taken as the equivalent-circle diameter D of the toner in the cross-sectional observation.

On the other hand, the gravity center position is determined based on the extracted cross-sectional profile of the toner. Subsequently, the shape of the release agent domain is extracted with the aid of brightness difference (contrast) between the binder resin and the release agent, and the gravity center position of the release agent domain is determined. Each of these gravity center positions is determined as a value obtained by assuming that with respect to the extracted region of the toner or release agent domain, the number of pixels in the region is n and the xy-coordinates of each pixel are $x_i$ and $y_i$ (i=1, 2, . . . , n), and dividing the total of respective $x_i$ coordinate values by n for the x-coordinate of the gravity center or dividing the total of respective $y_i$ coordinate values by n for the y-coordinate of the gravity center. The distance between the gravity center position of the cross-section of the toner and the gravity center position of the release agent domain is then determined, and the determined distance is taken as the distance d from the gravity center of the toner to the gravity center of the release agent-containing island part in the cross-sectional observation of the toner.

Finally, from the equivalent-circle diameter D and the distance d, the eccentricity degree B of the release agent domain is determined according to formula (1): eccentricity degree B=2d/D. The same operation as above is performed on each of a plurality of release agent domains present in the cross-section of one toner (toner particle), whereby the eccentricity degree B of the release agent domain is determined.

The method for calculating the mode value of the distribution of the eccentricity degree B of the release agent domain is described below.

First, the above-described measurement of the eccentricity degree B of the release agent domain is performed on 200 toners (toner particles). Using the obtained data on the eccentricity degree B of respective release agent domains, statistical and analytical processing is performed for data segments from 0 in steps of 0.01 to determine the distribution of the eccentricity degree B, and the mode value of the obtained distribution, that is, the value of the data segment appearing most frequently in the distribution of the eccentricity degree B of the release agent domain (for example, in FIG. 4, the data segment in which the number/frequency shows a largest value), is determined. The value of this data segment is taken as the mode value of the distribution of the eccentricity degree B of the release agent domain.

The method for calculating the skewness of the distribution of the eccentricity degree B of the release agent domain is described below.

First, the distribution of the eccentricity degree B of the release agent domain is determined as described above. The skewness of the distribution of the eccentricity degree B is determined based on the obtained distribution according to the following formula. In the following formula, the skewness is Sk, the number of data on the eccentricity degree B of the release agent domain is n, the value of data on the eccentricity degree B of each release agent domain is $x_i$ (i=1, 2, . . . , n), the average value of the entire data on the eccentricity degree B of the release agent domain is x (x with a bar at the top), and the standard deviation of the entire data on the eccentricity degree B of the release agent domain is s.

$$Sk = \frac{n}{(n-1)(n-2)} \sum_{i=1}^{n} \left( \frac{x_i - \bar{x}}{s} \right)^3$$

In the toner according to the first exemplary embodiment of the present invention, the method for satisfying the distribution characteristics of the eccentricity degree B of the release agent domain is described in Production Method of Toner.

The constituent components of the toner (toner particle) according to the first exemplary embodiment of the present invention are described below.

The toner according to the first exemplary embodiment of the present invention contains a binder resin, a coloring agent and a release agent having a melting temperature of 85° C. to 120° C. Specifically, the toner contains a binder resin, a coloring agent and a release agent having a melting temperature of 85° C. to 120° C. and may be composed of only a toner particle having a sea-island structure satisfying the above-described distribution characteristics of the eccentricity degree B of the release agent domain or may further contain, in addition to such a toner particle, an external additive attached to the surface of the toner particle.

—Binder Resin—

The binder resin includes, for example, a homopolymer of a monomer such as styrenes (e.g., styrene, p-chlorostyrene, α-methylstyrene), (meth)acrylic acid esters (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate), ethylenically unsaturated nitriles (e.g., acrylonitrile, methacrylonitrile), vinyl ethers (e.g., vinyl methyl ether, vinyl isobutyl ether), vinyl ketones (e.g., vinyl methyl ketone, vinyl ethyl ketone, vinyl isopropenyl ketone) and olefins (e.g., ethylene, propylene, butadiene), and a vinyl based resin composed of a copolymer using two or more of these monomers in combination.

The binder resin includes, for example, a non-vinyl-based resin such as epoxy resin, polyester resin, polyurethane resin, polyamide resin, cellulose resin, polyether resin and modified rosin, a mixture thereof with the above-described vinyl-based resin, and a graft polymer obtained by polymerizing a vinyl-based monomer in the presence of the resin above.

One of these binder resins may be used alone, or two or more thereof may be used in combination.

A polyester resin is suitable as the binder resin.

The polyester resin includes, for example, known polyester resins.

The polyester resin includes, for example, a condensation polymer of a polyvalent carboxylic acid and a polyhydric alcohol. As for the polyester resin, a commercially available product may be used, or a synthesized resin may be used.

The polyvalent carboxylic acid includes, for example, an aliphatic dicarboxylic acid (e.g., oxalic acid, malonic acid, maleic acid, fumaric acid, citraconic acid, itaconic acid, glutaconic acid, succinic acid, alkenyl succinic acid, adipic acid, sebacic acid), an alicyclic dicarboxylic acid (e.g., cyclohexanedicarboxylic acid), an aromatic dicarboxylic acid (e.g., terephthalic acid, isophthalic acid, phthalic acid, naphthalenedicarboxylic acid), an anhydride thereof, and a lower alkyl ester (for example, having a carbon number of 1 to 5) thereof. Among these, the polyvalent carboxylic acid is preferably, for example, an aromatic dicarboxylic acid.

As the polyvalent carboxylic acid, a trivalent or higher valent carboxylic acid forming a crosslinked structure or a branched structure may be used in combination, together with a dicarboxylic acid. The trivalent or higher valent carboxylic acid includes, for example, trimellitic acid, pyromellitic acid, an anhydride thereof, and a lower alkyl ester (for example, having a carbon number of 1 to 5) thereof.

One of these polyvalent carboxylic acids may be used alone, or two or more thereof may be used in combination.

The polyhydric alcohol includes, for example, an aliphatic diol (e.g., ethylene glycol, diethylene glycol, triethylene glycol, propylene glycol, butanediol, hexanediol, neopentyl glycol), an alicyclic diol (e.g., cyclohexanediol, cyclohexanedimethanol, hydrogenated bisphenol A), and an aromatic diol (e.g., an ethylene oxide adduct of bisphenol A, a propylene oxide adduct of bisphenol A). Among these, the polyhydric alcohol is preferably, for example, an aromatic diol or an alicyclic diol, more preferably an aromatic diol.

As the polyhydric alcohol, a trivalent or higher valent polyhydric alcohol forming a crosslinked structure or a branched structure may be used in combination together with the diol. The trivalent or higher valent polyhydric alcohol includes, for example, glycerin, trimethylolpropane, and pentaerythritol.

One of these polyhydric alcohols may be used alone, or two or more thereof may be used in combination.

The glass transition temperature (Tg) of the polyester resin is preferably from 50° C. to 80° C., more preferably from 50° C. to 65° C.

Incidentally, the glass transition temperature is determined from a DSC curve obtained by differential scanning calorimetry (DSC), more specifically, is determined as the "extrapolated glass transition initiation temperature" described in the determination method of glass transition temperature of JIS K-1987, "Method for Measuring Transition Temperature of Plastics".

The polyester resin is obtained by a known production method. Specifically, the polyester resin is obtained, for example, by a method where the polymerization temperature is set to be from 180° C. to 230° C. and after reducing, if desired, the pressure in the reaction system, the reaction is performed while removing water or alcohol occurring at the time of condensation.

Incidentally, in the case where a raw material monomer is insoluble or incompatible at the reaction temperature, the monomer may be dissolved by adding a high-boiling-point solvent as a dissolution aid. In this case, the polycondensation reaction is performed while distilling out the dissolution aid. In the case where a monomer with poor compatibility is present in the copolymerization reaction, the poorly compatible monomer may be previously condensed with an acid or alcohol to be polycondensed with the monomer, and then polycondensed together with the main component.

The content of the binder resin is, for example, preferably from 40 mass % to 95 mass %, more preferably from 50 mass % to 90 mass %, still more preferably from 60 mass % to 85 mass %, based on the entire toner particle. (In this specification, mass ratio is equal to weight ratio.)

—Coloring Agent—

The coloring agent includes, for examples, various pigments such as carbon black, Chrome Yellow, Hansa Yellow, Benzidine Yellow, Threne Yellow, Quinoline Yellow, Pigment Yellow, Permanent Orange GTR, Pyrazolone Orange, Vulcan Orange, Watchung Red, Permanent Red, Brilliant Carmine 3B, Brilliant Carmine 6B, DuPont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green and Malachite Green Oxalate, Aniline Black, Aniline Blue, Calcoil Blue, Chrome Yellow, Ultramarine Blue, DuPont Oil Red, Quinoline Yellow, Methylene Blue Chloride, Phthalocyanine Blue, Malachite Green Oxalate, Lamp Black, Rose Bengal, quinacridone, Benzidine Yellow, C.I. Pigment Red 48:1, C.I. Pigment Red 57:1, C.I. Pigment Red 122, C.I. Pigment Red 185, C.I. Pigment Red 238, C.I. Pigment Yellow 12, C.I. Pigment Yellow 17, C.I. Pigment Yellow 180, C.I. Pigment Yellow 97, C.I. Pigment Yellow 74, C.I. Pigment Blue 15:1, and C.I. Pigment Blue 15:3; and various dyes such as acridine type, xanthene type, azo type, benzoquinone type, azine type, anthraquinone type, thioindigo type, dioxazine type, thiazine type, azomethine type, indigo type, phthalocyanine type, aniline black type, polymethine type, triphenylmethane type, diphenylmethane type and thiazole type.

One of these coloring agents may be used alone, or two or more thereof may be used in combination.

As for the coloring agent, a surface-treated coloring agent may be used, if desired, or the coloring agent may be used in combination with a dispersant. In addition, a plurality of kinds of coloring agents may be used in combination.

The content of the coloring agent is, for example, preferably from 1 mass % to 30 mass %, more preferably from 3 mass % to 15 mass %, based on the entire toner particle.

—Release Agent—

The release agent includes, for example, a hydrocarbon-based wax; a natural wax such as carnauba wax, rice wax and candelilla wax; a synthetic or mineral/petroleum wax such as montan wax; and an ester-based wax such as fatty acid ester and a montanic acid ester. The release agent is not limited to those recited above.

Among these, a hydrocarbon-based wax (a wax having a hydrocarbon as the framework) is preferred as the release agent. The hydrocarbon-based wax is advantageous in that it readily forms a release agent domain and is likely to rapidly bleed out to the toner (toner particle) surface at the time of fixing.

The melting temperature of the release agent is from 85° C. to 120° C., preferably from 90° C. to 100° C.

By setting the melting temperature of the release agent to the range above, when pressure-contact/separation between an image and a resin sheet is repeated in a high temperature environment, document offset to the resin sheet can be prevented.

Incidentally, the melting temperature is determined from a DSC curve obtained by differential scanning calorimetry (DSC), as the "melting peak temperature" described in the determination method of melting temperature of JIS K-1987, "Method for Measuring Transition Temperature of Plastics".

The content of the release agent is, for example, preferably from 1 mass % to 20 mass %, more preferably from 2 mass % to 9 mass %, based on the entire toner particle.

—Other Additives—

Other additives include, for example, known additives such as magnetic material, charge controlling agent and inorganic powder. These additives are contained as an internal additive in the toner particle.

—Properties, Etc. of Toner Particle—

The toner particle may be a toner particle having a single layer structure or may be a toner particle having a so-called core/shell structure consisting of a core part (core particle) and a coating layer (shell layer) covering the core part.

Here, the toner particle having a core/shell structure preferably consists of, for example, a core part which contains a binder resin, a coloring agent and a release agent having a melting temperature of 85° C. to 120° C. and has a sea-island structure involving a sea part containing the binder resin and an island part containing the release agent, and a coating layer containing a binder resin.

The volume average particle diameter (D50v) of the toner particle is preferably from 2 μm to 10 μm, more preferably from 4 μm to 8 μm.

Incidentally, various average particle diameters and various particle size distribution indices of the toner particle are measured by means of Coulter Multisizer-II (manufactured by Beckman Coulter Co.) by using ISOTON-II (produced by Beckman Coulter Co.) as the electrolytic solution.

In the measurement, from 0.5 mg to 50 mg of a measurement sample is added to 2 ml of a 5% aqueous solution of a surfactant (sodium alkylbenzenesulfonate) as a dispersant, and the resulting solution is added to from 100 ml to 150 ml of the electrolytic solution.

The electrolytic solution having suspended therein the measurement sample is subjected to a dispersion treatment for 1 minute in an ultrasonic dispersing machine, and the particle size distribution of particles having a particle diameter of 2 μm to 60 μm is measured by Coulter Multisizer-II using an aperture having an aperture diameter of 100 μm. The number of particles sampled is 50,000.

A cumulative distribution of each of volume and number is drawn from the small diameter side for divided particle size ranges (channels) based on the particle size distribution measured. The particle diameters at an accumulation of 16% are defined as volume particle diameter D16v and number particle diameter D16p, the particle diameters at an accumulation of 50% are defined as volume average particle diameter D50v and cumulative number average particle diameter D50p, and the particle diameters at an accumulation of 84% are defined as volume particle diameter D84v and number particle diameter D84p.

Using these values, the volume average particle size distribution index (GSDv) is calculated as $(D84v/D16v)^{1/2}$, and the number average particle size distribution index (GSDp) is calculated as $(D84p/D16p)^{1/2}$.

The shape factor SF1 of the toner particle is preferably from 110 to 150, more preferably from 120 to 140.

Incidentally, the shape factor SF1 is determined by the following formula:

$$SF1=(ML^2/A)\times(\pi/4)\times 100 \quad \text{Formula}$$

In the formula above, ML represents the absolute maximum length of the toner, and A represents the projected area of the toner.

Specifically, mainly a microscope image or scanning electron microscope (SEM) image is numerically expressed by the analysis using an image analyzer and used for calculation as follows. That is, an optical microscope image of particles scattered on a slide glass surface is taken into a Luzex image analyzer through a video camera, the maximum length and projected area are measured on 100 particles, and after calculation according to the formula above, the average value is determined, whereby the shape factor SF1 is obtained.

(External Additive)

The external additive includes, for example, an inorganic particle. The inorganic particle includes $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$, etc.

The surface of the inorganic particle as an external additive is preferably subjected to a hydrophobing treatment. The hydrophobing treatment is performed, for example, by immersing the inorganic particle in a hydrophobing agent. The hydrophobing agent is not particularly limited but includes, for example, a silane-based coupling agent, silicone oil, a titanate-based coupling agent, and an aluminum-based coupling agent. One of these compounds may be used alone, or two or more thereof may be used in combination.

The amount of the hydrophobing agent is usually, for example, from 1 part by mass to 10 parts by mass per 100 parts by mass of the inorganic particle.

The external additive also includes a resin particle (a resin particle of polystyrene, polymethyl methacrylate (PMMA), melamine resins, etc.), a cleaning activator (for example, a metal salt of a higher fatty acid typified by zinc stearate, and a particle of a fluorine-based polymer having a high molecular weight), and the like.

The electrostatic image-developing toner (hereinafter referred to as "toner") according to the first exemplary embodiment may contain a silica particle as the external additive.

The silica particle has a volume average particle diameter of from 50 to 200 nm.

Examples of the silica particle include a silica particle such as fumed silica, colloidal silica, and silica gel. In addition, the silica particle may be subjected to a surface treatment. For example, the silica particle may be hydrophobilized by performing a surface treatment with a silane-based coupling agent, a silicone oil, or the like. For the surface treatment, a silane-based coupling agent in which charge properties and fluidity are easily obtainable is exemplified.

The volume average particle diameter of the silica particle is from 50 to 200 nm, and more preferably from 80 to 200 nm. When the volume average particle diameter of the silica particle is 50 nm or more, an effect as a spacer is thoroughly exhibited, whereas when it is 200 nm or less, liberation of the silica particle is suppressed.

A preparation method of the silica particle is not particularly limited so long as it is a known preparation method, and examples thereof include a vapor phase preparation method, a wet preparation method, a sol-gel preparation method, and the like.

The externally added amount of the external additive is, for example, preferably from 0.01 mass % to 5 mass %, more preferably from 0.01 mass % to 2.0 mass %, based on the entire toner particle.

(Production Method of Toner)

The method for producing the toner according to the first exemplary embodiment of the present invention is described below.

The toner according to the first exemplary embodiment of the present invention is obtained by externally adding an external additive to a toner particle after the production of the toner particle.

The toner particle may be produced by either a dry production method (for example, a kneading-pulverization method) or a wet production method (for example, an aggregation/coalescence method, a suspension polymerization method, and a dissolution-suspension method). The production method of the toner particle is not particularly limited to these production methods, and a known production method is employed.

Among others, the toner particle is preferably obtained by an aggregation/coalescence method.

In particular, from the standpoint of obtaining a toner (toner particle) satisfying the distribution characteristics of the eccentricity degree B of the release agent domain, the toner particle is preferably produced by the following aggregation-coalescence method.

Specifically, the toner particle is preferably produced through:

a step of preparing each dispersion liquid (dispersion liquid preparing step), a step of mixing a first resin particle dispersion liquid having dispersed therein a first resin particle working out to a binder resin and a coloring agent particle dispersion liquid having dispersed therein a particle of a coloring agent (hereinafter, sometimes referred to as "coloring agent particle") and aggregating respective particles in the obtained mixed dispersion liquid to form a first aggregate particle (first aggregate particle forming step), a step of, after obtaining a first aggregate particle dispersion liquid having dispersed therein the first aggregate particle, sequentially adding a mixed dispersion liquid having dispersed therein a second resin particle working out to a binder resin and a particle of a release agent (hereinafter sometimes referred to as "release agent particle") to the first aggregate particle dispersion liquid while gradually increasing the concentration of the release agent particle in the mixed dispersion liquid, and thereby further aggregating the second resin particle and the release agent particle on the surface of the first aggregate particle to form a second aggregate particle (second aggregate particle forming step), and a step of heating a second aggregate particle dispersion liquid having dispersed therein the second aggregate particle, and thereby fusing/coalescing second aggregate particles to form a toner particle (fusion/coalescence step).

The production method of the toner particle is not limited to the method above. For example, the toner particle may also be formed by mixing a resin particle dispersion liquid and a coloring agent particle dispersion liquid; aggregating respective particles in the mixed dispersion liquid; adding a release agent particle dispersion liquid to the mixed dispersion liquid in the course of aggregation while gradually increasing the addition rate or increasing the concentration of the release agent particle, thereby allowing aggregation of respective particles to proceed and forming an aggregate particle; and fusing/coalescing the aggregate particles.

Respective steps are described in detail below.

—Each Dispersion Liquid Preparing Step—

First, each dispersion liquid for use in the aggregation/coalescence method is prepared. Specifically, a first resin particle dispersion liquid having dispersed therein a first resin particle working out to a binder resin, a coloring agent particle dispersion liquid having dispersed therein a coloring agent particle, a second resin particle dispersion liquid having dispersed therein a second resin particle working out to a binder resin, and a release agent particle dispersion liquid having dispersed therein a release agent particle are prepared.

In the description of each dispersion liquid preparing step, the first resin particle and the second resin particle are referred to as "resin particle".

Here, the resin particle dispersion liquid is prepared, for example, by dispersing a resin particle in a dispersion medium with the aid of a surfactant.

The dispersion medium for use in the resin particle dispersion liquid includes, for example, an aqueous medium.

The aqueous medium includes, for example, water such as distilled water and ion-exchanged water, and alcohols. One of these mediums may be used alone, or two or more thereof may be used in combination.

The surfactant includes, for example, an anionic surfactant such as sulfuric ester salt type, sulfonate type, phosphoric ester type and soap type; a cationic surfactant such as amine salt type and quaternary ammonium salt type; and a nonionic surfactant such as polyethylene glycol type, alkyl phenol ethylene oxide adduct type and polyhydric alcohol type. Among these, an anionic surfactant and a cationic surfactant are preferred. The nonionic surfactant may be used in combination with an anionic surfactant or a cationic surfactant.

One of these surfactants may be used alone, or two or more thereof may be used in combination.

In the resin particle dispersion liquid, the method for dispersing the resin particle in a dispersion medium includes, for example, a rotation shearing homogenizer and a general dispersion method using media, such as ball mill, sand mill and dynomill. Also, depending on the kind of the resin particle, the resin particle may be dispersed in the resin particle dispersion liquid by using, for example, a phase inversion emulsification method.

Incidentally, the phase inversion emulsification method is a method of dissolving a resin to be dispersed, in a hydrophobic organic solvent in which the resin is soluble, adding a base to a continuous organic phase (O phase) to cause neutralization, and then charging an aqueous medium (W phase) to invert the resin from W/O to O/W (so-called phase inversion) and make a discontinuous phase, thereby dispersing the resin as particles in the aqueous medium.

The volume average particle diameter of the resin particle dispersed in the resin particle dispersion liquid is, for example, preferably from 0.01 μm to 1 μm, more preferably from 0.08 μm to 0.8 μm, still more preferably from 0.1 μm to 0.6 μm.

The volume average particle diameter of the resin particle is determined by drawing a cumulative volume distribution from the small diameter side for divided particle size ranges (channels) based on a particle size distribution obtained by measurement with a laser diffraction particle size distribution meter (for example, LA-700, manufactured by Horiba, Ltd.) and taking the particle size at an accumulation of 50% relative to all particles as the volume average particle diameter D50v. Incidentally, the volume average particle diameter of particles in other dispersion liquids is measured in the same manner.

The content of the resin particle contained in the resin particle dispersion liquid is, for example, preferably from 5 mass % to 50 mass %, more preferably from 10 mass % to 40 mass %.

Similarly to the resin particle dispersion liquid, for example, a coloring agent particle dispersion liquid and a release agent particle dispersion liquid are also prepared. That is, with regard to the volume average particle diameter of particles, dispersion medium, dispersion method and particle content in the resin particle dispersion, the same applies to the coloring agent particle dispersed in the coloring agent particle dispersion liquid and the release agent particle dispersed in the release agent particle dispersion liquid.

—First Aggregate Particle Forming Step—

Next, the first resin particle dispersion liquid and the coloring agent particle dispersion liquid are mixed.

In the mixed dispersion liquid, a first resin particle and a coloring agent particle are hetero-aggregated to form a first aggregate particle containing a first resin particle and a coloring agent particle and having a particle diameter close to the diameter of the target toner particle.

The first aggregate particle formed in this step does not contain a release agent.

Specifically, for example, as well as adding a coagulant to the mixed dispersion liquid, the pH of the mixed dispersion liquid is adjusted to be acidic (for example, a pH of 2 to 5) and after adding, if desired, a dispersion stabilizer, heated at a temperature close to the glass transition temperature of the first resin particle (specifically, for example, from glass transition temperature of first resin particle −30° C. to glass transition temperature −10° C.) to aggregate particles dispersed in the mixed dispersion liquid and form a first aggregate particle.

In the first aggregate particle forming step, the coagulant above may be added at room temperature (for example, 25° C.) while stirring the mixed dispersion liquid by a rotation shearing homogenizer and after adjusting the pH of the mixed dispersion liquid to be acidic (for example, a pH of 2 to 5) and adding, if desired, a dispersion stabilizer, the above-described heating may be performed.

The coagulant includes, for example, a surfactant having a polarity opposite the polarity of the surfactant used as a dispersant added to the mixed dispersion liquid, an inorganic metal salt, and a divalent or higher valent metal complex. In particular, when a metal complex is used as the coagulant, the amount of the surfactant used is decreased, and the charging characteristics are enhanced.

An additive forming a complex or similar bond with a metal ion of the coagulant may be used, if desired. As this additive, a chelating agent is suitably used.

The inorganic metal salt includes, for example, a metal salt such as calcium chloride, calcium nitrate, barium chloride, magnesium chloride, zinc chloride, aluminum chloride and aluminum sulfate, and an inorganic metal salt polymer such as polyaluminum chloride, polyaluminum hydroxide and calcium polysulfide.

As the chelating agent, a water-soluble chelating agent may also be used. The chelating agent includes, for example, an oxycarboxylic acid such as tartaric acid, citric acid and gluconic acid, an iminodiacetic acid (IDA), a nitrilotriacetic acid (NTA), and an ethylenediaminetetraacetic acid (EDTA).

The amount of the chelating agent added is, for example, preferably from 0.01 parts by mass to 5.0 parts by mass, more preferably from 0.1 parts by mass to less than 3.0 parts by mass, per 100 parts by mass of the first resin particle.

—Second Aggregate Particle Forming Step—

After obtaining a first aggregate particle dispersion liquid having dispersed therein the first aggregate particle, a mixed dispersion liquid having dispersed therein a second resin particle working out to a binder resin and a release agent particle is sequentially added to the first aggregate particle dispersion liquid while gradually increasing the concentration of the release agent particle in the mixed dispersion liquid.

The kind of the second resin particle may be the same as or different from the first resin particle.

Thereafter, the second resin particle and the release agent particle are aggregated on the surface of the first aggregate particle in the dispersion liquid having dispersed therein the first aggregate particle, the second resin particle and the release agent particle. Specifically, for example, when the first aggregate particle reaches the target particle diameter in the first aggregate particle forming step, a mixed dispersion liquid having dispersed therein a second resin particle and a release agent particle is added to the first aggregate particle dispersion liquid while increasing the concentration of the release agent particle, and the resulting dispersion liquid is heated at a temperature not more than the glass transition temperature of the second resin particle.

Then, the pH of the dispersion liquid is adjusted, for example, to the range of approximately from 6.5 to 8.5, whereby the progress of aggregation is stopped.

Through this step, an aggregate particle in which a second resin particle and a release agent particle are attached to the surface of a first aggregate particle, is formed. That is, a second aggregate particle in which an aggregate of a second resin particle and a release agent particle is attached to the surface of a first aggregate particle, is formed. At this time, since a mixed dispersion liquid having dispersed therein a second resin particle and a release agent particle is sequentially added to the first aggregate particle dispersion liquid while gradually increasing the concentration of the release agent particle in the mixed dispersion liquid, an aggregate of a second resin particle and a release agent particle is attached to the surface of the first aggregate particle with a gradual increase in the concentration (abundance) of the release agent particle toward the outer side in the particle diameter direction.

As the method for adding the mixed dispersion liquid, a power-feed addition method is preferably utilized. By utilizing the power-feed addition method, the mixed dispersion liquid can be added to the first aggregate particle dispersion liquid while gradually increasing the concentration of the release agent particle in the mixed dispersion liquid.

The method for adding the mixed dispersion liquid by utilizing the power-feed addition method is described below by referring to the drawing.

Figure 3:
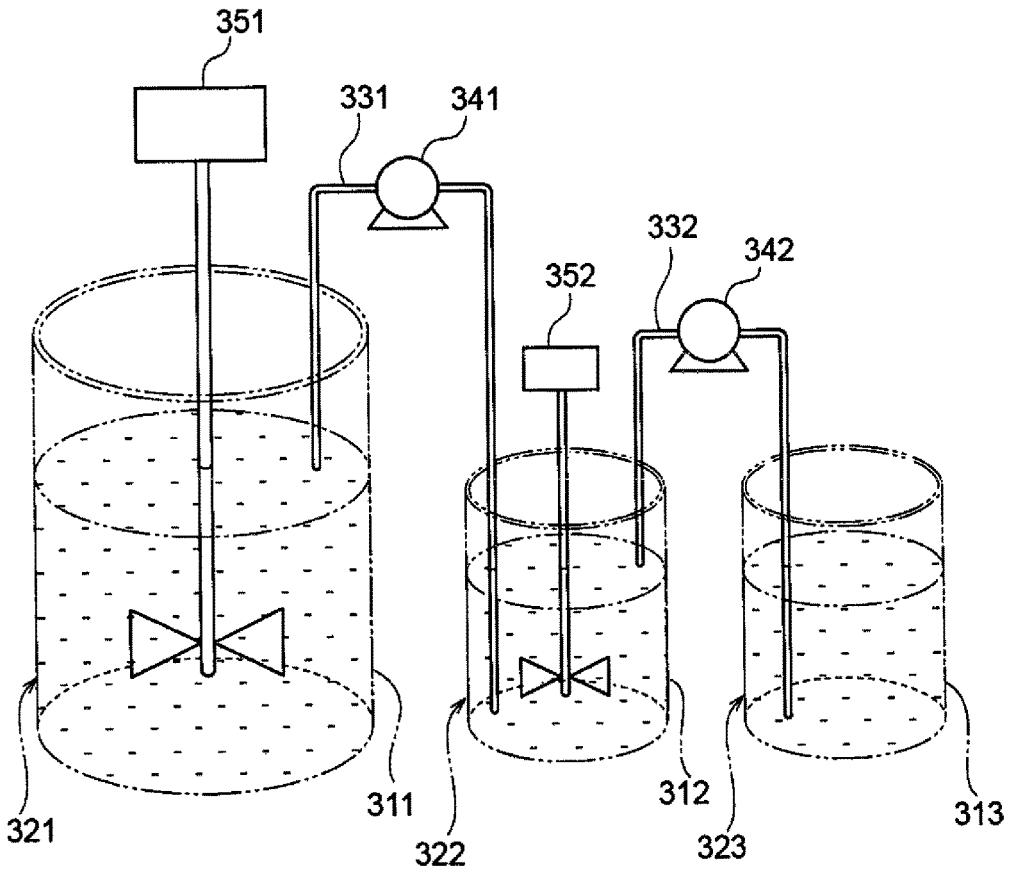
FIG. 3 is a schematic view for explaining the power-feed addition method.

FIG. 3 depicts an apparatus used for the power-feed addition method. In FIG. 3, before the drive of the apparatus (that is, before the drive of a first liquid feed pump 341 and a second liquid feed pump 342), 311 indicates a first aggregate particle dispersion liquid, 312 indicates a second resin particle dispersion liquid, and 313 indicates a release agent particle dispersion liquid.

The apparatus depicted in FIG. 3 has a first storage tank 321, a second storage tank 322 and a third storage tank 323, which are storing, at the stage before the drive of the apparatus, a first aggregate particle dispersion liquid having dispersed therein a first aggregate particle, a second resin particle dispersion liquid having dispersed therein a second resin particle, and a release agent particle dispersion liquid having dispersed therein a release agent particle, respectively.

The first storage tank 321 and the second storage tank 322 are connected by a first liquid feed pipe 331. A first liquid feed pump 341 intervenes in the middle of the route of the first liquid feed pipe 331. The dispersion liquid stored in the second storage tank 322 is fed to the first storage tank 321 through tire first liquid feed pipe 331 by the drive of the first liquid feed pump 341.

A first stirring device 351 is disposed in the first storage tank 321. The dispersion liquid fed from the second storage tank 322 is stirred and mixed in the first storage tank 321 together with the dispersion liquid stored in the first storage tank 321 by the drive of the first stirring device 351.

The second storage tank 322 and the third storage tank 323 are connected by a second liquid feed pipe 332. A second liquid feed pump 342 intervenes in the middle of the route of the second liquid feed pipe 332. The dispersion liquid stored in the third storage tank 323 is fed to the second storage tank 322 through the second liquid feed pipe 332 by the drive of the second liquid feed pump 342.

A second stirring device 352 is disposed in the second storage tank 322. The dispersion liquid fed from the third storage tank 323 is stirred and mixed in the second storage tank 322 together with the dispersion liquid stored in the second storage tank 322 by the drive of the second stirring device 352.

Subsequently, the operation of the apparatus depicted in FIG. 3 is described.

In the apparatus depicted in FIG. 3, first, a first aggregate particle forming step is carried out in the first storage tank 321 to prepare a first aggregate particle dispersion liquid. By this operation, a first aggregate particle dispersion liquid is stored in the first storage tank 321.

Incidentally, it may be also possible that the first aggregate particle forming step is performed in another thank to prepare a first aggregate particle dispersion liquid and the first aggregate particle dispersion liquid is then stored in the first storage tank 321.

Thereafter, the release agent particle dispersion liquid and the second resin particle dispersion liquid are stored in the second storage tank 322 and the third storage tank 323, respectively.

In this state, the first liquid feed pump 341 and the second liquid feed pump 342 are driven.

By the drive of these pumps, the dispersion liquid stored in the second storage tank 322 is fed to the first storage tank 321. Respective dispersion liquids in the first storage tank 321 are stirred and mixed by the drive of the first stirring device 351.

On the other hand, the release agent particle dispersion liquid stored in the third storage tank 323 is fed to the second storage tank 322, and respective dispersion liquids in the second storage tank 322 are stirred and mixed by the drive of the second stirring device 352.

At this time, the release agent particle dispersion liquid is sequentially fed to the second storage tank 322, and the concentration of the release agent particle in the second storage tank 322 is gradually increased. In consequence, a mixed dispersion liquid having dispersed therein a second resin particle and a release agent particle is stored in the second storage tank 322, and the mixed dispersion liquid is fed to the first storage tank 321 and mixed with the first aggregate particle dispersion liquid.

As described above, feed of the mixed dispersion liquid is continuously performed while increasing the concentration of the release agent particle dispersion liquid in the mixed dispersion liquid.

In this way, by utilizing the power-feed addition method, the mixed dispersion liquid having dispersed therein a second resin particle and a release agent particle can be added to the first aggregate particle dispersion liquid while gradually increasing the concentration of the release agent particle.

In the power-feed addition method, the distribution characteristics of the release agent domain of the toner are controlled by adjusting the timing for starting and ending the feed and the feed rates of respective dispersion liquids stored in the second storage tank 322 and the third storage tank 323. In the power-feed addition method, the distribution characteristics of the release agent domain of the toner are controlled also by adjusting the feed rate during the feed of respective dispersion liquids stored in the second storage tank 322 and the third storage tank 323.

Specifically, for example, the mode value of the distribution of the eccentricity degree B of the release agent domain is adjusted by the timing for ending the feed of the release agent particle dispersion liquid from the third storage tank 323 to the second storage tank 322. More specifically, for example, when the feed of the release agent particle dispersion liquid from the third storage tank 323 to the second storage tank 322 is ended before the feed from the second storage tank 322 to the first storage thank 321 is ended, the concentration of the release agent particle in the mixed dispersion liquid in the second storage tank 322 is not increased any more after that. Therefore, the mode value of the distribution of the eccentricity degree B of the release agent domain becomes small by expediting the timing for ending the feed of the release agent particle dispersion liquid from the third storage tank 323 to the second storage tank 322.

In addition, for example, the skewness of the distribution of the eccentricity degree B of the release agent domain is controlled by the timing for starting the feed of respective dispersion liquids from the second storage tank 322 and the third storage tank 323 as well as by the feed rate when feeding the dispersion liquid from the second storage tank 322 to the first storage tank 321. More specifically, for example, when the feed of the release agent particle dispersion liquid from the third storage tank 323 is started at an earlier timing than the timing for starting the feed of the dispersion liquid from the second storage tank 322 and the feed rate of the dispersion liquid from the second storage tank 322 is decreased, the aggregate particle formed is put into the state that a release agent particle is disposed over a region from the deeper side to the outer side of the particle, as a result, the skewness of the distribution of the eccentricity degree B of the release agent domain becomes large.

The power-feed addition method above is not limited to the above-described technique, and there may be employed various methods, for example, 1) a method where a storage tank storing the second resin particle dispersion liquid and a storage tank storing a mixed dispersion liquid having dispersed therein dispersion liquids of a second resin particle and a release agent particle are additionally provided and these dispersion liquids are fed to the first storage tank 321 from respective storage tanks while changing the feed rate, and a method where a storage tank storing the release agent particle dispersion liquid and a storage tank storing a mixed dispersion liquid having dispersed therein dispersion liquids of a second resin particle and a release agent particle are additionally provided and these dispersion liquids are fed to the first storage tank 321 from respective storage tanks while changing the feed rate.

By the operation above, a second aggregate particle in which a second resin particle and a release agent particle are aggregated in the manner of attaching to the surface of the first aggregate particle is obtained.

—Fusion/Coalescence Step—

Next, the second aggregate particle dispersion liquid having dispersed therein a second aggregate particle is heated, for example, at a temperature not lower than the glass transition temperatures of the first and second resin particles (for example, not lower than a temperature higher by 10° C. to 30° C. than the glass transition temperatures of the first and second resin particles) to fuse/coalesce the second aggregate particles and form a toner particle.

The toner particle is obtained through these steps.

Incidentally, the toner particle may also be produced through, after the aggregate particle dispersion liquid having dispersed therein a second aggregate particle is obtained, a step of further mixing the second aggregate particle dispersion liquid and a third resin particle dispersion liquid having dispersed therein a third resin particle working out to a binder resin, thereby aggregating the third resin particle in the manner of further attaching to the surface of the second aggregate particle to form a third aggregate particle, and a step of heating the third aggregate particle dispersion liquid having dispersed therein a third aggregate particle to fuse/coalesce third aggregate particles and form a toner particle having a core/shell structure.

In the toner particle obtained by this operation, the mode value of the distribution of the eccentricity degree B of the release agent domain becomes less than 1.00 due to the presence of a shell layer containing no release agent.

After the completion of fusion/coalescence step, the toner particle formed in a solution is subjected to known washing step, solid-liquid separation step and drying step to obtain a dry toner particle.

In the washing step, full displacement washing with ion-exchanged water is preferably applied in view of chargeability. The solid-liquid separation step is not particularly limited, but in view of productivity, suction filtration, pressure filtration, etc. is preferably applied. The drying step is also not particularly limited in its method, but in view of productivity, freeze drying, flash jet drying, fluidized drying, vibration-type fluidized drying, etc. is preferably applied.

The toner according to the first exemplary embodiment of the present invention is produced, for example, by adding an external additive to the obtained dry toner particle and mixing them. The mixing is preferably performed, for example, by a V-blender, a Henschel mixer, or a Lodige mixer. Furthermore, if desired, coarse toner particles may be removed using a vibration sieving machine, a wind power sieving machine, etc.

(Electrostatic Image-Developing Toner According to the Second Exemplary Embodiment)

The electrostatic image-developing toner (hereinafter referred to as "toner") according to the second exemplary embodiment of the present invention contains a binder resin, a coloring agent and a release agent.

Specifically, the toner according to the first exemplary embodiment contains a toner particle containing a binder resin, a coloring agent and a release agent.

In addition, the toner (toner particle) according to the second exemplary embodiment of the present invention has a sea-island structure involving a sea part containing the binder resin and an island part containing the release agent.

In the sea-island structure, the mode value of the distribution of the eccentricity degree B represented by formula (1) of the release agent-containing island part is from 0.75 to 1.00, and the skewness of the distribution of the eccentricity degree B is from −1.10 to −0.50:

$$\text{Eccentricity degree } B=2d/D \qquad \text{Formula (1)}$$

in formula (1), D is the equivalent-circle diameter (μm) of the toner (toner particle) in the cross-sectional observation of the toner (toner particle), and d is the distance (μm) from the gravity center of the toner (toner particle) to the gravity center of the release agent-containing island part in the cross-sectional observation of the toner (toner particle).

Thanks to the configuration above, the toner according to the second exemplary embodiment of the present invention reduces release failure of a recording medium at the time of fixing and suppresses image gloss unevenness generated when forming an image on a recording medium having large surface irregularities (gloss unevenness of image). The reason therefor is not clearly know but is presumed as follows.

In recent years, requirement for image formation (hereinafter, sometimes referred to as "printing") by an electrophotographic system is increasing on the light printing market such as on-demand printing (a method of printing an image on demand). In this light printing market, printing as not seen in the market of printing within an office or a company (a so-called office printing market) is required. Specifically, printing on various kinds of recording mediums such as embossed paper, printing without a margin in the recording medium's front-edge part (so-called borderless printing), etc. are required.

Therefore, characteristics higher than ever are required in the light printing market. One of the characteristics is, for example, releasability. Above all, in the borderless printing, image roughening is likely to occur due to release failure at the time of fixing of a toner, and higher releasability than ever is required of the toner.

For the purpose of enhancing the releasability, it is known to unevenly distribute a release agent to the surface layer part of a toner. The toner in which a release agent is unevenly distributed to the surface layer part has a property that the release agent readily bleeds out at the time of fixing. Therefore, the toner having this property is enhanced in the releasability.

However, when an image is formed on a recording medium having large surface irregularities, such as embossed paper, by using a toner in which a release agent is unevenly distributed to the surface layer part, gloss unevenness of image is sometimes generated. In a recording medium having large surface irregularities, a toner image before fixing is in the state that the toner is present in each of convex and concave parts on the recording medium surface, and the toner image is fixed in this state. The toner present in a concave part is less subject to a fixing pressure compared with the toner present in a convex part. In other words, the toner present in a concave part is difficult to come into contact with a fixing unit (for example, a fixing member such as fixing roller and fixing belt), compared with the toner present in a convex part.

On the other hand, in the case of a toner in which a release agent is unevenly distributed to the surface layer part, the release agent bleeds out even when the toner is present in a concave part less subject to a pressure. The release agent bled out from the toner present in a convex part transfers to a fixing unit through the contact with the fixing unit, but the release agent bled out from the toner present in a concave part can hardly transfer to a fixing unit because of difficulty in contacting with a fixing unit and is liable to remain in the concave part. Therefore, in the image after fixing, the amount of the remaining release agent differs between a convex part and a concave part on the recording medium surface, and this difference appears as gloss unevenness.

Here, the eccentricity degree B of the release agent-containing island part (hereinafter, sometimes referred to as "release agent domain") is an indicator indicating how much distant is the gravity center of the release agent domain from the gravity center of the toner. A larger value of the eccentricity degree B indicates that the release agent domain is present near the toner surface, and a smaller value indicates that the release agent domain is present near the center of the toner. The mode value of the distribution of the eccentricity degree B indicates the region where a largest number of release agent domains are present in the diameter direction of the toner. On the other hand, the skewness of the distribution of the eccentricity degree B indicates a bilateral symmetry of the distribution. Specifically, the skewness of the distribution of the eccentricity degree B indicates the degree of tailing of the distribution from the mode value. That is, the skewness of the distribution of the eccentricity degree B indicates to what extent the release agent domain is distributed in the diameter direction of the toner from the region where a largest number of domains are present.

More specifically, when the mode value of the distribution of the eccentricity degree B of the release agent domain is from 0.75 to 1.00, this indicates that a largest number of release agent domains are present in the surface layer part of the toner. In addition, when the skewness of the distribution of the eccentricity degree B of the release agent domain is from −1.10 to −0.50, this indicates that the release agent domain is distributed with a gradient from the surface layer part toward the inside of the toner (see, FIG. 4).

In this way, the toner in which the mode value and skewness of the distribution of the eccentricity degree B of the release agent domain satisfy the above-described ranges is a toner where a largest number of release agent domains are present in the surface layer part and at the same time, the domains are distributed with a gradient from the inside toward the surface layer part of the toner. The toner having a gradient in the distribution of the release agent domain has a property that only the release agent in the surface layer part of the toner bleeds out when receiving a low pressure and the release agent in the inside of the toner also bleeds out when receiving a high pressure. That is, in the toner having a concentration gradient of the release agent domain, the amount of the release agent bled out is controlled according to the pressure.

When an image is formed on a recording medium having large surface irregularities, such as embossed paper, by using a toner having such a property, the toner present in a convex part of the recording medium is subject to a sufficiently large pressure at the time of fixing and in turn, the release agent in the inside of the toner bleeds out, leading to the exertion of sufficient releasability. On the other hand, the toner present in a concave part of the recording medium is less subject to a fixing at the time of fixing and therefore, only the release agent on the surface layer part side of the toner bleeds out. That is, in a concave part, excess bleed-out of the release agent is suppressed.

As a result, while developing the releasability at the time of fixing, the difference in the amount of the remaining release agent between a convex part and a concave part on the recording medium surface is decreased in the image after fixing.

For these reasons, the toner according to the second exemplary embodiment of the present invention is presumed to reduce release failure of a recording medium at the time of fixing and at the same time, suppress image gloss unevenness generated when forming an image on a recording medium having large surface irregularities (gloss unevenness of image).

In this connection, there are conventionally known, for example, a toner in which the position of a release agent is located near the surface by utilizing the difference in the hydrophilicity/hydrophobicity between a binder resin and a release agent which are dissolved in a solvent (JP-A-2004-145243, etc.), and a toner in which the position of a release agent is located near the surface by a kneading pulverization production method using an eccentricity control resin having both a moiety close to the porality of a binder resin and a moiety close to the polarity of a release agent (JP-A-2011-458758, etc.). However, in all of these toners, the release agent position within a toner is controlled by physical properties of the material and a gradient cannot be imparted to the distribution of the release agent domain of the toner.

Details of the toner according to the second exemplary embodiment of the present invention are described below.

The toner (toner particle) according to the second exemplary embodiment of the present invention has a sea-island structure involving a binder resin-containing sea part and a release agent-containing island part. That is, the toner has a sea-island structure where a release agent is present like islands in a continuous phase of a binder resin. Incidentally, from the standpoint of reducing the release failure and suppressing the gloss unevenness, the release agent domain is preferably not present in the central part (gravity center part) of the toner in the cross-sectional observation of the toner.

In the toner having a sea-island structure, the mode value of the distribution of the eccentricity degree B of the release agent domain (release agent-containing island part) is from 0.75 to 1.00 and from the standpoint of reducing the release failure and suppressing the gloss unevenness, preferably from 0.80 to 0.95, more preferably from 0.85 to 0.90. Among others, in view of thermal storability of the toner, the mode value of the distribution of the eccentricity degree B of the release agent domain is preferably 0.98 or less.

The skewness of the distribution of the eccentricity degree B of the release agent domain (release agent-containing island part) is from −1.10 to −0.50 and from the standpoint of suppressing the gloss unevenness, preferably from −1.00 to −0.60, more preferably from −0.95 to −0.65.

The kurtosis of the distribution of the eccentricity degree 13 of the release agent domain (release agent-containing island part) is, from the standpoint of reducing the release failure and suppressing the gloss unevenness, preferably from −0.20 to +1.50, more preferably from −0.15 to +1.40, still more preferably from −0.10 to +1.30.

Here, the kurtosis is an indicator indicating the sharpness of the peak of the distribution of the eccentricity degree B (i.e., the mode value of the distribution). The kurtosis in the above-described range indicates the state where in the distribution of the eccentricity degree B, the peak (mode value) is not excessively sharpened and the distribution is appropriately curved, albeit with a pointed profile. Accordingly, the change in the amount of the release agent bleeding from the toner according to the pressure is moderate, and the amount of the release agent bled out from the toner in convex and concave parts of a recording medium is likely to be kept at an appropriate amount, as a result, the release failure and gloss unevenness are more suppressed.

In addition, the method for confirming the sea-island structure of the toner (toner particle), the method for measuring the eccentricity degree B of the release agent domain, and the method for calculating the mode value of the distribution of the eccentricity degree B of the release agent domain, and the method for calculating the skewness of the distribution of the eccentricity degree B of the release agent domain are same as the contents explained in the electrostatic image-developing toner according to the first exemplary embodiment.

The method for calculating the kurtosis of the distribution of the eccentricity degree B of the release agent domain is described below.

First, as described above, the distribution of the eccentricity degree B of the release agent domain is determined, and the kurtosis of the distribution of the eccentricity degree B of the release agent is determined based on the obtained distribution according to the following formula. In the following formula, the kurtosis is Ku, the number of data on the eccentricity degree B of the release agent domain is n, the value of data on the eccentricity degree B of each release agent domain is $x_i$ (i=1, 2, . . . , n), the average value of the entire data on the eccentricity degree B of the release agent domain is x (x with a bar at the top), and the standard deviation of the entire data on the eccentricity degree B of the release agent domain is s.

$$Ku = \frac{n(n+1)}{(n-1)(n-2)(n-3)} \sum_{i=1}^{n} \left(\frac{x_i - \bar{x}}{s}\right)^4 - \frac{3(n-1)^2}{(n-2)(n-3)}$$

The constituent components of the toner according to the second exemplary embodiment of the present invention are described below.

The toner according to the second exemplary embodiment of the present invention contains a binder resin, a coloring agent and a release agent. Specifically, the toner includes a toner particle containing a binder resin, a coloring agent and a release agent. The toner may have an external additive attached to the surface of the toner particle.

In addition, the binder resin, the coloring agent and other additives are same as the binder resin, coloring agent and other additives, described in the electrostatic image-developing toner according to the first exemplary embodiment, and the preferable ranges thereof are also same as those described in the electrostatic image-developing toner according to the first exemplary embodiment.

—Release Agent—

The release agent includes, for example, a hydrocarbon-based wax; a natural wax such as carnauba wax, rice wax and candelilla wax; a synthetic or mineral/petroleum wax such as montan wax; and an ester-based wax such as fatty acid ester and a montanic acid ester. The release agent is not limited to those recited above.

Among these, a hydrocarbon-based wax (a wax having a hydrocarbon as the framework) is preferred as the release agent. The hydrocarbon-based wax is advantageous in that it readily forms a release agent domain and is likely to rapidly bleed out to the toner (toner particle) surface at the time of fixing.

The content of the release agent is, for example, preferably from 1 mass % to 20 mass %, more preferably from 5 mass % to 15 mass %, based on the entire toner particle.

Moreover, properties, etc. of toner particle is also same as properties, etc. of toner (toner particle) described in the electrostatic image-developing toner according to the first exemplary embodiment.

In addition, external additive is same as the external additive described in the electrostatic image-developing toner according to the first exemplary embodiment, and the preferable ranges thereof is also same as that described in the electrostatic image-developing toner according to the first exemplary embodiment.

The method for producing the toner according to the second exemplary embodiment is same as the method for producing the toner according to the first exemplary embodiment. In addition, the release agent in the toner according to the second exemplary embodiment is used as the release agent (Electrostatic Image-Developing Toner According to the Third Exemplary Embodiment)

The electrostatic image-developing toner (hereinafter referred to as "toner") according to the third exemplary embodiment of the present invention includes a toner particle containing a binder resin, a coloring agent and a release agent and having a weight average molecular weight of 30,000 to 100,000. In addition, the toner particle has a sea-island structure involving a sea part containing the binder resin and an island part containing the release agent.

In the sea-island structure, the mode value of the distribution of the eccentricity degree B of the release agent-containing island part, represented by formula (1), is from 0.65 to 0.90, and the skewness of the distribution of the eccentricity degree 13 is from −1.10 to −0.50:

$$\text{Eccentricity degree } B=2d/D \qquad \text{Formula (1)}$$

in formula (1), D is the equivalent-circle diameter (μm) of the toner particle in the cross-sectional observation of the toner particle, and d is the distance (μm) from the gravity center of the toner particle to the gravity center of the release agent-containing island part in the cross-sectional observation of the toner particle.

Thanks to the configuration above, the toner according to the third exemplary embodiment of the present invention ensures that when an image without a margin in the recording medium's front-edge part and the recording medium's rear-edge part is formed (borderless printing) by using a coated paper with a thin overall thickness as a recording medium, the color gamut difference between the recording medium's front-edge part and the recording medium's rear-edge part of the image (sheet front-edge color difference) is small and an image prevented from color gamut reduction due to rubbing of the image (rubbing-induced color gamut reduction) is formed.

The "color gamut difference" and "color gamut reduction" as used herein are identified by taking the square root of the sum of the squares in the L*a*b* space in the CIE 1976 (L*a*b*) color system. Here, the CIE 1976 (L*a*b*) color system is a color space recommended by CIE (International Commission on Illumination) in 1976 and defined in "JIS Z 8729" of Japanese Industrial Standards.

When L* value, a* value and b* value in the recording medium's front-edge part of the image are assumed to be $L_A$, $a_A$ and $b_A$, respectively, and L* value, a* value and b* value in the recording medium's rear-edge part of the image are assumed to be $L_B$, $a_B$ and $b_B$, respectively, the sheet front-edge color difference is represented by $\Delta E_{AB}$ of the following formula:

$$\Delta E_{AB}=\{(L_B-L_A)^2+(a_B-a_A)^2+(b_B-b_A)^2\}^{1/2} \qquad \text{(Formula)}$$

As the sheet front-edge color difference is larger, the color of the image in the recording medium's front-edge part and the color of the image in the recording medium's rear-edge part are perceived differently even with an eye.

In addition, when L* value, a* value and b* value in the image before rubbing are assumed to be $L_C$, $a_C$ and $b_C$, respectively, and L* value, a* value and b* value in the image after rubbing are assumed to be $L_D$, $a_D$ and $b_D$, respectively, the rubbing-induced color gamut reduction is represented by $\Delta E_{CD}$ of the following formula:

$$\Delta E_{CD}=\{(L_D-L_C)^2+(a_D-a_C)^2+(b_D-b_C)^2\}^{1/2} \qquad \text{(Formula)}$$

A larger rubbing-induced reduction of color gamut means that the color of the image is changed by rubbing, and when rubbed, dulling of the color of the image is perceived even with an eye.

Here, the "recording medium's front-edge part" is an edge part where a fixing device reaches first in one recording medium sheet, and the "recording medium's rear-edge part" is an edge part where a fixing device reaches last in one recording medium sheet. Also, the "thin coated paper" is a paper sheet with a thickness of 100 μm or less, which is a coated paper obtained by applying a coating material, a synthetic resin, etc. onto base paper for the purpose of, for example, imparting gloss to the paper surface.

The reason why when borderless printing is performed on thin coated paper by using the toner according to the third exemplary embodiment of the present invention, the sheet front-edge color difference is small and an image prevented from rubbing-induced color gamut reduction is formed, is not clearly know but is presumed as follows.

In recent years, requirement for image formation (hereinafter, sometimes referred to as "printing") by an electrophotographic system is increasing on the light printing market such as on-demand printing (a method of printing an image on demand). In this light printing market, printing as not seen in the market of printing within an office or a company (a so-called office printing market) is required. Specifically, printing on various kinds of recording mediums such as thin coated paper, printing without a margin in the recording medium's front-edge part (so-called borderless printing), etc. are required. Therefore, characteristics higher than ever are required in the light printing market.

One of the characteristics is, for example, releasability. Above all, when borderless printing is performed on thin coated paper, sheet front-edge color difference associated with release failure after fixing is likely to occur, compared with a case where normal printing (formation of an image having a margin in the recording medium's front-edge part and the recording medium's rear-edge part) is performed on uncoated plain paper. Specifically, when the recording medium is thin, the self-supporting property is low and skewing readily occurs, as a result, the recording medium is likely to be entrained on a fixing device (fixing roller), compared with a case where the recording medium is thick. In addition, when an image is formed in the recording medium's front-edge part, a fixed image can be hardly released from a fixing roller due to its tack force, and when release failure of a recording medium takes place, not only roughening is caused on the surface of the image in the recording medium's front-edge part but also the contact time of the recording medium's front-edge part with a fixing device becomes longer than that of the recording medium's rear-edge part, making it likely that the color tinge differs between the recording medium's front-edge part and the recording medium's rear-edge part. Furthermore, when the recording medium is coated paper, because of high smoothness and high glossiness on the surface of the recording medium itself, surface roughness or color tinge difference of the fixed image formed on the recording medium becomes highly visible, and the sheet front-edge color difference tends to be increased. For these reasons, higher releasability than ever is required of the toner.

It is known to unevenly distribute a release agent to the surface layer part of a toner particle with the purpose of enhancing the releasability. The toner particle in which a release agent is unevenly distributed to the surface layer part has a property that the release agent readily bleeds out at the time of fixing. Therefore, the releasability of a toner particle having this property is enhanced.

However, when an image is formed on thin coated paper by using a toner containing a toner particle in which a release agent is unevenly distributed to the surface layer part, there may be caused a phenomenon that the color gamut is reduced by the rubbing of the image surface due to the presence of an excess release agent in the image surface.

In this connection, the eccentricity degree B of the release agent-containing island part (hereinafter, sometimes referred to as "release agent domain") is an indicator indicating how much distant is the gravity center of the release agent domain from the gravity center of the toner particle. A larger value of the eccentricity degree B indicates that the release agent domain is present near the toner particle surface, and a smaller value indicates that the release agent domain is present near the center of the toner particle. The mode value of the distribution of the eccentricity degree B indicates the region where a largest number of release agent domains are present in the diameter direction of the toner particle. On the other hand, the skewness of the distribution of the eccentricity degree B indicates a bilateral symmetry of the distribution. Specifically, the skewness of the distribution of the eccentricity degree B indicates the degree of tailing of the distribution from the mode value. That is, the skewness of the distribution of the eccentricity degree B indicates to what extent the release agent domain is distributed in the diameter direction of the toner from the region where a largest number of domains are present.

Figure 5:
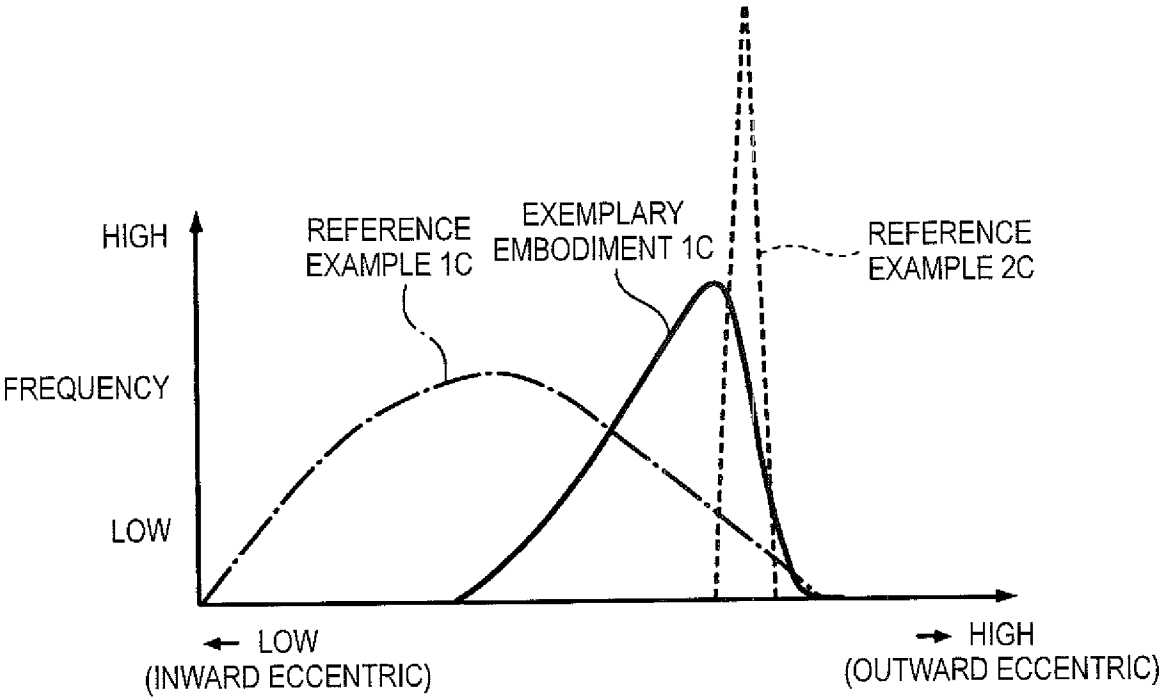
FIG. 5 is a view illustrating a specific example of the distribution of the eccentricity degree B in an exemplary embodiment of the present invention and Reference Examples.

FIG. 5 depicts a specific example of the distribution of the eccentricity degree B in an exemplary embodiment of the present invention and Reference Examples (Exemplary Embodiment 1C of the present invention, Reference Example 1C and Reference Example 2C). Specifically, distributions of the eccentricity degree B in Exemplary Embodiment 1C of the present invention (the mode value is from 0.65 to 0.90 and the skewness is from −1.10 to −0.50), Reference Example 1C (for example, a case where the mode value is less than 0.65 and the skewness is close to 0 relative to −0.50), and Reference Example 2C (for example, a case where the mode value is from 0.65 to 0.90 and the skewness is close to 0 relative to −0.50) are depicted in FIG. 5.

As shown, in FIG. 5 by the distribution of the eccentricity degree B in Exemplary Embodiment 1C of the present invention, when the mode value of the distribution of the eccentricity degree B of the release agent domain is from 0.65 to 0.90, this indicates that the region where a largest number of release agent domains are present exists at a position close to the surface layer part of the toner particle, and when the skewness of the distribution of the eccentricity degree B of the release agent domain is from −1.10 to −0.50, this indicates that the release agent domain is distributed with a gradient from the surface layer part toward the inside of the toner particle.

On the other hand, for example, in Reference Example 1C of FIG. 5, the mode value is smaller than the range above and therefore, the region where a largest number of release agent domains are present exists at a position distant from the surface layer part (a position close to the inside) of the toner particle, compared with the exemplary embodiment of the present invention. Also, in Reference Example 2C of FIG. 5, the mode value is in the range above but the skewness is larger than the range above and is a value close to 0, and therefore, the release agent domain is present only in the surface layer part of the toner particle.

In this way, the toner particle of an exemplary embodiment of the present invention in which the mode value and skewness of the distribution of the eccentricity degree B of the release agent domain satisfy the above-described ranges is a toner particle where a largest number of release agent domains are present on the surface layer part side and at the same time, the domains are distributed with a gradient toward the surface layer part from the inside of the toner particle. A toner particle having such a gradient in the distribution of the release agent domain is less likely to cause reduction in the color gamut even when the image surface is rubbed, because the amount of the release agent in the image surface is small compared with a toner particle in which the release agent is unevenly distributed only to the surface layer part.

The third exemplary embodiment of the present invention is characterized not only in that the distribution of the release agent domain has the above-described gradient but also in that the weight average molecular weight of the toner particle is from 30,000 to 100,000. In a toner particle having a large weight average molecular weight, the release agent can hardly move to the image surface at the time of image fixing. That is, the toner particle contained in the toner according to an exemplary embodiment of the present invention has a high weight average molecular weight compared with the conventional toner particle and therefore, the release agent inside of the toner particle can hardly move to the image surface, making it unlikely that rubbing-induced color gamut reduction occurs due to the presence of an excess release agent in the image surface. Furthermore, in an exemplary embodiment of the present invention, as compared with a case where the weight average molecular weight of the toner particle is larger than the range above, the release agent in the surface layer part of the toner particle readily bleeds out to the image surface during fixing, and the sheet front-edge color difference associated with release failure after fixing is reduced.

As described above, it is presumed that according to the toner of the third exemplary embodiment of the present invention, the sheet front-edge color difference is small and an image prevented from rubbing-induced color gamut reduction is formed.

In this connection, there are conventionally known, for example, a toner in which the position of a release agent is located near the surface by utilizing the difference in the hydrophilicity/hydrophobicity between a binder resin and a release agent which are dissolved in a solvent (JP-A-2004-145243, etc.), and a toner in which the position of a release agent is located near the surface by a kneading pulverization production method using an eccentricity control resin having both a moiety close to the porality of a binder resin and a moiety close to the polarity of a release agent (JP-A-2011-158758, etc.). However, in all of these toners, the release agent position within a toner particle is controlled by physical properties of the material and a gradient cannot be imparted to the distribution of the release agent domain of the toner particle.

Details of the toner according to the third exemplary embodiment of the present invention are described below.

The toner particle according to an exemplary embodiment of the present invention has a sea-island structure involving a binder resin-containing sea part and a release agent-containing island part. That is, the toner particle has a sea-island structure where a release agent is present like islands in a continuous phase of a binder resin. Incidentally, from the standpoint of reducing the sheet front-edge color difference and suppressing the rubbing-induced color gamut reduction, the release agent domain is preferably not present in the central part (gravity center part) of the toner particle.

In the toner particle having a sea-island structure, the mode value of the distribution of the eccentricity degree B of the release agent domain (release agent-containing island part) is from 0.65 to 0.90. In addition, from the standpoint of reducing the sheet front-edge color difference and suppressing the rubbing-induced color gamut reduction, the mode value of the distribution of the eccentricity degree B is preferably from 0.75 to 0.85.

In addition, it is preferred that the eccentricity degree 13 of the release agent domain has one mode value.

The skewness of the distribution of the eccentricity degree B of the release agent domain (release agent-containing island part) is from −1.10 to −0.50 and from the standpoint of reducing the sheet front-edge color difference and suppressing the rubbing-induced color gamut reduction, preferably from −1.05 to −0.55, more preferably from −1.00 to −0.60.

In addition, the method for confirming the sea-island structure of the toner (toner particle), the method for measuring the eccentricity degree B of the release agent domain, the method for calculating the mode value of the distribution of the eccentricity degree B of the release agent domain, and the method for calculating the skewness of the distribution of the eccentricity degree B of the release agent domain are same as the contents explained in the electrostatic image-developing toner according to the first exemplary embodiment.

The weight average molecular weight of the toner particle is from 30,000 to 100,000 and from the standpoint of reducing the sheet front-edge color difference and suppressing the rubbing-induced color gamut reduction, preferably from 35,000 to 60,000.

The weight average molecular weight of the toner particle is measured by gel permeation chromatography (GPC). The measurement of the molecular weight by GPC is performed with a THF solvent by using, as the measuring apparatus, GPC, HLC-8120GPC, manufactured by Tosoh Corporation and using a TSKgel Super HM-M column (15 cm) manufactured by Tosoh Corporation. The weight average molecular weight is calculated from the measurement results by using a molecular weight calibration curve prepared from a monodisperse polystyrene standard sample.

In the case of performing the measurement on a toner in which an external additive is attached to the toner particle, a pretreatment of previously removing the external additive may be carried out.

The constituent components of the toner according to the third exemplary embodiment of the present invention are described below.

The toner according to the third exemplary embodiment of the present invention has a toner particle containing a binder resin, a coloring agent and a release agent. The toner may have an external additive attached to the surface of the toner particle.

In addition, the coloring agent and other additives are same as coloring agent and other additives, described in the electrostatic image-developing toner according to the first exemplary embodiment, and the preferable ranges thereof are also same as those described in the electrostatic image-developing toner according to the first exemplary embodiment.

—Binder Resin—

The binder resin includes, for example, a homopolymer of a monomer such as styrenes (e.g., styrene, p-chlorostyrene; α-methylstyrene), (meth)acrylic acid esters (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate), ethylenically unsaturated nitriles (e.g., acrylonitrile, methacrylonitrile), vinyl ethers (e.g., vinyl methyl ether, vinyl isobutyl ether), vinyl ketones (e.g., vinyl methyl ketone, vinyl ethyl ketone, vinyl isopropenyl ketone) and olefins (e.g., ethylene, propylene, butadiene), and a vinyl-based resin composed of a copolymer using two or more of these monomers in combination.

The binder resin includes, for example, a non-vinyl-based resin such as epoxy resin, polyester resin, polyurethane resin, polyamide resin, cellulose resin, polyether resin and modified rosin, a mixture thereof with the above-described vinyl-based resin, and a graft polymer obtained by polymerizing a vinyl-based monomer in the presence of the resin above.

One of these binder resins may be used alone, or two or more thereof may be used in combination.

A polyester resin is suitable as the binder resin.

The polyester resin includes, for example, known polyester resins.

The polyester resin includes, for example, a condensation polymer of a polyvalent carboxylic acid and a polyhydric alcohol. As for the polyester resin, a commercially available product may be used, or a synthesized resin may be used.

The polyvalent carboxylic acid includes, for example, an aliphatic dicarboxylic acid (e.g., oxalic acid, malonic acid, maleic acid, fumaric acid, citraconic acid, itaconic acid, glutaconic acid, succinic acid, alkenyl succinic acid, adipic acid, sebacic acid), an alicyclic dicarboxylic acid (e.g., cyclohexanedicarboxylic acid), an aromatic dicarboxylic acid (e.g., terephthalic acid, isophthalic acid, phthalic acid, naphthalenedicarboxylic acid), an anhydride thereof, and a lower alkyl ester (for example, having a carbon number of 1 to 5) thereof. Among these, the polyvalent carboxylic acid is preferably, for example, an aromatic dicarboxylic acid.

As the polyvalent carboxylic acid, a trivalent or higher valent carboxylic acid forming a crosslinked structure or a branched structure may be used in combination, together with a dicarboxylic acid. The trivalent or higher valent carboxylic acid includes, for example, trimellitic acid, pyromellitic acid, an anhydride thereof, and a lower alkyl ester (for example, having a carbon number of 1 to 5) thereof.

One of these polyvalent carboxylic acids may be used alone, or two or more thereof may be used in combination.

The polyhydric alcohol includes, for example, an aliphatic diol (e.g., ethylene glycol, diethylene glycol, triethylene glycol, propylene glycol, butanediol, hexanediol, neopentyl glycol), an alicyclic diol (e.g., cyclohexanediol, cyclohexanedimethanol, hydrogenated bisphenol A), and an aromatic diol (e.g., an ethylene oxide adduct of bisphenol A, a propylene oxide adduct of bisphenol A). Among these, the polyhydric alcohol is preferably, for example, an aromatic diol or an alicyclic diol, more preferably an aromatic diol.

As the polyhydric alcohol, a trivalent or higher valent polyhydric alcohol forming a crosslinked structure or a branched structure may be used in combination together with the diol. The trivalent or higher valent polyhydric alcohol includes, for example, glycerin, trimethylolpropane, and pentaerythritol.

One of these polyhydric alcohols may be used alone, or two or more thereof may be used in combination.

The polyester resin is obtained by a known production method. Specifically, the polyester resin is obtained, for example, by a method where the polymerization temperature is set to be from 180° C. to 230° C. and after reducing, if desired, the pressure in the reaction system, the reaction is performed while removing water or alcohol occurring at the time of condensation.

Incidentally, in the case where a raw material monomer is insoluble or incompatible at the reaction temperature, the monomer may be dissolved by adding a high-boiling-point solvent as a dissolution aid. In this case, the polycondensation reaction is performed while distilling out the dissolution aid. In the case where a monomer with poor compatibility is present in the copolymerization reaction, the poorly compatible monomer may be previously condensed with an acid or alcohol to be polycondensed with the monomer, and then polycondensed together with the main component.

The glass transition temperature (Tg) of the binder resin is preferably from 50° C. to 80° C., more preferably from 50° C. to 65° C.

Incidentally, the glass transition temperature is determined from a DSC curve obtained by differential scanning calorimetry (DSC), more specifically, is determined as the "extrapolated glass transition initiation temperature" described in the determination method of glass transition temperature of JIS K-1987, "Method for Measuring Transition Temperature of Plastics".

The weight average molecular weight (Mw) of the binder resin is, from the standpoint of reducing the sheet front-edge color difference and suppressing the rubbing-induced color gamut reduction, preferably from 30,000 to 100,000, more preferably from 35,000 to 60,000.

The number average molecular weight (Mn) of the binder resin is, from the standpoint of reducing the sheet front-edge color difference and suppressing the rubbing-induced color gamut reduction, preferably from 3,000 to 30,000, more preferably from 5,000 to 10,000.

The measurements of the weight average molecular weight and number average molecular weight of the binder are performed by the same method as that for the measurement of the weight average molecular weight of the toner particle.

The content of the binder resin is, for example, preferably from 40 mass % to 95 mass %, more preferably from 50 mass % to 90 mass %, still more preferably from 60 mass % to 85 mass %, based on the entire toner particle.

—Release Agent—

The release agent includes, for example, a hydrocarbon-based wax; a natural wax such as carnauba wax, rice wax and candelilla wax; a synthetic or mineral/petroleum wax such as montan wax; and an ester-based wax such as fatty acid ester and a montanic acid ester. The release agent is not limited to those recited above.

Among these, a hydrocarbon-based wax (a wax having a hydrocarbon as the framework) is preferred as the release agent. The hydrocarbon-based wax is advantageous in that it readily forms a release agent domain and is likely to rapidly bleed out to the toner (toner particle) surface at the time of fixing.

The content of the release agent is, for example, preferably from 1 mass % to 20 mass %, more preferably from 5 mass % to 15 mass %, based on the entire toner particle.

Moreover, properties, etc. of toner particle is also same as properties, etc. of toner (toner particle) described in the electrostatic image-developing toner according to the first exemplary embodiment.

In addition, external additive is same as the external additive described in the electrostatic image-developing toner according to the first exemplary embodiment, and the preferable ranges thereof is also same as that described in the electrostatic image-developing toner according to the first exemplary embodiment.

The method for producing the toner according to the third exemplary embodiment is same as the method for producing the toner according to the first exemplary embodiment. In addition, the binder resin and the release agent in the toner according to the third exemplary embodiment is used as the binder resin and the release agent.

(Electrostatic Image-Developing Toner According to the Fourth Exemplary Embodiment)

The electrostatic image-developing toner of the fourth exemplary embodiment (hereinafter also referred to simply as "toner") includes a colored particle containing a colorant and a binder resin, in which two or more kinds of inorganic particles are externally added to the surface of the colored particle; the two or more kinds of inorganic particles include a metatitanic acid particle and a silica particle; the metatitanic acid particle shows a maximum diffraction peak at a Bragg angle 2θ of 27.5° in the CuKα characteristic X-ray diffraction and have a crystallite diameter as calculated from the peak of from 12 to 16 nm; and the silica particle has a volume average particle diameter of from 50 to 200 nm.

A toner charge amount is largely different between under a low temperature and low humidity environment and a high temperature and high humidity environment, and therefore, in all of these environments, it is difficult to keep the image density at a constant level. Then, it may be considered that by using titanium oxide having high charge exchanging properties as an external additive, higher charging in a low temperature and low humidity environment is suppressed, and a difference of charge amount between the environments is reduced, thereby keeping the image density at a constant level.

But, in the case where images having a low image density are continued under a low temperature and low humidity environment, adhesion of the toner to the member is so strong that the external additive is apt to be buried, and therefore, transfer properties may not be kept, and a lowering of the density is generated. On the other hand, by using metatitanic acid having higher water content and lower resistance than titanic, even if it is buried in the neighborhood of the outermost surface of the charging toner, the toner surface resistance may be reduced to impart charge exchanging properties, and even in the case where a low image density is continued, the density may be kept at a constant level.

Meanwhile, in the case where images having a low image density are continued under a high temperature and high humidity environment, adhesion of the toner to the member is strong, and the external additive is apt to be buried, and therefore, transfer properties may not be kept, and a lowering of the density is generated. On the other hand, by using large-sized silica having a particle diameter of from 50 to 200 nm, an effect for keeping a spacer may be imparted, and the density may be kept at a constant level.

But, in the case of using metatitanic acid and large-sized silica in combination, a difference in particle resistance between metatitanic acid and large-sized silica existing on the outermost surface of toner is so large that electrostatic repulsion becomes strong, and therefore, the large-sized silica is apt to be desorbed from the toner. For that reason, in the case where prints having a high image density are continued, the large-sized silica is desorbed from the developed toner and excessively fed into a cleaning blade part, and therefore, the large-sized silica slips therethrough, thereby generating color streaks.

As described above, even in the case where image patterns having a high image density are continued while keeping the density at a constant level disregarding the environment or image density, the suppression of color streaks cannot be achieved.

The present inventors made extensive and intensive investigations. As a result, it has been found that by using, as external additives, a metatitanic acid particle showing a maximum diffraction peak at a Bragg angle 2θ of 27.5° in the CuKα characteristic X-ray diffraction and having a crystallite diameter as calculated from the peak of from 12 to 16 nm and a silica particle having a volume average particle diameter of from 50 to 200 nm in combination, an electrostatic image-developing toner in which not only an image density variation is suppressed under all of a low temperature and low humidity environment and a high temperature and high humidity environment, but also the generation of color streaks is suppressed can be provided, leading to accomplishment of the invention.

Although the action effect is not always elucidated yet, it may be presumed that by using specified metatitanic acid, the particle resistance may be increased without reducing the water content of metatitanic acid, whereby while guaranteeing the effect for suppressing a variation of the image density to be caused due to a difference in charge amount against a difference in the environment or a difference in the image density, the desorption amount of large-sized silica may be decreased due to a lowering of the electrostatic repulsion against the large-sized silica, and the color streaks to be caused due to slipping through a cleaning blade part may be suppressed. According to the foregoing actions, it may be considered that while keeping the image density at a constant level, even in the case where image patterns having a high image density are continued, the color streaks may be improved disregarding the temperature and relative humidity or image density.

Each of components constituting the toner and physical property values are hereunder described in detail.

<External Additive>

In the electrostatic image-developing toner according to the fourth exemplary embodiment, two or more kinds of inorganic particles are externally added as external additives to the surfaces of the colored particles. The two or more kinds of inorganic particles include a metatitanic acid particle and a silica particle, and the metatitanic acid particle shows a maximum diffraction peak at a Bragg angle 2θ of 27.5° in the CuKα characteristic X-ray diffraction and has a crystallite diameter as calculated from the peak of from 12 to 16 nm, and the silica particle has a volume average particle diameter of from 50 to 200 nm.

In the electrostatic image-developing toner according to the fourth exemplary embodiment, the metatitanic acid particle and the silica particle having a volume average particle diameter of from 50 to 200 nm are used in combination, and the crystallite diameter of metatitanic acid is controlled to from 12 to 16 nm.

[Metatitanic Acid Particle]

In the electrostatic image-developing toner according to the fourth exemplary embodiment, two or more kinds of inorganic particles are externally added as external additives to the surfaces of the colored particles, and the two or more kinds of inorganic particles include a metatitanic acid particle.

The metatitanic acid particle shows a maximum diffraction peak at a Bragg angle 2θ of 27.5° in the CuKα characteristic X-ray diffraction and has a crystallite diameter as calculated from the peak of from 12 to 16 nm.

In the present exemplary embodiment, a particle obtained by synthesizing through a sulfuric acid hydrolysis reaction may be used as the metatitanic acid particle. Specifically, for example, a wet precipitation method in which ilmenite is used as an ore and dissolved in sulfuric acid to separate an iron powder, and $TiOSO_4$ is hydrolyzed to produce $Ti(OH)_2$ is adopted.

In addition, the metatitanic acid particle which is used in the present exemplary embodiment has only to be a particle composed mainly of metatitanic acid. That is, a proportion of metatitanic acid is preferably 70% by weight or more, more preferably 80% by weight or more, still more preferably 95% by weight or more, and especially preferably 99% by weight or more relative to the whole weight of the metatitanic acid particles.

In addition, as the metatitanic acid particle which is used in the fourth exemplary embodiment, a particle having been subjected to a hydrophobilizing treatment is used. The hydrophobilizing treatment is not particularly limited, and the treatment is performed using a known hydrophobilizing agent. Although the hydrophobilizing agent is not particularly limited, examples thereof include coupling agents such as a silane coupling agent, a titanate-based coupling agent, and an aluminum-based agent, a silicone oil, and the like. These may be used singly, or may be used in combination of two or more kinds thereof.

As the silane coupling agent, for example, any type of a chlorosilane, an alkoxysilane, a silazane, and a special silylating agent may be used. Specifically, examples thereof include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltriethoxysilane, decyltrimethoxysilane, hexamethyldisilazane, N,O-(bistrimethylsilyl)acetamide, N,N-(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, mercaptopropyltrimethoxysilane, γ-chloropropyltrimethoxysilane, and the like. In addition, examples of other coupling agents include a titanate-based coupling agent, an aluminate-based coupling agent, and the like.

In order to perform the hydrophobilizing treatment with a coupling agent, the coupling agent may be added to a slurry of metatitanic acid.

A treatment amount of the coupling agent is preferably 5 parts by mass or more and 80 parts by mass or less, and more preferably 10 parts by mass or more and 50 parts by mass or less based on 100 parts by pass of metatitanic acid. When the treatment amount is less than 5 parts by mass, there is a concern that water repellency may not be imparted to the metatitanic acid, whereas when it is more than 80 parts by mass, there is a concern that the treating agent per se is aggregated, so that the surface treatment may not be evenly performed.

Examples of the silicone oil which is used for the hydrophobilizing treatment include dimethylsilicone oil, fluorine-modified silicone oil, amino-modified silicone oil, and the like.

As a method for performing the hydrophobilizing treatment with a silicone oil, far example, a general spray-drying process is exemplified; however, so long as the surface treatment may be performed, the method is not particularly limited.

A treatment amount of the silicone oil is preferably 10 parts by mass or more and 40 parts by mass or less, and more preferably 20 parts by mass or more and 35 parts by mass or less based on 100 parts by mass of the metatitanic acid particles.

In the present exemplary embodiment, the metatitanic acid particle having been subjected to a hydrophilizing treatment with an alkoxysilane is preferred from the standpoint of a high degree of hydrophobicity.

The ilmenite ore ($FeTiO_3$) is heated and dissolved in concentrated sulfuric acid to separate an iron powder, thereby obtaining $TiOSO_4$. Furthermore, a precipitate of $TiO(OH)_2$ is produced by thermal hydrolysis. This is filtered and repeatedly washed with water, followed by drying at 150° C.

Subsequently, heating and burning are performed under a condition at 500° C. for 120 minutes, thereby obtaining a dried material of $TiO(OH)_2$. The crystal state can be controlled by controlling the temperature or time at this time. But, it is difficult to stably obtain a target crystallite diameter of from 12 to 16 nm.

At the time of the water washing, the solid after washing is mixed and stirred with 10 ppm of a polycarboxylic acid and water and dried, and a burning step is then performed, whereby a crystallite diameter of from 12 to 16 nm may be stably obtained. This may be considered to be caused due to the fact that the presence of a polycarboxylic acid makes the oxidation gentle and also makes the particle coupling gentle.

In addition, the crystallite diameter as referred to herein represents an average diameter of the crystallites as a minimum unit constituting a crystalline body. The crystallite diameter can be determined as follows.

The target crystalline body is measured using an X-ray diffraction apparatus, and the crystallite diameter is determined according to the following Scherrer's equation.

$$D=K\times\lambda/(\beta\times\cos\theta)$$

D: crystallite diameter (nm), K: Scherrer's constant, λ: X-ray wavelength, β: spread of diffraction line, θ: diffraction angle (2θ/θ)

A number average particle diameter of the metatitanic acid particles is preferably 20 nm or more and 50 nm or less, more preferably 20 nm or more and 45 nm or less, and still more preferably 20 nm or more and 40 nm or less.

Incidentally, the particle diameter of the metatitanic acid particle is controlled by the amount of the hydrophobilizing treating agent at the time of the hydrophobilizing treatment and the temperature at the time of adding the hydrophobilizing treating agent.

In addition, a specific surface area of the metatitanic acid particle by the BET method is preferably from 100 to 200 $cm^2/g$, more preferably from 120 to 200 $cm^2/g$, and still more preferably from 130 to 170 $cm^2/g$.

An amount of the metatitanic acid particle which is contained as the external additive in the toner is preferably 0.5 parts by mass or more and 2.0 parts by mass or less, and more preferably 0.6 parts by mass or more and 12 parts by mass or less based on 100 parts by mass of the colored particles. When the addition amount falls within the foregoing range, the toner surface coverage falls within an appropriate range, and therefore, a toner which is satisfactory in powder fluidity and in which liberation of the metatitanic acid particles as a cause of reduction of electrical resistance ability of the carrier is suppressed is obtained.

[Silica Particle]

In the electrostatic image-developing toner of the fourth exemplary embodiment, two or more kinds of inorganic particles are externally added as external additives to the surfaces of the colored particle, and the two or more kinds of inorganic particles include a silica particle.

The silica particle has a volume average particle diameter of from 50 to 200 nm.

Examples of the silica particle includes a silica particle such as fumed silica, colloidal silica, and silica gel. In addition, the silica particle may be subjected to a surface treatment. For example, the silica particle may be hydrophobilized by performing a surface treatment with a silane-based coupling agent, a silicone oil, or the like. For the surface treatment, a silane-based coupling agent in which charge properties and fluidity are easily obtainable is exemplified.

The volume average particle diameter of the silica particle is from 50 to 200 nm, and more preferably from 80 to 200 nm. When the volume average particle diameter of the silica particle is 50 nm or more, an effect as a spacer is thoroughly exhibited, whereas when it is 200 nm or less, liberation of the silica particles is suppressed.

A preparation method of the silica particle is not particularly limited so long as it is a known preparation method, and examples thereof include a vapor phase preparation method, a wet preparation method, a sol-gel preparation method, and the like.

The addition amount of the silica particle is preferably an addition amount such that the coverage is from 10 to 50%, and more preferably an addition amount such that the coverage is from 15 to 45%, relative to the colored particle. In the addition amount in which the coverage is 10% or more, sufficient charge exchanging properties are obtained, whereas in the addition amount in which the coverage is 50% or less, desorption of the silica particle from the toner is suppressed.

[Other External Additives]

In addition, in the electrostatic image-developing toner of the fourth exemplary embodiment, other external additives may be externally added within the range where the object is not impaired, and only the titanium-based particles and the silica-based particles may be externally added.

Examples of other external additives include inorganic particles of alumina, cesium oxide, or the like and organic particles such as polymethyl methacrylate (PMMA) particles.

<Colored Particle>

The colored particle in the electrostatic image-developing toner according to the fourth exemplary embodiment contain at least a colorant (coloring agent) and a binder resin.

The colored particles may contain, in addition to these components, other components such as a release agent.

[Colorant]

The colored particle contains a colorant.

In addition, the colorant (the coloring agent) is same as the coloring agent described in the electrostatic image-developing toner according to the first exemplary embodiment, and the preferable ranges thereof are also same as those described in the electrostatic image-developing toner according to the first exemplary embodiment.

[Binder Resin]

It is preferred that a transparent toner of the fourth exemplary embodiment contains at least a binder resin.

Examples of the binder resin include homopolymers or copolymers of a styrene such as styrene and chlorostyrene; a monoolefin such as ethylene, propylene, butylene, and isoprene; a vinyl ester such as vinyl acetate, vinyl propionate, vinyl benzoate, and vinyl acetate; an α-methylene aliphatic monocarboxylic acid ester such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; a vinyl ether such as vinyl methyl ether, vinyl ethyl ether, and vinyl butyl ether; a vinyl ketone such as vinyl methyl ketone, vinyl hexyl ketone, and vinyl isopropenyl ketone; or the like.

In particular, representative examples of the binder resin include a polystyrene resin, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene, and polypropylene. Furthermore, examples include a polyester resin, a polyurethane resin, an epoxy resin, a silicone resin, a polyamide resin, a modified rosin resin, a paraffin, a wax, and the like. Of these, a polyester resin is especially preferred.

The polyester resin which is used in the fourth exemplary embodiment is synthesized through polycondensation from a polyol component and a polycarboxylic acid component. Incidentally, in the present exemplary embodiment, as the polyester resin, a commercially available product may be used, or a properly synthesized product may also be used.

Examples of polyvalent carboxylic acid components include aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acids such as dibasic acids, for example, phthalic acid, isophthalic acid, terephthalic acid, naphthalene-2,6-dicarboxylic acid, malonic acid, and mesaconic acid; and the like. Furthermore, examples include anhydrides thereof and lower alkyl esters thereof; however, it should not be construed that the polyvalent carboxylic acid component is limited to these compounds.

Examples of trivalent or multivalent carboxylic acids include 1,2,4-benzenetricarboxylic acid, 1,2,5-benzenetricarboxylic acid, 1,2,4-naphthalenetricarboxylic acid, and the like; anhydrides thereof or lower alkyl esters thereof; and the like. These may be used singly, may be used in combination of two or more kinds thereof.

Furthermore, it is more preferred to contain a dicarboxylic acid component having an ethylenically unsaturated double bond, in addition to the above-described aliphatic dicarboxylic acid or aromatic dicarboxylic acid. The dicarboxylic acid having an ethylenically unsaturated double bond is suitably used for the purpose of preventing hot offset at the time of fixing from occurring from the standpoint of obtaining a radical crosslinking bond via the ethylenically unsaturated double bond. Examples of such a dicarboxylic acid include maleic acid, fumaric acid, 3-hexenedioic acid, 3-octenedioic acid, and the like; however, it should not be construed that the dicarboxylic acid is limited to these acids. In addition, examples further include lower esters or acid anhydrides thereof. Of these, from the standpoint of costs, fumaric acid, maleic acid, and the like are exemplified.

As for a polyhydric alcohol component, examples of divalent polyhydric alcohols include C2-C4-alkylene oxide adducts (average addition molar number: 1.5 to 6) of bisphenol A, such as polyoxypropylene (2.2)-2,2-bis(4-hydroxyphenyl)propane and polyoxyethylene (2.2)-2,2-bis(4-hydroxyphenyl)propane, ethylene glycol, propylene glycol, neopentyl glycol, 1,4-butanediol, 1,3-butanediol, 1,6-hexanediol, and the like.

Examples of trivalent or multivalent polyhydric alcohols include sorbitol, pentaerythritol, glycerol, trimethylolpropane, and the like.

As for an amorphous polyester resin (also referred to as "non-crystalline polyester resin"), among the above-described raw material monomers, divalent or multivalent secondary alcohols and/or divalent or multivalent aromatic carboxylic acid compounds are preferred. Examples of the divalent or multivalent secondary alcohol include a propylene oxide adduct of bisphenol A, propylene glycol, 1,3-butanediol, glycerol, and the like. Of these, a propylene oxide adduct of bisphenol A is preferred.

As the divalent or multivalent aromatic carboxylic acid compound, terephthalic acid, isophthalic acid, phthalic acid, and trimellitic acid are preferred, with terephthalic acid and trimellitic acid being more preferred.

In addition, in order to impart low-temperature fixing properties to the toner, it is preferred to use a crystalline polyester resin as a part of the binder resin.

The crystalline polyester resin is preferably one composed of an aliphatic dicarboxylic acid and an aliphatic diol, and more preferably one composed of a linear dicarboxylic acid and a linear aliphatic diol, in which the carbon number of a main-chain moiety thereof is from 4 to 20. So long as the linear type is concerned, the polyester resin is excellent in crystallizability and appropriate in terms of a crystal melting point, and therefore, it is excellent in toner blocking resistance, image preservability, and low-temperature fixing properties. In addition, when the carbon number is 4 or more, the ester linkage concentration is low, the electrical resistance is appropriate, and the toner charge properties are excellent. In addition, when the carbon number is 20 or less, practically useful materials are easily available. The carbon number is more preferably 14 or less.

Examples of the aliphatic dicarboxylic acid which is suitably used for synthesizing a crystalline polyester include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, and the like; and lower alkyl esters or acid anhydrides thereof. However, it should not be construed that the aliphatic dicarboxylic acid is limited to these compounds. Of these, taking into consideration easiness of availability, sebacic acid and 1,10-decanedicarboxylic acid are preferred.

Specifically, examples of the aliphatic dial include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,14-eicosadecanediol, and the like. However, it should not be construed that the aliphatic diol is limited to these compounds. Of these, taking into consideration easiness of availability, 1,8-octanediol, 1,9-nonanediol, and 1,10-decanediol are preferred.

Examples of the trihydric or multihydric alcohol include glycerin, trimethylolethane, trimethylolpropane, pentaerythritol, and the like. These may be used singly, or may be used in combination of two or more kinds thereof.

In the polyvalent carboxylic acid component, a content of the aliphatic dicarboxylic acid is preferably 80 mol % or more, and more preferably 90 mol % or more. When the content of the aliphatic dicarboxylic acid is 80 mol % or more, the polyester resin is excellent in crystallizability and appropriate in terms of a melting point, and therefore, it is excellent in toner blocking resistance, image preservability, and low-temperature fixing properties.

In the polyhydric alcohol component, a content of the aliphatic diol component is preferably 80 mol % or more, and more preferably 90 mol % or more. When the content of the aliphatic diol component is 80 mol % or more, the polyester resin is excellent in crystallizability and appropriate in terms of a melting point, and therefore, it is excellent in toner blocking resistance, image preservability, and low-temperature fixing properties.

In the present exemplary embodiment, a melting temperature Tm of the crystalline polyester resin is preferably from 50 to 100° C., more preferably from 50 to 90° C., and still more preferably from 50 to 80° C. What the melting temperature falls within the foregoing range is preferred because the polyester resin is excellent in releasability and low-temperature fixing properties, and furthermore, the offset may be reduced.

Here, for measurement of the melting temperature of the crystalline polyester resin, a differential scanning calorimeter (DSC) is used, and the melting temperature may be determined as a melting peak temperature in the input compensation type differential scanning calorimetry as defined in HS K-7121:87, when the measurement is performed at a rate of temperature rise of 10° C. per minute from room temperature (20° C.) to 180° C. Incidentally, though there may be the case where the crystalline polyester resin shows plural melting peaks, in the present exemplary embodiment, a maximum peak is considered to be the melting temperature.

Meanwhile, a glass transition temperature (Tg) of the non-crystalline polyester resin is preferably 30° C. or higher, more preferably from 30 to 100° C., and still more preferably from 50 to 80° C. When the glass transition temperature falls within the foregoing range, since the non-crystalline polyester resin is in a glass state when used, the toner particles are free from aggregation to be caused due to heat or pressure applied at the time of image formation, and the particles are neither attached nor accumulated within the machine. Thus, a stable image forming performance over a long period of time is obtained.

Here, the glass transition temperature of the non-crystalline polyester resin refers to a value measured by a method as defined in ASTM D3418-82 (DSC method).

In addition, the glass transition temperature in the present exemplary embodiment may be measured by, for example, "DSC-20" (manufactured by Seiko Instruments Inc.) according to the differential scanning colorimetry. Specifically, the glass transition temperature is determined by heating about 10 mg of a sample at a fixed rate of temperature rise (10° C./min) and obtained from a point of intersection between a baseline and an inclination line of an endothermic peak.

A weight average molecular weight of the crystalline polyester resin is preferably from 10,000 to 60,000, more preferably from 15,000 to 45,000, and still more preferably from 20,000 to 30,000.

In addition, a weight average molecular weight of the non-crystalline polyester resin is preferably from 5,000 to 100,000, more preferably from 10,000 to 90,000, and still more preferably from 20,000 to 80,000.

When the weight average molecular weights of the crystalline polyester resin and the non-crystalline polyester resin fall within the foregoing numerical value ranges, respectively, both image intensity and fixing properties may be made compatible with each other, and hence, such is preferred. All of the above-described weight average molecular weights are obtained by the measurement of molecular weight by a gel permeation chromatography (GPC) method of a tetrahydrofuran (THF)-soluble fraction. The molecular weight of the resin is determined by measuring a THF-soluble material with a THF solvent by using TSK-GEL (GMH (manufactured by Tosoh Corporation) or the like and performing calculation using a molecular weight calibration curve as prepared from a monodispersed polystyrene standard sample.

An acid value of each of the crystalline polyester resin and the non-crystalline polyester resin is preferably from 1 to 50 mg-KOH/g, more preferably from 5 to 50 mg-KOH/g, and still more preferably from 8 to 50 mg-KOH/g. When the acid value falls within the foregoing range, the polyester resin is excellent in fixing characteristics and charge stability, and hence, such is preferred.

Incidentally, for the purpose of controlling the acid value or hydroxyl value or other purposes, a monovalent acid such as acetic acid and benzoic acid, or a monohydric alcohol such as cyclohexanol and benzyl alcohol, is also used, if desired.

A method for producing the polyester resin is not particularly limited, and the polyester resin may be produced by a general polyester polymerization method for allowing an acid component and an alcohol component to react with each other. Examples thereof include a direct polycondensation method, a transesterification method, and the like, and the polyester resin is produced according to the kind of the monomers. In addition, it is preferred to use a polycondensation catalyst such as a metal catalyst and a Brønsted acid catalyst.

The polyester resin may also be produced by subjecting the polyhydric alcohol and the polyvalent carboxylic acid to a condensation reaction according to the usual way. For example, the polyester resin is produced by charging and compounding the polyhydric alcohol and the polyvalent carboxylic acid and optionally, a catalyst in a reactor including a thermometer, a stirrer, and a falling type condenser; heating the mixture at 150° C. to 250° C. in the presence of an inert gas (e.g., a nitrogen gas, etc.); continuously removing a low-molecular weight compound produced as a byproduct outside the reaction system; and stopping the reaction at a point of time of reaching a prescribed acid value, followed by cooling to obtain a target reaction product.

In addition, though a content of the binder resin in the transparent toner of the present exemplary embodiment is not particularly limited, it is preferably from 75 to 99.5% by weight, more preferably from 85 to 99% by weight, and still more preferably from 90 to 99% by weight relative to the whole weight of the electrostatic image-developing toner. When the content of the binder resin falls within the foregoing range, the toner is excellent in fixing properties, storage properties, powder characteristics, charge characteristics, and the like.

[Release Agent]

The colored particle may contain a release agent.

Examples of the release agent include paraffin waxes such as low-molecular weight polypropylene and low-molecular weight polyethylene; silicone resins; rosins; rice wax; carnauba wax; and the like.

A melting temperature of such a release agent is preferably from 50 to 100° C., and more preferably from 60 to 95° C.

A content of the release agent in the colored particles is preferably from 0.5 to 15% by weight, and more preferably from 1.0 to 12% by weight. When the content of the release agent is 0.5% by weight or more, in particular, releasing failure in the case of oilless fixing is prevented from occurring. When the content of the release agent is 15% by weight or less, deterioration of the fluidity of the toner is prevented from occurring, and hence, the image quality and the reliability of image formation are kept.

[Other Additives]

To the colored particles, in addition to the above-described components, various components such as an internal additive and a charge-controlling agent may be added, if desired.

Examples of the internal additive include magnetic materials of metals or alloys such as ferrite, magnetite, reduced iron, cobalt, nickel, and manganese; compounds containing such metals; and the like.

Examples of the charge-controlling agent include quaternary ammonium salt compounds, nigrosine-based compounds, dyes composed of a complex of aluminum, iron, chromium, or the like, triphenylmethane-based pigments, and the like.

<Characteristics of Toner>

In the fourth exemplary embodiment, the electrostatic image-developing toner has a shape factor SF1 of preferably from 115 to 140, and more preferably from 120 to 138.

Here, the shape factor SF1 is determined according to the following equation.

$$SF1=((ML)^2/A)\times(\pi/4)\times 100$$

In the foregoing equation, ML represents an absolute maximum length of the toner particles, and A represents a projected area of the toner particles.

SF1 is numerically converted mainly by analyzing a microscopic image or a scanning electron microscopic (SEM) image by using an image analyzer, and is calculated as follows. That is, optical microscopic images of particles scattered on a surface of a glass slide are input into an image analyzer Luzex through a video camera to obtain maximum lengths and projected areas of 100 particles, values of SF1 are then calculated according to the foregoing expression, and an average value thereof is obtained.

In addition, in the fourth exemplary embodiment, a volume average particle diameter of the electrostatic image-developing toner is preferably from 3.0 to 9.0 μm, more preferably from 3.1 to 8.5 μm, and still more preferably from 3.2 to 8.0 μm. When the volume average particle diameter is 3 μm or more, the fluidity is hardly lowered, and the charge properties are apt to be kept. When the volume average particle diameter is 9 μm or less, the resolution is hardly lowered. Incidentally, the volume average particle diameter is, for example, measured using an analyzer such as a Coulter Multisizer II (manufactured by Beckman Coulter, Inc.).

(Production Method of Electrostatic Image-Developing Toner)

A production method of the electrostatic image-developing toner of the present exemplary embodiment is not particularly limited so long as the toner of the present exemplary embodiment is obtained. For example, a kneading pulverizing method in which a binder resin and optionally, a release agent, a charge-controlling agent, and the like are kneaded, pulverized, and classified; a method of changing the shape of the particles obtained by the kneading pulverizing method, by using a mechanical impact force or thermal energy; an emulsion polymerization aggregation method in which a dispersion liquid obtained by emulsifying and polymerizing polymerizable monomers of a binder resin is mixed with a dispersion liquid containing a release agent and optionally, a charge-controlling agent and the like, aggregated, and heat fused to obtain toner particles; a polyester aggregation method in which a dispersion liquid obtained by emulsifying a polyester resin is mixed with a dispersion liquid containing a release agent and optionally, a charge-controlling agent and the like, aggregated, and heat fused to obtain toner particles; a suspension polymerization method in which polymerizable monomers for obtaining a binder resin and a solution containing a release agent and optionally, a charge-controlling agent and the like are suspended in an aqueous solvent and polymerized; a dissolution suspension method in which a binder resin and a solution containing a release agent and optionally, a charge-controlling agent and the like are suspended in an aqueous solvent and granulated; and the like may be adopted. In addition, a production method in which aggregated particles are further attached to the toner particles obtained by the above-described method as a core and then heated and fused to bring a core-shell structure may be adopted.

Of these, it is preferred to prepare the toner particles by a kneading pulverizing method, an emulsion polymerization aggregation method, or a polyester aggregation method, and it is more preferred to prepare the toner particles by a polyester aggregation method.

<Colored Particle Preparing Step>

The production method of the electrostatic image-developing toner of the present exemplary embodiment includes a step of preparing colored particles containing a colorant and a binder resin (colored particle preparing step).

A method for preparing the colored particles in the colored particle preparing step is not particularly limited, and examples thereof include a known method in which the colored particles are prepared by a dry method such as a kneading pulverizing method, or a wet method such as a melt suspension method, an emulsion aggregation method, and a dissolution suspension method.

<External Addition Step>

The production method of the electrostatic image-developing toner of the present exemplary embodiment includes an external addition step of externally adding an external additive to the colored particles.

A method for externally adding an external additive to the toner in the external addition step is not particularly limited, and a known method can be adopted. Examples thereof include a method for attaching the external additive by a mechanical method or a chemical method. Specifically, examples thereof include a method in which the external additive is attached to the surfaces of the colored particles in a dry process using a mixer such as a V-blender and a Henschel mixer; a method in which after dispersing the external additive in a liquid, the resultant is added to the toner in a slurry state and dried, thereby attaching it to the surface of the toner; and a method as a wet method in which drying is performed while spraying a slurry onto the dry toner.

<Electrostatic Image Developer>

The electrostatic image developer according to an exemplary embodiment of the present invention contains at least the toner according to any one of the first to fourth exemplary embodiment of the present invention.

The electrostatic image developer according to an exemplary embodiment of the present invention may be a single-component developer containing only the toner according to any one of the first to the fourth exemplary embodiment of the present invention or may be a two-component developer obtained by mixing the toner with a carrier.

The carrier is not particularly limited and includes known carriers. The carrier includes, for example, a coated carrier obtained by applying a coating resin onto the surface of a core material composed of a magnetic material; a magnetic powder dispersion-type carrier obtained by dispersing/blending a magnetic powder in a matrix resin; and a resin-impregnated carrier obtained by impregnating a porous magnetic powder with a resin.

Incidentally, the magnetic powder dispersion-type carrier and the resin-impregnated carrier may be a carrier where a constituent particle of the carrier is used as a core material and coated with a coating resin.

The magnetic powder includes, for example, a magnetic metal such as iron, nickel and cobalt, and a magnetic oxide such as ferrite and magnetite.

The coating resin and matrix resin include, for example, polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, an organosiloxane bond-containing straight silicone resin or a modified product thereof, fluororesin, polyester, polycarbonate, phenolic resin, and epoxy resin.

Incidentally, in the coating resin and matrix resin, other additives such as electrically conductive particle may be incorporated.

The electrically conductive particle includes particles of a metal such as gold, silver and copper, carbon black, titanium oxide, zinc oxide, tin oxide, barium sulfate, aluminum borate, potassium titanate, etc.

The method for applying a coating resin onto the surface of a core material includes, for example, a method of applying a coating layer-forming solution obtained by dissolving the coating resin and, if desired, various additives in an appropriate solvent. The solvent is not particularly limited and may be selected taking into account the coating resin used, suitability for coating, and the like.

Specific examples of the resin coating method include a dipping method of dipping the core material in the coating layer-forming solution, a spray method of spraying the coating layer-forming solution onto the core material surface, a fluidized bed method of spraying the coating layer-forming solution in the state of the core material being floated by fluidizing air, and a kneader-coater method of mixing the core material of the carrier with the coating layer-forming solution in a kneader-coater and removing the solvent.

The mixing ratio (mass ratio) between the toner and the carrier in the two-component developer is preferably toner: carrier=from 1:100 to 30:100, more preferably from 3:100 to 24:100.

<Image Forming Apparatus/Image Forming Method>

The image forming apparatus/image forming method according to an exemplary embodiment of the present invention are described.

The image forming apparatus according to an exemplary embodiment of the present invention includes an image holding member, a charging unit for charging the surface of the image holding member, an electrostatic image forming unit for forming an electrostatic image on the charged surface of the image holding member, a developing unit for storing an electrostatic image developer and developing the electrostatic image formed on the surface of the image holding member to form a toner image, a transfer unit for transferring the toner image formed on the surface of the image holding member onto a recording medium, and a fixing unit for fixing the toner image transferred onto the surface of the recording medium. As the electrostatic image developer, the electrostatic image developer according to an exemplary embodiment of the present invention is applied.

In the image forming apparatus according to an exemplary embodiment of the present invention, an image forming method including a charging step of charging the surface of an image holding member, an electrostatic image forming step of forming an electrostatic image on the charged surface of the image holding member, a developing step of developing the electrostatic image formed on the surface of the image holding member with the electrostatic image developer according to an exemplary embodiment of the present invention to form a toner image, a transfer step of transferring the toner image formed on the surface of the image holding member onto the surface of a recording medium, and a fixing step of fixing the toner image transferred onto the surface of the recording medium (the image forming method according to an exemplary embodiment of the present invention), is performed.

As for the image forming apparatus according to an exemplary embodiment of the present invention, there is applied a known image forming apparatus, e.g., a direct transfer-type apparatus where a toner image formed on the surface of an image holding member is transferred directly onto a recording medium; an intermediate transfer-type apparatus where a toner image formed on the surface of an image holding member is primarily transferred onto the surface of an intermediate transfer material and the toner image transferred onto the surface of the intermediate transfer material is secondarily transferred onto the surface of a recording medium; an apparatus equipped with a cleaning unit for cleaning the surface of an image holding member after transfer of a toner image but before charging; and an apparatus equipped with a destaticizing unit for irradiating the surface of an image holding member after transfer of a toner image but before charging, with destaticizing light to remove electrostatic charge.

In the case of an intermediate transfer-type apparatus, the configuration applied to the transfer unit includes, for example, an intermediate transfer material onto the surface of which a toner image is transferred, a primary transfer unit for primarily transferring a toner image formed on the surface of an image holding member onto the surface of the intermediate transfer material, and a secondary transfer unit for secondarily transferring the toner image transferred onto the surface of the intermediate transfer material, onto the surface of a recording medium.

Incidentally, in the image forming apparatus according to an exemplary embodiment of the present invention, for example, the portion containing the developing unit may be a cartridge structure (process cartridge) that is attached to and detached from the image forming apparatus. As the process cartridge, for example, a process cartridge storing the electrostatic image developer according to an exemplary embodiment of the present invention and having a developing unit is suitably used.

One example of the image forming apparatus according to an exemplary embodiment of the present invention is described below, but the present invention is not limited thereto. Incidentally, main parts depicted in the figure are described, and description of others is omitted.

FIG. 1 is a schematic configuration diagram illustrating an image forming apparatus according to an exemplary embodiment of the present invention.

The image forming apparatus depicted in FIG. 1 is equipped with first to fourth image forming units 10Y, 10M, 10C and 10K (image forming unit) for outputting an image of each color of yellow (Y), magenta (M), cyan (C) and black (K) based on the color-separated image data. These image forming units (hereinafter, sometimes simply referred to as "unit") 10Y, 10M, 10C and 10K are arranged in parallel with a predetermined spacing from each other in the horizontal direction. Incidentally, these units 10Y, 10M, 10C and 10K may be a process cartridge that is attached to and detached from the image forming apparatus.

Above respective units 10Y, 10M, 10C and 10K in the figure, an intermediate transfer belt 20 is disposed extending as an intermediate transfer material over respective units. The intermediate transfer belt 20 is provided by winding it around a drive roller 22 and a support roller 24 put into contact with the inner surface of the intermediate transfer belt 20, these rollers being arranged to be apart from each other in the left-to-right direction in the figure, and is configured to run in the direction toward fourth unit 10K from first unit 10Y. Incidentally, the support roller 24 is biased in the direction away from the drive roller 22 by a spring, etc. (not shown), and a tension is applied to the intermediate transfer belt 20 wound around those two rollers. An intermediate transfer material cleaning device 30 is provided on the image holding member-side surface of the intermediate transfer belt 20 to face the drive roller 22.

Toners including toners of four colors of yellow, magenta, cyan and black, which are stored in toner cartridges 8Y, 8M, 8C and 8K, are supplied respectively to developing devices (developing units) 4Y, 4M, 4C and 4K of respective units 10Y, 10M, 10C and 10K.

First to fourth units 10Y, 10M, 10C and 10K have the same configuration and therefore, first unit 10Y for forming a yellow image, which is arranged on the upstream side in the running direction of the intermediate transfer belt, is described here as a representative of those units. Incidentally, description of second to fourth units 10M, 10C and 10K is omitted by assigning reference numerals of magenta (M), cyan (C) and black (K) in place of yellow (Y) to the equivalent parts of first unit 10Y.

First unit 10Y has a photoreceptor 1Y acting as an image holding member. A charging roller (one example of the charging unit) 2Y for charging the surface of the photoreceptor 1Y to a predetermined potential, an exposure device (one example of the electrostatic image forming unit) 3 for exposing the charged surface to a laser beam 3Y based on color-separated image signals to form an electrostatic image, a developing device (one example of the developing unit) 4Y for developing the electrostatic image by supplying a charged toner to the electrostatic image, a primary transfer roller (one example of the primary transfer unit) 5Y for transferring the developed toner image onto the intermediate transfer belt 20, and a photoreceptor cleaning device (one example of the cleaning unit) 6Y for removing the toner remaining on the surface of the photoreceptor 1Y after the primary transfer are sequentially disposed on the periphery of the photoreceptor 1Y.

Incidentally, the primary transfer roller 5Y is arranged inside of the intermediate transfer belt 20 and is provided at a position facing the photoreceptor 1Y. Furthermore, a bias power source (not shown) for applying a primary transfer bias is connected to each of the primary transfer rollers 5Y, 5M, 5C and 5K Each bias power source can change the transfer bias applied to each primary transfer roller through control by a controller (not shown).

The operation of forming a yellow image in first unit 10Y is described below.

First, the surface of the photoreceptor 1Y is charged to a potential of −600 V to −800 V by a charging roller 2Y in advance of operation.

The photoreceptor 1Y is formed by stacking a photosensitive layer on an electrically conductive (for example, volume resistivity at 20° C.: $1\times10^{-5}$ Ωcm or less) substrate. This photosensitive layer has a property such that the resistance is usually high (resistance of a general resin) but upon irradiation with a laser beam 3Y, the specific resistance of the portion irradiated with the laser beam varies. Therefore, a laser beam 3Y is output through the exposure device 3 onto the charged surface of the photoreceptor 1Y according to yellow image data transmitted from a controller (not shown). The photosensitive layer on the surface of the photoreceptor 1Y is irradiated with the laser beam 3Y, whereby an electrostatic image of a yellow image pattern is formed on the surface of the photoreceptor 1Y.

The electrostatic image is an image formed on the surface of the photoreceptor 1Y by charging and is a so-called negative image formed resulting from flow of the charge electrified on the surface of the photoreceptor 1Y due to decrease in the specific resistance in the portion of the photosensitive layer irradiated with the laser beam 3Y and, on the other hand, remaining of the charge in the portion not irradiated with the laser beam 3Y.

The electrostatic image formed on the photoreceptor 1Y is rotated to a predetermined development position along with running of the photoreceptor 1Y. At this development position, the electrostatic image on the photoreceptor 1Y is visualized (developed) as a toner image by the developing device 4Y.

In the developing device 4Y, for example, an electrostatic image developer containing at least a yellow toner and a carrier is stored. The yellow toner is frictionally electrified through stirring inside the developing device 4Y and is held on a developer roll (one example of the developer holding member) by having a charge with the same polarity (negative polarity) as that of the charge electrified on the photoreceptor 1Y. In the course of the photoreceptor 1Y surface passing through the developing device 4Y, the yellow toner electrostatically adheres to the destaticized latent image part on the photoreceptor 1Y surface, and the latent image is developed with the yellow toner. The photoreceptor 1Y having formed thereon a yellow toner image is caused to continuously run at a predetermined speed, and the toner image developed on the photoreceptor 1Y is conveyed to a predetermined primary transfer position.

When the yellow toner image on the photoreceptor 1Y is conveyed to the primary transfer position, a primary transfer bias is applied to the primary transfer roller 5Y, and an electrostatic force directed from the photoreceptor 1Y to the primary transfer roller 5Y acts on the toner image, as a result, the toner image on the photoreceptor 1Y is transferred onto the intermediate transfer belt 20. The transfer bias applied here has (+) polarity opposite the polarity (−) of the toner and, for example, in first unit 10Y, the transfer bias is controlled to +10 μA by a controller (not shown).

On the other hand, the toner remaining on the photoreceptor 1Y is removed and collected by the photoreceptor cleaning device 6Y.

The primary transfer biases applied to the primary transfer rollers 5M, 5C and 5K of second unit 10M and the subsequent units are also controlled in accordance with the first unit.

In this way, the intermediate transfer belt 20 having the yellow toner image transferred in the first unit 10Y is sequentially conveyed over second to fourth units 10M, 10C and 10K, and toner images of respective colors are superposed and multi-transferred.

The intermediate transfer belt 20, onto which the toner images of four colors are multi-transferred by first to fourth units, reaches a secondary transfer part composed of the intermediate transfer belt 20, the support roller 24 in contact with the inner surface of the intermediate transfer belt, and a secondary transfer roller (one example of the secondary transfer unit) 26 disposed on the image holding surface side of the intermediate transfer belt 20. On the other hand, recording paper (one example of the recording medium) P is fed through a feed mechanism at a predetermined timing to a gap where the secondary transfer roller 26 comes into contact with the intermediate transfer belt 20, and a secondary transfer bias is applied to the support roller 24. The transfer bias applied here has (−) polarity the same as the polarity (−) of the toner, and an electrostatic force directed from the intermediate transfer belt 20 to the recording paper P acts on the toner image, as a result, the toner images on the intermediate transfer belt 20 are transferred onto the recording paper P. Incidentally, the secondary transfer bias above is determined according to the resistance detected by a resistance detecting unit (not shown) for detecting the resistance of the secondary transfer part and is voltage-controlled.

Thereafter, the recording paper P is delivered to a pressure-contact part (nip part) of a pair of fixing rollers in the fixing device (one example of the fixing unit) 28, and the toner images are fixed on the recording paper P, whereby a fixed image is formed.

The recording paper P onto which the toner images are transferred includes, for example, plain paper used for an electrophotographic copying machine, a printer, etc. The recording medium includes OHP sheet, etc., in addition to the recording paper P.

In order to further improve the smoothness of the image surface after fixing, the surface of the recording paper P is also preferably smooth and, for example, coated paper obtained by coating the surface of plain paper with a resin, etc., and art paper for printing are suitably used.

The recording paper P after the completion of fixing of a color image is conveyed toward the ejection part, and a series of color image forming operations are terminated.

<Process Cartridge/Toner Cartridge>

The process cartridge according to an exemplary embodiment of the present invention is described.

The process cartridge according to an exemplary embodiment of the present invention is a process cartridge that is attached to and detached from the image forming apparatus and includes a developing unit for storing the electrostatic image developer according to an exemplary embodiment of the present invention and developing the electrostatic image formed on the surface of the image holding member with the electrostatic image developer to form a toner image.

Incidentally, the process cartridge according to an exemplary embodiment of the present invention is not limited to the above-described configuration and may be configured to include a developing device and, if desired, additionally include, for example, at least one member selected from other units such as image holding member, charging unit, electrostatic image forming unit and transfer unit.

One example of the process cartridge according to an exemplary embodiment of the present invention is described below, but the present invention is not limited thereto. Incidentally, main parts depicted in the figure are described, and description of others is omitted.

Figure 2:
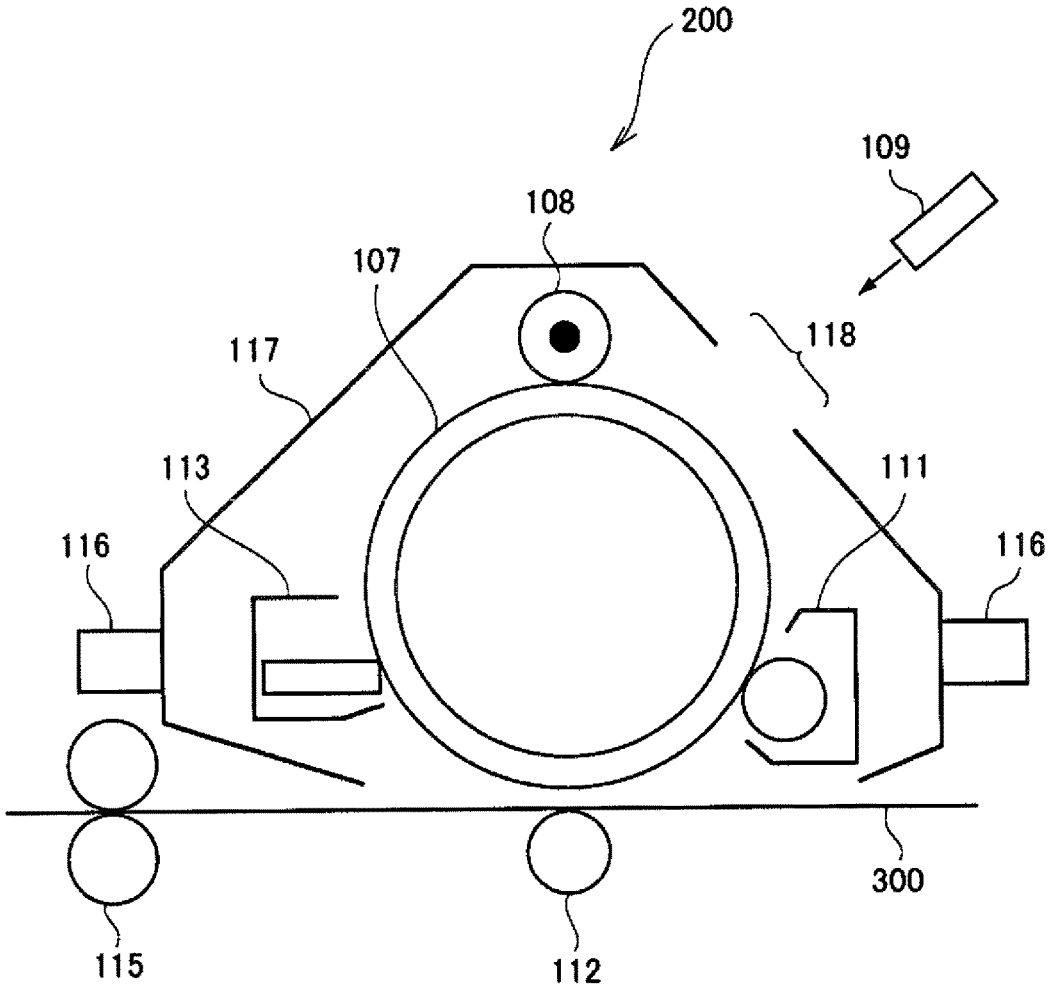
FIG. 2 is a schematic configuration diagram illustrating an example of the process cartridge according to an exemplary embodiment of the present invention.

FIG. 2 is a schematic configuration diagram illustrating the process cartridge according to an exemplary embodiment of the present embodiment.

The process cartridge 200 depicted in FIG. 2 has a configuration where, for example, a photoreceptor 107 (one example of the image holding member), a charging roller 108 (one example of the charging unit) disposed on the periphery of the photoreceptor 107, a developing device 111 (one example of the developing unit), and a photoreceptor cleaning device 113 (one example of the cleaning unit) are held in an integrally combined manner by a mounting rail 116 and a housing 117 with an opening 118 for exposure and formed into a cartridge.

Incidentally, in FIG. 2, 109 indicates an exposure device (one example of the electrostatic image forming unit), 112 indicates a transfer device (one example of the transfer unit), 115 indicates a fixing device (one example of the fixing unit), and 300 indicates recording paper sheet (one example of the recording medium).

The toner cartridge according to an exemplary embodiment of the present invention is described below.

The toner cartridge according to an exemplary embodiment of the present invention is a toner cartridge storing the toner according to an exemplary embodiment of the present invention and being attached to and detached from an image forming apparatus. The toner cartridge is a unit for storing a replenishment toner supplied to the developing unit provided in the image forming apparatus.

The image forming apparatus depicted in FIG. 1 is an image forming apparatus having a configuration where toner cartridges 8Y, 8M, 8C and 8K are attached and detached, and developing devices 4Y, 4M, 4C and 4K are connected to toner cartridges corresponding to respective developing devices (colors) through toner supply pipes (not shown). In the case where the amount of the toner stored in the toner cartridge is reduced, this toner cartridge is replaced.

EXAMPLES

The exemplary embodiment of the present invention is described in greater detail below by referring to Examples and Comparative Examples, but the exemplary embodiment of the present invention is not limited to these Examples. Incidentally, unless otherwise indicated, the "parts" means "parts by mass".

Examples 1 to 7, Comparative Examples 1 to 8

<Preparation of Resin Particle Dispersion Liquid>

[Preparation of Resin Particle Dispersion Liquid (1)]

Terephthalic acid: 30 molar parts

Fumaric acid: 70 molar parts

Bisphenol A ethylene oxide adduct: 5 molar parts

Bisphenol A propylene oxide adduct: 95 molar parts

These materials are charged into a flask having an inner volume of 5 liter and being equipped with a stirring device, a nitrogen inlet tube, a temperature sensor and a rectifying column. The temperature is raised to 210° C. over 1 hour, and 1 part of titanium tetraethoxide is charged per 100 parts of the materials above. The temperature is raised to 230° C. over 0.5 hours while distilling out water produced and after continuing the dehydration condensation reaction for 1 hour at this temperature, the reaction product is cooled. In this way, Polyester Resin (1) having a weight average molecular weight of 18,500, an acid value of 14 mgKOH/g and a glass transition temperature of 59° C. is synthesized.

40 Parts of ethyl acetate and 25 parts of 2-butanol are charged into a vessel equipped with a temperature adjusting unit and a nitrogen purging unit to make a mixed solvent. Subsequently, 100 parts of Polyester Resin (1) is gradually charged and dissolved, and an aqueous 10 mass % ammonia solution (in an amount corresponding to 3 times, in terms of the molar ratio, the acid value of the resin) is added thereto, followed by stirring for 30 minutes.

Thereafter, the inside of the vessel is purged with dry nitrogen, and 400 parts of ion-exchanged water is added dropwise at a rate of 2 parts/min by keeping the temperature at 40° C. while stirring the mixed solution, thereby effecting emulsification. After the completion of dropwise addition, the emulsified solution is returned to room temperature (from 20° C. to 25° C.), and the content of ethyl acetate and 2-butanol is decreased to 1,000 ppm or less by bubbling dry nitrogen through the solution for 48 hours while stirring to obtain a resin particle dispersion liquid in which resin particles having a volume average particle diameter of 200 nm are dispersed. Ion-exchanged water is added to this resin particle dispersion liquid to adjust the solid content to 20 mass %, and the resulting dispersion liquid is designated as Resin Particle Dispersion Liquid (1).

<Preparation of Coloring Agent Particle Dispersion Liquid>

[Preparation of Coloring Agent Particle Dispersion Liquid (1)]

Cyanine pigment, C.I. Pigment Blue 15:3 (copper phthalocyanine, produced by DIC Corp., trade name: FASTOGEN BLUE LA5380): 70 parts Anionic surfactant (Neogen RK, produced by Dai-Ichi Kogyo Seiyaku Co., Ltd.): 5 parts Ion-exchanged water: 200 parts These materials are mixed and dispersed for 10 minutes by using a homogenizer (ULTRA-TURRAX T50, manufactured by IKA), and ion-exchanged water is added to adjust the solid content in the dispersion liquid to 20 mass %, whereby Coloring Agent Particle Dispersion Liquid (1) having dispersed therein coloring agent particles with a volume average particle diameter of 190 nm is obtained.

<Preparation of Release Agent Particle Dispersion Liquid>

[Preparation of Release Agent Particle Dispersion Liquid (1)]

Fischer-Tropsch wax (FNP-0090, produced by Nippon Seiro Co., Ltd., melting temperature: 90° C.): 100 parts Anionic surfactant (Neogen RK, produced by Dai-Ichi Kogyo Seiyaku Co., Ltd.): 1 part Ion-exchanged water: 350 parts These materials are mixed, heated at 100° C., dispersed using a homogenizer (ULTRA-TURRAX T50, manufactured by IKA), and then subjected to a dispersion treatment by means of a Manton Gaulin high-pressure homogenizer (manufactured by Gaulin Corp.) to obtain Release Agent Particle Dispersion Liquid (1) (solid content: 20 mass %) wherein release agent particles with a volume average particle diameter of 200 nm are dispersed therein.

[Preparation of Release Agent Particle Dispersion Liquid (2)]

Polyethylene wax (Polywax 725, produced by Baker Petrolite Corp., melting temperature: 104° C.): 100 parts Anionic surfactant (Neogen RK, produced by Dai-Ichi Kogyo Seiyaku Co., Ltd.): 1 part Ion-exchanged water: 350 parts These materials are mixed, heated at 110° C., dispersed using a homogenizer (ULTRA-TURRAX T50, manufactured by IKA), and then subjected to a dispersion treatment by means of a Manton Gaulin high-pressure homogenizer (manufactured by Gaulin Corp.) to obtain Release Agent Particle Dispersion Liquid (2) (solid content: 20 mass %) wherein release agent particles with a volume average particle diameter of 200 nm are dispersed therein.

[Preparation of Release Agent Particle Dispersion Liquid (3)]

Microcrystalline wax (Hi-MIC-1090, produced by Nippon Seiro Co., Ltd., melting temperature: 88° C.): 100 parts Anionic surfactant (Neogen RK, produced by Dai-Ichi Kogyo Seiyaku Co., Ltd.): 1 part Ion-exchanged water: 350 parts These materials are mixed, heated at 100° C., dispersed using a homogenizer (ULTRA-TURRAX T50, manufactured by IKA), and then subjected to a dispersion treatment by means of a Manton Gaulin high-pressure homogenizer (manufactured by Gaulin Corp.) to obtain Release Agent Particle Dispersion Liquid (3) (solid content: 20 mass %) wherein release agent particles with a volume average particle diameter of 200 nm are dispersed therein.

[Preparation of Release Agent Particle Dispersion Liquid (4)]

Microcrystalline wax (Hi-MIC-2065, produced by Nippon Seiro Co., Ltd., melting temperature: 75° C.): 100 parts Anionic surfactant (Neogen RK, produced by Dai-Ichi Kogyo Seiyaku Co., Ltd.): 1 part Ion-exchanged water: 350 parts These materials are mixed, heated at 100° C., dispersed using a homogenizer (ULTRA-TURRAX T50, manufactured by IKA), and then subjected to a dispersion treatment by means of a Manton Gaulin high-pressure homogenizer (manufactured by Gaulin Corp.) to obtain Release Agent Particle Dispersion Liquid (4) (solid content: 20 mass %) wherein release agent particles with a volume average particle diameter of 200 nm are dispersed therein.

[Preparation of Release Agent Particle Dispersion Liquid (5)]

Polypropylene wax (NP055, produced by Mitsui Chemicals, Inc., melting temperature: 136° C.): 100 parts Anionic surfactant (Neogen RK, produced by Dai-Ichi 1 part Kogyo Seiyaku Co., Ltd.):

Ion-exchanged water: 350 parts

These materials are mixed, heated at 140° C., dispersed using a homogenizer (ULTRA-TURRAX T50, manufactured by IKA), and then subjected to a dispersion treatment by means of a Manton Gaulin high-pressure homogenizer (manufactured by Gaulin Corp.) to obtain Release Agent Particle Dispersion Liquid (5) (solid content: 20 mass %) wherein release agent particles with a volume average particle diameter of 200 nm are dispersed therein.

Example 1

[Preparation of Toner Particle]

An apparatus where a round stainless steel-made flask and a vessel A are connected by a tube pump A, a solution stored in the vessel A is fed to the flask by driving the tube pump A, the vessel A and a vessel B are connected by a tube pump B, and a solution stored in the vessel B is fed to the vessel A by driving the tube pump B, was prepared (see, FIG. 3). The following operation was carried out by using this apparatus.

Resin Particle Dispersion Liquid (1): 500 parts

Coloring Agent Particle Dispersion Liquid (1): 40 parts

Anionic surfactant (TaycaPower): 2 parts

These materials are put in the round stainless steel-made flask and after adjusting the pH to 3.5 by adding 0.1 N nitric acid, 30 parts of an aqueous nitric acid solution having a polyaluminum chloride concentration of 10 mass % is added. Subsequently, the mixture is dispersed at 30° C. by using a homogenizer (ULTRA-TURRAX T50, manufactured by IKA), and thereafter, the temperature is raised at a rate of 1° C./30 min in an oil bath for heating to grow the particle diameter of aggregate particles.

On the other hand, 150 parts of Resin Particle Dispersion Liquid (1) is put in the vessel A that is a polyester-made bottle, and 25 parts of Release Agent Particle Dispersion Liquid (1) is put in the vessel B. Then, the liquid feed rate of the tube pump A and the liquid feed rate of the tube pump B are set to 0.68 parts/1 min and 0.13 parts/1 min, respectively, and when the temperature in the round stainless steel-made flask under the formation of aggregate particles reaches 37° C., the tube pumps A and B are driven to start feed of respective dispersion liquids. As a result, a mixed dispersion liquid wherein a resin particle and a release agent particle are dispersed therein is fed from the vessel A to the round stainless steel-made flask under the formation of aggregate particles while gradually increasing the concentration of the release agent particle.

The resulting mixture is held for 30 minutes from the time when feed of respective dispersion liquids to the flask is completed and the temperature in the flask reaches 48° C., and a second aggregate particle is thereby formed.

Thereafter, 50 parts of Resin Particle Dispersion Liquid (1) is slowly added, and the mixture is held for 1 hour. After adjusting the pH to 8.5 by adding an aqueous 0.1 N sodium hydroxide solution, the mixture is heated to 85° C. while continuously stirring, held for 5 hours, then cooled to 20° C. at a rate of 20° C./min, filtered, thoroughly washed with ion-exchanged water, and dried to obtain Toner Particle (1) having a volume average particle diameter of 6.0 μm.

[Preparation of Toner]

100 Parts of Toner Particle (1) and 0.7 parts of dimethyl silicone oil-treated silica particle (RY200, produced by Nippon Aerosil Co., Ltd.) are mixed using a Henschel mixer to obtain Toner (1).

[Preparation of Developer]

Ferrite particle (average particle diameter: 50 μm): 100 parts

Toluene: 14 parts

Styrene/methyl methacrylate copolymer (copolymerization 3 parts ratio: 15/85):

Carbon black: 0.2 parts

These components except for the ferrite particle are dispersed by a sand mill to prepare a dispersion liquid, and this dispersion liquid is put in a vacuum deaeration-type kneader together with the ferrite particle, stirred while reducing the pressure, and dried to obtain a carrier.

Thereafter, 8 parts of Toner (1) is mixed per 100 parts of the carrier above to obtain Developer (1).

Example 2

Toner Particle (2) is obtained in the same manner as in Example 1 except that in the production of Toner Particle (1), Release Agent Particle Dispersion Liquid (1) is changed to Release Agent Particle Dispersion Liquid (2) and when the temperature in the round stainless steel-made flask under the formation of aggregate particles reaches 37° C., the tube pumps A and B are driven to start feed of respective dispersion liquids.

The volume average particle diameter of Toner Particle (2) obtained is 6.1 μm. Thereafter, Toner (2) and Developer (2) are obtained in the same manner as in Example 1 by using Toner Particle (2).

Example 3

Toner Particle (3) is obtained in the same manner as in Example 1 except that in the production of Toner Particle (1), Release Agent Particle Dispersion Liquid (1) is changed to Release Agent Particle Dispersion Liquid (3) and when the temperature in the round stainless steel-made flask under the formation of aggregate particles reaches 37° C., the tube pumps A and B are driven to start feed of respective dispersion liquids.

The volume average particle diameter of Toner Particle (3) obtained is 5.9 μm. Thereafter, Toner (3) and Developer (3) are obtained in the same manner as in Example 1 by using Toner Particle (3).

Example 4

Toner Particle (4) is obtained in the same manner as in Example 1 except that in the production of Toner Particle (1), the liquid feed rate of the tube pump A and the liquid feed rate of the tube pump B are set to 0.40 parts/1 min and 0.08 parts/1 min, respectively, and when the temperature in the round stainless steel-made flask under the formation of aggregate particles reaches 31.5° C., the tube pumps A and B are driven to start feed of respective dispersion liquids.

The volume average particle diameter of Toner Particle (4) obtained is 6.0 μm. Thereafter, Toner (4) and Developer (4) are obtained in the same manner as in Example 1 by using Toner Particle (4).

Example 5

Toner Particle (5) is obtained in the same manner as in Example t except that in the production of Toner Particle (1), the liquid feed rate of the tube pump A and the liquid feed rate of the tube pump B are set to 0.78 parts/1 min and 0.16 parts/1 min, respectively, and when the temperature in the round stainless steel-made flask under the formation of aggregate particles reaches 38° C., the tube pumps A and B are driven to start feed of respective dispersion liquids.

The volume average particle diameter of Toner Particle (5) obtained is 5.8 μm. Thereafter, Toner (5) and Developer (5) are obtained in the same manner as in Example 1 by using Toner Particle (5).

Example 6

Toner Particle (6) is obtained in the same manner as in Example 1 except that in the production of Toner Particle (1), the liquid feed rate of the tube pump A and the liquid feed rate of the tube pump B are set to 0.64 parts/1 min and 0.13 parts/1 min, respectively, and when the temperature in the round stainless steel-made flask under the formation of aggregate particles reaches 38° C., the tube pumps A and B are driven to start feed of respective dispersion liquids.

The volume average particle diameter of Toner Particle (6) obtained is 5.7 μm. Thereafter, Toner (6) and Developer (6) are obtained in the same manner as in Example 1 by using Toner Particle (6).

Example 7

Toner Particle (7) is obtained in the same manner as in Example 1 except that in the production of Toner Particle (1), the liquid feed rate of the tube pump A and the liquid feed rate of the tube pump B are set to 0.66 parts/1 min and 0.14 parts/1 min, respectively, and when the temperature in the round stainless steel-made flask under the formation of aggregate particles reaches 39° C., the tube pumps A and B are driven to start feed of respective dispersion liquids.

The volume average particle diameter of Toner Particle (7) obtained is 6.1 μm. Thereafter, Toner (7) and Developer (7) are obtained in the same manner as in Example 1 by using Toner Particle (7).

Comparative Example 1

Toner Particle (C1) is obtained in the same manner as in Example 1 except that in the production of Toner Particle (1), Release Agent Particle Dispersion Liquid (1) is changed to Release Agent Particle Dispersion Liquid (4) and when the temperature in the round stainless steel-made flask under the formation of aggregate particles reaches 37° C., the tube pumps A and B are driven to start feed of respective dispersion liquids.

The volume average particle diameter of Toner Particle (C1) obtained is 5.8 μm. Thereafter, Toner (C1) and Developer (C1) are obtained in the same manner as in Example 1 by using Toner Particle (C1).

Comparative Example 2

Toner Particle (C2) is obtained in the same manner as in Example 1 except that in the production of Toner Particle (1), Release Agent Particle Dispersion Liquid (1) is changed to Release Agent Particle Dispersion Liquid (5) and when the temperature in the round stainless steel-made flask under the formation of aggregate particles reaches 37° C., the tube pumps A and B are driven to start feed of respective dispersion liquids.

The volume average particle diameter of Toner Particle (C2) obtained is 6.1 μm. Thereafter, Toner (C2) and Developer (C2) are obtained in the same manner as in Example 1 by using Toner Particle (C2).

Comparative Example 3

Toner Particle (C3) is obtained in the same manner as in Example 1 except that in the production of Toner Particle (1), the liquid feed rate of the tube pump A and the liquid feed rate of the tube pump B are set to 0.38 parts/1 min and 0.08 parts/1 min, respectively, and when the temperature in the round stainless steel-made flask under the formation of aggregate particles reaches 30° C., the tube pumps A and B are driven to start feed of respective dispersion liquids.

The volume average particle diameter of Toner Particle (C3) obtained is 6.0 μm. Thereafter, Toner (C3) and Developer (C3) are obtained in the same manner as in Example 1 by using Toner Particle (C3).

Comparative Example 4

Toner Particle (C4) is obtained in the same manner as in Example 1 except that in the production of Toner Particle (1), the liquid feed rate of the tube pump A and the liquid feed rate of the tube pump B are set to 0.85 parts/1 min and 0.17 parts/1 min, respectively, and when the temperature in the round stainless steel-made flask under the formation of aggregate particles reaches 33° C., the tube pumps A and B are driven to start feed of respective dispersion liquids.

The volume average particle diameter of Toner Particle (C4) obtained is 5.7 μm. Thereafter, Toner (C4) and Developer (C4) are obtained in the same manner as in Example 1 by using Toner Particle (C4).

Comparative Example 5

Toner Particle (C5) is obtained in the same manner as in Example 1 except that in the production of Toner Particle (1), the liquid feed rate of the tube pump A and the liquid feed rate of the tube pimp B are set to 0.37 parts/1 min and 0.08 parts/1 min, respectively, and when the temperature in the round stainless steel-made flask under the formation of aggregate particles reaches 30.5° C., the tube pumps A and B are driven to start feed of respective dispersion liquids.

The volume average particle diameter of Toner Particle (C5) obtained is 6.0 μm. Thereafter, Toner (C5) and Developer (C5) are obtained in the same manner as in Example by using Toner Particle (C5).

Comparative Example 6

Toner Particle (C6) is obtained in the same manner as in Example 1 except that in the production of Toner Particle (1), the liquid feed rate of the tube pump A and the liquid feed rate of the tube pump B are set to 0.90 parts/1 min and 0.18 parts/1 min, respectively, and when the temperature in the round stainless steel-made flask under the formation of aggregate particles reaches 37° C., the tube pumps A and B are driven to start feed of respective dispersion liquids.

The volume average particle diameter of Toner Particle (C6) obtained is 5.8 μm. Thereafter, Toner (C6) and Developer (C6) are obtained in the same manner as in Example 1 by using Toner Particle (C6).

Comparative Example 7

Toner Particle (C7) is obtained in the same manner as in Example 1 except that in the production of Toner Particle (1), the liquid feed rate of the tube pump A and the liquid feed rate of the tube pump B are set to 0.39 parts/1 min and 0.08 parts/1 min, respectively, and when the temperature in the round stainless steel-made flask under the formation of aggregate particles reaches 35.2° C., the tube pumps A and B are driven to start feed of respective dispersion liquids.

The volume average particle diameter of Toner Particle (C7) obtained is 6.2 μm. Thereafter, Toner (C7) and Developer (C7) are obtained in the same manner as in Example 1 by using Toner Particle (C7).

Comparative Example 8

Toner Particle (C8) is obtained in the same manner as in Example 1 except that in the production of Toner Particle (1), the liquid feed rate of the tube pump A and the liquid feed rate of the tube pump B are set to 0.90 parts/1 min and 0.18 parts/1 min, respectively, and when the temperature in the round stainless steel-made flask under the formation of aggregate particles reaches 42.3° C., the tube pumps A and B are driven to start feed of respective dispersion liquids.

The volume average particle diameter of Toner Particle (C8) obtained is 6.1 μm. Thereafter, Toner (C8) and Developer (C8) are obtained in the same manner as in Example by using Toner Particle (C8).

<Various Measurements>

With respect to the toner of the developer obtained in each of Examples and Comparative Examples, the mode value and skewness of the distribution of the eccentricity degree 13 of the release agent domain are measured according to the methods described above. The results thereof are shown in Table 1.

<Evaluation>

The following evaluation is performed using the developer obtained in each of Examples and Comparative Examples. The results thereof are shown in Table 1.

[Evaluation of Document Offset]

As the image forming apparatus to form an image for evaluation, 700 Digital Color Press manufactured by Fuji Xerox Co., Ltd. is prepared, and the developer and a replenishing toner (the same toner as the toner contained in the developer) are put in the developer bottle and the toner cartridge, respectively. Consecutively, a text image (a string of 12-point characters) for test is formed in the range of 3 cm×4 cm of C2 paper (produced by Fuji Xerox Co., Ltd., basis weight: 70 g/m$^2$) and fixed by setting the fixing temperature to 180° C. and the process speed to 220 mm/sec to form a fixed image.

A vinyl chloride sheet (ARUTORON SSS, produced by Mitsubishi Chemical Vinyl) is overlaid on the fixed image obtained, and a load of 250 g is applied thereonto and held at 65° C. for 8 hours (pressure-contact).

Thereafter, the vinyl chloride sheet is separated, and the presence or absence of an image transferred is confirmed with an eye on the vinyl chloride sheet surface that opposing the fixed image. Here, when transfer of the image onto the vinyl chloride sheet is not observed, the pressure-contact/separation above is repeated, and the presence or absence of transfer of the image is confirmed each time.

In the evaluation of document offset, the degree of image transfer onto the vinyl chloride sheet after two repetitions of pressure-contact/separation is graded according to the following standard and when graded as A to C, by repeating the pressure-contact/separation above until reaching grade D, the number of repetitions was determined, —Evaluation Standards of Document Offset—

A: Image is not transferred onto vinyl chloride sheet at all.

B: Very slight transfer onto the vinyl chloride sheet can be confirmed.

C: Transfer onto vinyl chloride sheet to an allowable degree can be confirmed.

D: Transfer onto vinyl chloride sheet can be confirmed.

TABLE 1

| | Release Agent | | | Image | |
|---|---|---|---|---|---|
| | Distribution of Eccentricity Degree B of Release Agent Domain | | Melting Temperature (° C.) | Transfer Grade After Two Repetitions of Pressure-Contact/Separation | Number of Repetitions Until Reaching Grade D |
| | Mode Value | Skewness | | | |
| Example 1 | 0.87 | −0.90 | 90 | A | 6 |
| Example 2 | 0.87 | −0.90 | 104 | B | 5 |
| Example 3 | 0.87 | −0.90 | 88 | B | 5 |
| Example 4 | 0.77 | −1.25 | 90 | B | 6 |
| Example 5 | 0.76 | −0.52 | 90 | B | 5 |
| Example 6 | 0.95 | −1.24 | 90 | A | 4 |
| Example 7 | 0.97 | −0.53 | 90 | B | 5 |
| Comparative Example 1 | 0.87 | −0.90 | 75 | C | 3 |
| Comparative Example 2 | 0.87 | −0.90 | 136 | C | 3 |
| Comparative Example 3 | 0.74 | −1.28 | 90 | D | 2 |
| Comparative Example 4 | 0.74 | −0.52 | 90 | D | 1 |
| Comparative Example 5 | 0.78 | −1.33 | 90 | C | 3 |
| Comparative Example 6 | 0.78 | −0.48 | 90 | D | 1 |
| Comparative Example 7 | 1.00 | −1.33 | 90 | D | 2 |
| Comparative Example 8 | 1.00 | −0.48 | 90 | D | 2 |

As seen from the results above, in Examples, good results are obtained in the evaluation of document offset as compared with Comparative Examples.

Among others, it is understood that in Example 1 where the melting temperature of the release agent is in the range from 90° C. to 100° C., the document offset is more successfully suppressed as compared with Example 2 and Example 3.

Examples 1B to 7B Comparative Examples 13 to 6B, Reference Examples 1B and 2B

<Preparation of Resin Particle Dispersion Liquid>

[Preparation of Resin Particle Dispersion Liquid (1B)]

Terephthalic acid: 30 molar parts

Fumaric acid: 70 molar parts

Bisphenol A ethylene oxide adduct: 5 molar parts

Bisphenol A propylene oxide adduct: 95 molar parts

These materials are charged into a flask having an inner volume of 5 liter and being equipped with a stirring device, a nitrogen inlet tube, a temperature sensor and a rectifying column. The temperature is raised to 210° C. over 1 hour, and 1 part of titanium tetraethoxide is charged per 100 parts of the materials above. The temperature is raised to 230° C. over 0.5 hours while distilling out water produced and after continuing the dehydration condensation reaction for 1 hour at this temperature, the reaction product is cooled. In this way, Polyester Resin (1) having a weight average molecular weight of 18,500, an acid value of 14 mgKOH/g and a glass transition temperature of 59° C. is synthesized.

40 Parts of ethyl acetate and 25 parts of 2-butanol are charged into a vessel equipped with a temperature adjusting unit and a nitrogen purging unit to make a mixed solvent. Subsequently, 100 parts of Polyester Resin (1) is gradually charged and dissolved, and an aqueous 10 mass % ammonia solution (in an amount corresponding to 3 times, in terms of the molar ratio, the acid value of the resin) is added thereto, followed by stirring for 30 minutes.

Thereafter, the inside of the vessel is purged with dry nitrogen, and 400 parts of ion-exchanged water is added dropwise at a rate of 2 parts/min by keeping the temperature at 40° C. while stirring the mixed solution, thereby effecting emulsification. After the completion of dropwise addition, the emulsified solution is returned to room temperature (from 20° C. to 25° C.), and the content of ethyl acetate and 2-butanol was decreased to 1,000 ppm or less by bubbling dry nitrogen through the solution for 48 hours while stirring to obtain a resin particle dispersion liquid in which resin particles having a volume average particle diameter of 200 nm are dispersed. Ion-exchanged water is added to this resin particle dispersion liquid to adjust the solid content to 20 mass %, and the resulting dispersion liquid is designated as Resin Particle Dispersion Liquid (1B).

<Preparation of Coloring Agent Particle Dispersion Liquid>

[Preparation of Coloring Agent Particle Dispersion Liquid (1B)]

Cyanine pigment, C.I. Pigment Blue 15:3 (copper 70 parts phthalocyanine, produced by DIC Corp., trade name: FASTOGEN BLUE LA5380):

Anionic surfactant (Neogen RK, produced by Dai-Ichi 5 parts Kogyo Seiyaku Co., Ltd.):

Ion-exchanged water: 200 parts

These materials are mixed and dispersed for 10 minutes by using a homogenizer (ULTRA-TURRAX T50, manufactured by IKA), and ion-exchanged water is added to adjust the solid content in the dispersion liquid to 20 mass %, whereby Coloring Agent Particle Dispersion Liquid (1B) wherein coloring agent particles with a volume average particle diameter of 190 nm are dispersed therein is obtained.

<Preparation of Release Agent Particle Dispersion Liquid>

[Preparation of Release Agent Particle Dispersion Liquid (1B)]

Paraffin wax (IINP-9, produced by Nippon Seiro Co., Ltd.: 100 parts

Anionic surfactant (Neogen RK, produced by Dai-Ichi Kogyo 1 part Seiyaku Co., Ltd.):

Ion-exchanged water: 350 parts

These materials are mixed, heated at 100° C., dispersed using a homogenizer (ULTRA-TURRAX T50, manufactured by IKA), and then subjected to a dispersion treatment by means of a Manton Gaulin high-pressure homogenizer (manufactured by Gaulin Corp.) to obtain Release Agent Particle Dispersion Liquid (1B) (solid content: 20 mass %) wherein release agent particles with a volume average particle diameter of 200 nm are dispersed therein.

Example 1B

[Preparation of Toner Particle]

An apparatus where a round stainless steel-made flask and a vessel A are connected by a tube pump A, a solution stored in the vessel A is fed to the flask by driving the tube pump A, the vessel A and a vessel B are connected by a tube pump B, and a solution stored in the vessel B is fed to the vessel A by driving the tube pump B, was prepared (see, FIG. 3). The following operation is carried out by using this apparatus.

Resin Particle Dispersion Liquid (1B): 500 parts

Coloring Agent Particle Dispersion Liquid (1B): 40 parts

Anionic surfactant (TaycaPower): 2 parts

These materials are put in the round stainless steel-made flask and after adjusting the pH to 3.5 by adding 0.1 N nitric acid, 30 parts of an aqueous nitric acid solution having a polyaluminum chloride concentration of 10 mass % is added. Subsequently, the mixture is dispersed at 30° C. by using a homogenizer (ULTRA-TURRAX T50, manufactured by IKA), and thereafter, the temperature is raised at a rate of 1° C./30 min in an oil bath for heating to grow the particle diameter of aggregate particles.

On the other hand, 150 parts of Resin Particle Dispersion Liquid (1B) is put in the vessel A that is a polyester-made bottle, and 25 parts of Release Agent Particle Dispersion Liquid (1B) is put in the vessel B. Then, the liquid feed rate of the tube pump A and the liquid feed rate of the tube pump B are set to 0.70 parts/1 min and 0.14 parts/1 min, respectively, and when the temperature in the round stainless steel-made flask under the formation of aggregate particles reaches 37.0° C., the tube pumps A and B are driven to start feed of respective dispersion liquids. As a result, a mixed dispersion liquid wherein a resin particle and a release agent particle are dispersed therein is fed from the vessel A to the round stainless steel-made flask under the formation of aggregate particles while gradually increasing the concentration of the release agent particle.

The resulting mixture is held for 30 minutes from the time when feed of respective dispersion liquids to the flask is completed and the temperature in the flask reaches 48° C., and a second aggregate particle is thereby formed.

Thereafter, 50 parts of Resin Particle Dispersion Liquid (1B) is slowly added, and the mixture is held for 1 hour. After adjusting the pH to 8.5 by adding an aqueous 0.1 N sodium hydroxide solution, the mixture is heated to 85° C. while continuously stirring, held for 5 hours, then cooled to 20° C. at a rate of 20° C./min, filtered, thoroughly washed with ion-exchanged water, and dried to obtain Toner Particle (1B) having a volume average particle diameter of 6.0 μm.

[Preparation of Toner]

100 Parts of Toner Particle (1B) and 0.7 parts of dimethyl silicone oil-treated silica particle (RY200, produced by Nippon Aerosil Co., Ltd.) are mixed using a Henschel mixer (peripheral velocity: 30 m/sec, 3 minutes) to obtain Toner (1B).

[Preparation of Developer]

Ferrite particle (average particle diameter: 50 μm): 100 parts

Toluene: 14 parts

Styrene/methyl methacrylate copolymer (copolymerization 3 parts ratio: 15/85):

Carbon black: 0.2 parts

These components except for the ferrite particle are dispersed by a sand mill to prepare a dispersion liquid, and this dispersion liquid is put in a vacuum deaeration-type kneader together with the ferrite particle, stirred while reducing the pressure, and dried to obtain a carrier.

Thereafter, 8 parts of Toner (1B) is mixed per 100 parts of the carrier above to obtain Developer (1B).

Example 2B

Toner Particle (2B) is obtained in the same manner as in Example 1B except that in the production of Toner Particle (1B), the liquid feed rate of the tube pump A and the liquid feed rate of the tube pump B are set to 0.55 parts/1 min and 0.11 parts/1 min, respectively, and the tube pumps A and B are driven when the temperature in the flask reaches 33.0° C. The volume average particle diameter of Toner Particle (2B) obtained is 5.9 μm. Thereafter, Toner (2B) and Developer (2B) are obtained in the same manner as in Example 1B by using Toner Particle (2B).

Example 3B

Toner Particle (3B) is obtained in the same manner as in Example 1B except that in the production of Toner Particle (1B), the liquid feed rate of the tube pump A and the liquid feed rate of the tube pump B are set to 0.80 parts/1 min and 0.16 parts/1 min, respectively, and the tube pumps A and B are driven when the temperature in the flask reached 35.0° C. The volume average particle diameter of Toner Particle (3B) obtained is 5.3 μm. Thereafter, Toner (3B) and Developer (3B) are obtained in the same manner as in Example 1B by using Toner Particle (3B).

Example 4B

Toner Particle (4B) is obtained in the same manner as in Example 1B except that in the production of Toner Particle (1B), the liquid feed rate of the tube pump A and the liquid feed rate of the tube pump B are set to 0.58 parts/1 min and 0.11 parts/1 min, respectively, and the tube pumps A and B are driven when the temperature in the flask reaches 39.0° C. The volume average particle diameter of Toner Particle (4B) obtained is 5.6 μm. Thereafter, Toner (4B) and Developer (4B) are obtained in the same manner as in Example 1B by using Toner Particle (4B).

Example 5B

Toner Particle (5B) is obtained in the same manner as in Example 1B except that in the production of Toner Particle (1B), the liquid feed rate of the tube pump A and the liquid feed rate of the tube pump B are set to 0.84 parts/1 min and 0.17 parts/1 min, respectively, and the tube pumps A and B are driven when the temperature in the flask reaches 41.0° C. The volume average particle diameter of Toner Particle (5B) obtained is 5.7 μm. Thereafter, Toner (5B) and Developer (5B) are obtained in the same manner as in Example 1B by using Toner Particle (5B).

Comparative Example 1B

Toner Particle (C1B) is obtained in the same manner as in Example 1B except that in the production of Toner Particle (1B), the liquid feed rate of the tube pump A and the liquid feed rate of the tube pump B are set to 055 parts/1 min and 0.11 parts/1 min, respectively, and the tube pumps A and B are driven when the temperature in the flask reaches 30.0° C. The volume average particle diameter of Toner Particle (C1B) obtained is 5.2 μm. Thereafter, Toner (C1B) and Developer (C1B) are obtained in the same manner as in Example 1B by using Toner Particle (C1B).

Comparative Example 2B

Toner Particle (C2B) is obtained in the same manner as in Example 1B except that in the production of Toner Particle (1B), the liquid feed rate of the tube pump A and the liquid feed rate of the tube pump B are set to 0.84 parts/1 min and 0.17 parts/1 min, respectively, and the tube pumps A and B are driven when the temperature in the flask reaches 33.0° C. The volume average particle diameter of Toner Particle (C2B) obtained is 6.0 μm. Thereafter, Toner (C2B) and Developer (C2B) are obtained in the same manner as in Example 1B by using Toner Particle (C2B).

Comparative Example 3B

Toner Particle (C3B) is obtained in the same manner as in Example 1B except that in the production of Toner Particle (1B), the liquid feed rate of the tube pump A and the liquid feed rate of the tube pump B are set to 0.51 parts/1 min and 0.10 parts/1 min, respectively, and the tube pumps A and B are driven when the temperature in the flask reaches 31.0° C. The volume average particle diameter of Toner Particle (C3B) obtained is 5.9 μm. Thereafter, Toner (C3B) and Developer (C3B) are obtained in the same manner as in Example 1B by using Toner Particle (C3B).

Comparative Example 4B

Toner Particle (C4B) is obtained in the same manner as in Example 1B except that in the production of Toner Particle (1B), the liquid feed rate of the tube pump A and the liquid feed rate of the tube pump B are set to 0.90 parts/1 min and 0.19 parts/1 min, respectively, and the tube pumps A and B are driven when the temperature in the flask reaches 35.0° C. The volume average particle diameter of Toner Particle (C4B) obtained is 6.1 μm. Thereafter, Toner (C4B) and Developer (C4B) are obtained in the same manner as in Example 1B by using Toner Particle (C4B).

Comparative Example 5B

Toner Particle (C5B) is obtained in the same manner as in Example 1B except that in the production of Toner Particle (1B), the liquid feed rate of the tube pump A and the liquid feed rate of the tube pump B are set to 0.50 parts/1 min and 0.10 parts/1 min, respectively, and the tube pumps A and B are driven when the temperature in the flask reaches 38.0° C. The volume average particle diameter of Toner Particle (C5B) obtained is 5.4 μm. Thereafter, Toner (C5B) and Developer (C5B) are obtained in the same manner as in Example 1B by using Toner Particle (C5B).

Comparative Example 6B

Toner Particle (C6B) is obtained in the same manner as in Example 1B except that in the production of Toner Particle (1B), the liquid feed rate of the tube pump A and the liquid feed rate of the tube pump B are set to 0.89 parts/1 min and 0.19 parts/1 min, respectively, and the tube pumps A and B are driven when the temperature in the flask reaches 42.0° C. The volume average particle diameter of Toner Particle (C6B) obtained is 5.5 μm. Thereafter, Toner (C6B) and Developer (C6B) are obtained in the same manner as in Example 1B by using Toner Particle (C6B).

Example 6B

Toner Particle (6B) is obtained in the same manner as in Example 1B except that in the production of Toner Particle (1B), the liquid feed rate of the tube pump A and the liquid feed rate of the tube pump B are set to 0.75 parts/1 min and 0.11 parts/1 min, respectively, the tube pumps A and B are driven when the temperature in the flask reaches 37.0° C., and the liquid feed rate of the tube pump B is changed to 0.19 parts/1 min when the temperature in the flask reaches 40° C. The volume average particle diameter of Toner Particle (6B) obtained is 5.9 μm. Thereafter, Toner (6B) and Developer (6B) are obtained in the same manner as in Example 1B by using Toner Particle (6B).

Example 7B

Toner Particle (7B) is obtained in the same manner as in Example 1B except that in the production of Toner Particle (1B), the liquid feed rate of the tube pump A and the liquid feed rate of the tube pump B are set to 0.75 parts/1 min and 0.14 parts/1 min, respectively, the tube pumps A and B are driven when the temperature in the flask reaches 35.0° C., and the liquid feed rate of the tube pump B is changed to 0.10 parts/1 min when the temperature in the flask reaches 39° C. The volume average particle diameter of Toner Particle (7B) obtained is 5.9 μm. Thereafter, Toner (7B) and Developer (7B) are obtained in the same manner as in Example 1B by using Toner Particle (7B).

Reference Example 1B

Toner Particle (R1B) is obtained in the same manner as in Example 1B except that in the production of Toner Particle (1B), the liquid feed rate of the tube pump A and the liquid feed rate of the tube pump B are set to 0.75 parts/1 min and 0.11 parts/1 min, respectively, the tube pumps A and B are driven when the temperature in the flask reaches 35° C., and the liquid feed rate of the tube pump B is changed to 0.22 parts/1 min when the temperature in the flask reaches 40° C. The volume average particle diameter of Toner Particle (RIB) obtained is 5.8 μm. Thereafter, Toner (R1B) and Developer (R1B) are obtained in the same manner as in Example 1B by using Toner Particle (R1B).

Reference Example 2B

Toner Particle (R2B) is obtained in the same manner as in Example 1B except that in the production of Toner Particle (1B), the liquid feed rate of the tube pump A and the liquid feed rate of the tube pump B are set to 0.75 parts/1 min and 0.14 parts/1 min, respectively, the tube pumps A and B are driven when the temperature in the flask reaches 35° C., and the liquid feed rate of the tube pump B is changed to 0.08 parts/1 min when the temperature in the flask reaches 39° C. The volume average particle diameter of Toner Particle (R2B) obtained is 5.6 μm. Thereafter, Toner (R2B) and Developer (R2B) are obtained in the same manner as in Example 1B by using Toner Particle (R2B).

<Various Measurements>

With respect to the toner of the developer obtained in each of Examples and Comparative Examples, the mode value, skewness and kurtosis of the distribution of the eccentricity degree B of the release agent domain are measured according to the methods described above. The results thereof are shown in Table 2.

<Evaluation>

The following evaluations are performed using the developer obtained in each of Examples and Comparative Examples. The results thereof are shown in Table 2.

[Evaluation of Releasability and Gloss Unevenness]

The following operation and image formation are performed in an environment of temperature: 25° C./humidity: 60%.

As the image forming apparatus to form an image for evaluation, an apparatus obtained by modifying 700 Digital Color Press manufactured by Fuji Xerox Co., Ltd. to enable outputting an unfixed image even in the edge part of paper is prepared, the developer is put in the developer bottle, and a replenishing toner (the same toner as the toner contained in the developer) is put in the toner cartridge. Consecutively, an overall solid image with a secondary color density of 200% having no front-edge margin is formed on embossed paper (REZAK 66 White, produced by Fuji Xerox Co., Ltd., basis weight: 151 g/m$^2$), and outputting is continuously carried out on 100 sheets by setting the fixing temperature to 180° C. and the process speed to 220 mm/sec. The following evaluation is performed on the images obtained on 1st sheet and 100th sheet.

—Evaluation of Releasability—

The images obtained on 1st sheet and 100th sheet are observed for the state in the front edge of paper and evaluated according to the following standards.

A: Release failure is not generated, and the state in the front edge of paper is good.

B: Release failure is not generated, and the front edge of paper is slightly curled.

C: Roughening due to release failure is generated in the front edge of the image.

D: Release fails, and paper winding is generated.

—Evaluation of Gloss Unevenness—

The images obtained on 1st sheet and 100th sheet are measured for the 60° gloss by using a portable glossimeter (BYK-Gardener MicroTrigloss, manufactured by Toyo Seiki Seisaku-Sho Ltd.). The gloss is measured 10 times at random in each of front-edge left end/front-edge right end/rear-edge left end/rear-edge right end/central part, 5 portions in total, of the image, and the standard deviation σ of the data on a total of 50 gloss values is determined and used as an indicator of gloss unevenness.

A: $\sigma<3.0$

B: $3.0\leq\sigma\leq5.0$

C: $5.0\leq\sigma<8.0$

D: $8.0\leq\sigma$

TABLE 2

| | Distribution of Eccentricity Degree B of Release Agent Domain | | | Evaluation of 1st Sheet | | Evaluation of 100th Sheet | |
|---|---|---|---|---|---|---|---|
| | Mode Value | Skewness | Kurtosis | Release Failure | Gloss Unevenness | Release Failure | Gloss Unevenness |
| Example 1B | 0.88 | −0.80 | 0.60 | A | A: 2.6 | A | A: 2.7 |
| Example 2B | 0.77 | −1.08 | 0.50 | B | A: 2.7 | B | A: 2.8 |
| Example 3B | 0.76 | −0.52 | 0.62 | A | A: 2.9 | B | A: 2.9 |
| Example 4B | 1.00 | −1.07 | 0.62 | A | B: 3.2 | A | B: 3.5 |
| Example 5B | 0.98 | −0.51 | 0.65 | A | B: 4.0 | A | B: 4.3 |

TABLE 2-continued

| | Distribution of Eccentricity Degree B of Release Agent Domain | | | Evaluation of 1st Sheet | | Evaluation of 100th Sheet | |
|---|---|---|---|---|---|---|---|
| | Mode Value | Skewness | Kurtosis | Release Failure | Gloss Unevenness | Release Failure | Gloss Unevenness |
| Comparative Example 1B | 0.74 | −1.08 | 0.53 | C | B: 3.5 | C | B: 3.8 |
| Comparative Example 2B | 0.74 | −0.52 | 0.63 | B | C: 6.9 | C | D: 10.0 |
| Comparative Example 3B | 0.76 | −1.12 | 0.52 | C | B: 4.5 | D | cannot be measured |
| Comparative Example 4B | 0.76 | −0.48 | 0.60 | C | D: 9.9 | C | D: 10.5 |
| Comparative Example 5B | 0.99 | −1.13 | 0.48 | A | C: 7.8 | A | D: 8.5 |
| Comparative Example 6B | 0.99 | −0.47 | 0.59 | A | D: 10.6 | A | D: 11.1 |
| Example 6B | 0.85 | −0.81 | 1.48 | A | A: 2.6 | A | A: 2.8 |
| Example 7B | 0.82 | −0.70 | −0.19 | A | A: 2.7 | A | A: 2.7 |
| Reference Example 1B | 0.84 | −0.79 | 1.60 | A | A: 2.7 | A | B: 3.3 |
| Reference Example 2B | 0.84 | −0.65 | −0.24 | A | A: 2.6 | B | A: 2.5 |

As seen from the results above, in Examples, good results are obtained in both evaluations of release failure and gloss unevenness, as compared with Comparative Examples.

Among others, it is understood that in Examples 6B to 7B where the kurtosis of the eccentricity degree B of the release agent domain is in the range from −0.20 to +1.50, good results are obtained in both evaluations of release failure and gloss unevenness, as compared with Reference Examples 1B and 2B.

Examples 1C to 13C Comparative Examples 1C to 6C

<Preparation of Resin Particle Dispersion Liquid>

[Preparation of Resin Particle Dispersion Liquid (1C)]

Terephthalic acid: 30 molar parts

Fumaric acid: 70 molar parts

Bisphenol A ethylene oxide adduct: 5 molar parts

Bisphenol A propylene oxide adduct: 95 molar parts

These materials are charged into a flask having an inner volume of 5 liter and being equipped with a stirring device, a nitrogen inlet tube, a temperature sensor and a rectifying column. The temperature is raised to 210° C. over 1 hour, and 1 part of titanium tetraethoxide is charged per 100 parts of the materials above. The temperature is raised to 230° C. over 0.5 hours while distilling out water produced and after continuing the dehydration condensation reaction for 3 hours at this temperature, the reaction product is cooled. In this way, Polyester Resin (1) having a weight average molecular weight of 40,000, an acid value of 14 mgKOH/g and a glass transition temperature of 59° C. is synthesized.

40 Parts of ethyl acetate and 25 parts of 2-butanol are charged into a vessel equipped with a temperature adjusting unit and a nitrogen purging unit to make a mixed solvent. Subsequently, 100 parts of Polyester Resin (1) is gradually charged and dissolved, and an aqueous 10 mass % ammonia solution (in an amount corresponding to 3 times, in terms of the molar ratio, the acid value of the resin) is added thereto, followed by stirring for 30 minutes.

Thereafter, the inside of the vessel is purged with dry nitrogen, and 400 parts of ion-exchanged water is added dropwise at a rate of 2 parts/min by keeping the temperature at 40° C. while stirring the mixed solution, thereby effecting emulsification. After the completion of dropwise addition, the emulsified solution is returned to room temperature (from 20° C. to 25° C.), and the content of ethyl acetate and 2-butanol is decreased to 1,000 ppm or less by bubbling dry nitrogen through the solution for 48 hours while stirring to obtain a resin particle dispersion liquid in which resin particles having a volume average particle diameter of 200 nm are dispersed. Ion-exchanged water is added to this resin particle dispersion liquid to adjust the solid content to 20 mass %, and the resulting dispersion liquid is designated as Resin Particle Dispersion Liquid (1C).

[Preparation of Resin Particle Dispersion Liquid (2C)]

Terephthalic acid: 30 molar parts

Fumaric acid: 70 molar parts

Bisphenol A ethylene oxide adduct: 5 molar parts

Bisphenol A propylene oxide adduct: 95 molar parts

These materials are charged into a flask having an inner volume of 5 liter and being equipped with a stirring device, a nitrogen inlet tube, a temperature sensor and a rectifying column. The temperature is raised to 210° C. over 1 hour, and 1 part of titanium tetraethoxide is charged per 100 parts of the materials above. The temperature is raised to 230° C. over 0.5 hours while distilling out water produced and after continuing the dehydration condensation reaction for 2.5 hours at this temperature, the reaction product is cooled. In this way, Polyester Resin (2) having a weight average molecular weight of 30,000, an acid value of 14 mgKOH/g and a glass transition temperature of 59° C. is synthesized.

40 Parts of ethyl acetate and 25 parts of 2-butanol are charged into a vessel equipped with a temperature adjusting unit and a nitrogen purging unit to make a mixed solvent Subsequently, 100 parts of Polyester Resin (2) is gradually charged and dissolved, and an aqueous 10 mass % ammonia solution (in an amount corresponding to 3 times, in terms of the molar ratio, the acid value of the resin) is added thereto, followed by stirring for 30 minutes.

Thereafter, the inside of the vessel is purged with dry nitrogen, and 400 parts of ion-exchanged water is added dropwise at a rate of 2 parts/min by keeping the temperature at 40° C. while stirring the mixed solution, thereby effecting emulsification. After the completion of dropwise addition, the emulsified solution is returned to room temperature (from 20° C. to 25° C.), and the content of ethyl acetate and 2-butanol is decreased to 1,000 ppm or less by bubbling dry nitrogen through the solution for 48 hours while stirring to obtain a resin particle dispersion liquid in which resin particles having a volume average particle diameter of 200 nm are dispersed. Ion-exchanged water is added to this resin particle dispersion liquid to adjust the solid content to 20 mass %, and the resulting dispersion liquid is designated as Resin Particle Dispersion Liquid (2C).

[Preparation of Resin Particle Dispersion Liquid (3C)]

Terephthalic acid: 30 molar parts

Fumaric acid: 70 molar parts

Bisphenol A ethylene oxide adduct: 5 molar parts

Bisphenol A propylene oxide adduct: 95 molar parts

These materials are charged into a flask having an inner volume of 5 liter and being equipped with a stirring device, a nitrogen inlet tube, a temperature sensor and a rectifying column. The temperature is raised to 210° C. over 1 hour, and 1 part of titanium tetraethoxide is charged per 100 parts of the materials above. The temperature is raised to 230° C. over 0.5 hours while distilling out water produced and after continuing the dehydration condensation reaction for 10 hours at this temperature, the reaction product is cooled. In this way, Polyester Resin (3) having a weight average molecular weight of 100,000, an acid value of 14 mgKOH/g and a glass transition temperature of 59° C. is synthesized.

40 Parts of ethyl acetate and 25 parts of 2-butanol are charged into a vessel equipped with a temperature adjusting unit and a nitrogen purging unit to make a mixed solvent. Subsequently, 100 parts of Polyester Resin (3) is gradually charged and dissolved, and an aqueous 10 mass % ammonia solution (in an amount corresponding to 3 times, in terms of the molar ratio, the acid value of the resin) is added thereto, followed by stirring for 30 minutes.

Thereafter, the inside of the vessel is purged with dry nitrogen, and 400 parts of ion-exchanged water is added dropwise at a rate of 2 parts/min by keeping the temperature at 40° C. while stirring the mixed solution, thereby effecting emulsification. After the completion of dropwise addition, the emulsified solution is returned to room temperature (from 20° C. to 25° C.), and the content of ethyl acetate and 2-butanol is decreased to 1,000 ppm or less by bubbling dry nitrogen through the solution for 48 hours while stirring to obtain a resin particle dispersion liquid in which resin particles having a volume average particle diameter of 200 nm are dispersed. Ion-exchanged water is added to this resin particle dispersion liquid to adjust the solid content to 20 mass %, and the resulting dispersion liquid is designated as Resin Particle Dispersion Liquid (3C).

[Preparation of Resin Particle Dispersion Liquid (4C)]

Terephthalic acid: 30 molar parts

Fumaric acid: 70 molar parts

Bisphenol A ethylene oxide adduct: 5 molar parts

Bisphenol A propylene oxide adduct: 95 molar parts

These materials are charged into a flask having an inner volume of 5 liter and being equipped with a stirring device, a nitrogen inlet tube, a temperature sensor and a rectifying column. The temperature is raised to 210° C. over 1 hour, and 1 part of titanium tetraethoxide is charged per 100 parts of the materials above. The temperature is raised to 230° C. over 0.5 hours while distilling out water produced and after continuing the dehydration condensation reaction for 2 hours at this temperature, the reaction product is cooled. In this way, Polyester Resin (4) having a weight average molecular weight of 25,000, an acid value of 14 mgKOH/g and a glass transition temperature of 59° C. is synthesized.

40 Parts of ethyl acetate and 25 parts of 2-butanol are charged into a vessel equipped with a temperature adjusting unit and a nitrogen purging unit to make a mixed solvent. Subsequently, 100 parts of Polyester Resin (4) is gradually charged and dissolved, and an aqueous 10 mass % ammonia solution (in an amount corresponding to 3 times, in terms of the molar ratio, the acid value of the resin) is added thereto, followed by stirring for 30 minutes.

Thereafter, the inside of the vessel is purged with dry nitrogen, and 400 parts of ion-exchanged water is added dropwise at a rate of 2 parts/min by keeping the temperature at 40° C. while stirring the mixed solution, thereby effecting emulsification. After the completion of dropwise addition, the emulsified solution is returned to room temperature (from 20° C. to 25° C.), and the content of ethyl acetate and 2-butanol is decreased to 1,000 ppm or less by bubbling dry nitrogen through the solution for 48 hours while stirring to obtain a resin particle dispersion liquid in which resin particles having a volume average particle diameter of 200 nm are dispersed. Ion-exchanged water is added to this resin particle dispersion liquid to adjust the solid content to 20 mass %, and the resulting dispersion liquid is designated as Resin Particle Dispersion Liquid (4C).

[Preparation of Resin Particle Dispersion Liquid (5C)]

Terephthalic acid: 30 molar parts

Fumaric acid: 70 molar parts

Bisphenol A ethylene oxide adduct: 5 molar parts

Bisphenol A propylene oxide adduct: 95 molar parts

These materials are charged into a flask having an inner volume of 5 liter and being equipped with a stirring device, a nitrogen inlet tube, a temperature sensor and a rectifying column. The temperature is raised to 210° C. over 1 hour, and 1 part of titanium tetraethoxide is charged per 100 parts of the materials above. The temperature is raised to 230° C. over 0.5 hours while distilling out water produced and after continuing the dehydration condensation reaction for 11 hours at this temperature, the reaction product is cooled. In this way, Polyester Resin (5) having a weight average molecular weight of 110,000, an acid value of 14 mgKOH/g and a glass transition temperature of 59° C. is synthesized.

40 Parts of ethyl acetate and 25 parts of 2-butanol are charged into a vessel equipped with a temperature adjusting unit and a nitrogen purging unit to make a mixed solvent. Subsequently, 100 parts of Polyester Resin (5) is gradually charged and dissolved, and an aqueous 10 mass % ammonia solution (in an amount corresponding to 3 times, in terms of the molar ratio, the acid value of the resin) is added thereto, followed by stirring for 30 minutes.

Thereafter, the inside of the vessel is purged with dry nitrogen, and 400 parts of ion-exchanged water is added dropwise at a rate of 2 parts/min by keeping the temperature at 40° C. while stirring the mixed solution, thereby effecting emulsification. After the completion of dropwise addition, the emulsified solution is returned to room temperature (from 20° C. to 25° C.), and the content of ethyl acetate and 2-butanol is decreased to 1,000 ppm or less by bubbling dry nitrogen through the solution for 48 hours while stirring to obtain a resin particle dispersion liquid in which resin particles having a volume average particle diameter of 200 nm are dispersed. Ion-exchanged water is added to this resin particle dispersion liquid to adjust the solid content to 20 mass %, and the resulting dispersion liquid is designated as Resin Particle Dispersion Liquid (5C).

[Preparation of Resin Particle Dispersion Liquid (6C)]

Terephthalic acid: 30 molar parts

Fumaric acid: 70 molar parts

Bisphenol A ethylene oxide adduct: 5 molar parts

Bisphenol A propylene oxide adduct: 95 molar parts

These materials are charged into a flask having an inner volume of 5 liter and being equipped with a stirring device, a nitrogen inlet tube, a temperature sensor and a rectifying column. The temperature is raised to 210° C. over 1 hour, and 1 part of titanium tetraethoxide is charged per 100 parts of the materials above. The temperature is raised to 230° C. over 0.5 hours while distilling out water produced and after continuing the dehydration condensation reaction for 2.7 hours at this temperature, the reaction product is cooled. In this way, Polyester Resin (6) having a weight average molecular weight of 35,000, an acid value of 14 mgKOH/g and a glass transition temperature of 59° C. is synthesized.

40 Parts of ethyl acetate and 25 parts of 2-butanol are charged into a vessel equipped with a temperature adjusting unit and a nitrogen purging unit to make a mixed solvent. Subsequently, 100 parts of Polyester Resin (6) is gradually charged and dissolved, and an aqueous 10 mass % ammonia solution (in an amount corresponding to 3 times, in terms of the molar ratio, the acid value of the resin) is added thereto, followed by stirring for 30 minutes.

Thereafter, the inside of the vessel was purged with dry nitrogen, and 400 parts of ion-exchanged water is added dropwise at a rate of 2 parts/min by keeping the temperature at 40° C. while stirring the mixed solution, thereby effecting emulsification. After the completion of dropwise addition, the emulsified solution is returned to room temperature (from 20° C. to 25° C.), and the content of ethyl acetate and 2-butanol is decreased to 1,000 ppm or less by bubbling dry nitrogen through the solution for 48 hours while stirring to obtain a resin particle dispersion liquid in which resin particles having a volume average particle diameter of 200 nm are dispersed. Ion-exchanged water is added to this resin particle dispersion liquid to adjust the solid content to 20 mass %, and the resulting dispersion liquid was designated as Resin Particle Dispersion Liquid (6C).

[Preparation of Resin Particle Dispersion. Liquid (7C)]

Terephthalic acid: 30 molar parts

Fumaric acid: 70 molar parts

Bisphenol A ethylene oxide adduct: 5 molar parts

Bisphenol A propylene oxide adduct: 95 molar parts

These materials are charged into a flask having an inner volume of 5 liter and being equipped with a stirring device, a nitrogen inlet tube, a temperature sensor and a rectifying column. The temperature is raised to 210° C. over 1 hour, and 1 part of titanium tetraethoxide is charged per 100 parts of the materials above. The temperature is raised to 230° C. over 0.5 hours while distilling out water produced and after continuing the dehydration condensation reaction for 6 hours at this temperature, the reaction product is cooled. In this way, Polyester Resin (7) having a weight average molecular weight of 60,000, an acid value of 14 mgKOH/g and a glass transition temperature of 59° C. is synthesized.

40 Parts of ethyl acetate and 25 parts of 2-butanol is charged into a vessel equipped with a temperature adjusting unit and a nitrogen purging unit to make a mixed solvent. Subsequently, 100 parts of Polyester Resin (7) is gradually charged and dissolved, and an aqueous 10 mass % ammonia solution (in an amount corresponding to 3 times, in terms of the molar ratio, the acid value of the resin) is added thereto, followed by stirring for 30 minutes.

Thereafter, the inside of the vessel is purged with dry nitrogen, and 400 parts of ion-exchanged water is added dropwise at a rate of 2 parts/min by keeping the temperature at 40° C. while stirring the mixed solution, thereby effecting emulsification. After the completion of dropwise addition, the emulsified solution is returned to room temperature (from 20° C. to 25° C.), and the content of ethyl acetate and 2-butanol is decreased to 1,000 ppm or less by bubbling dry nitrogen through the solution for 48 hours while stirring to obtain a resin particle dispersion liquid in which resin particles having a volume average particle diameter of 200 nm are dispersed. Ion-exchanged water is added to this resin particle dispersion liquid to adjust the solid content to 20 mass %, and the resulting dispersion liquid is designated as Resin Particle Dispersion Liquid (7C).

<Preparation of Coloring Agent Particle Dispersion Liquid>

[Preparation of Coloring Agent Particle Dispersion Liquid (1C)]

Cyanine pigment, C.I. Pigment Blue 15:3 (copper 70 parts phthalocyanine, produced by DIC Corp., trade name: FASTOGEN BLUE LA5380):

Anionic surfactant (Neogen RK, produced by Dai-Ichi Kogyo 5 parts Seiyaku Co., Ltd.):

Ion-exchanged water: 200 parts

These materials are mixed and dispersed for 10 minutes by using a homogenizer (ULTRA-TURRAX T50, manufactured by IKA), and ion-exchanged water was added to adjust the solid content in the dispersion liquid to 20 mass %, whereby Coloring Agent Particle Dispersion Liquid (1C) wherein coloring agent particles with a volume average particle diameter of 190 nm are dispersed therein is obtained.

<Preparation of Release Agent Particle Dispersion Liquid>

[Preparation of Release Agent Particle Dispersion Liquid (1C)]

Paraffin wax (HNP-9, produced by Nippon Seiro Co., Ltd.: 100 parts

Anionic surfactant (Neogen RK, produced by Dai-lchi Kogyo 1 part Seiyaku Co., Ltd.):

Ion-exchanged water: 350 parts

These materials are mixed, heated at 100° C., dispersed using a homogenizer (ULTRA-TURRAX T50, manufactured by IKA), and then subjected to a dispersion treatment by means of a Manton Gaulin high-pressure homogenizer (manufactured by Gaulin Corp.) to obtain Release Agent Particle Dispersion Liquid (1C) (solid content: 20 mass %) wherein release agent particles with a volume average particle diameter of 200 nm are dispersed.

Example 1C

Preparation of Toner Particle

An apparatus where a round stainless steel-made flask and a vessel A are connected by a tube pump A, a solution stored in the vessel A is fed to the flask by driving the tube pump A, the vessel A and a vessel B are connected by a tube pump B, and a solution stored in the vessel B is fed to the vessel A by driving the tube pump B, was prepared (see, FIG. 3). The following operation was carried out by using this apparatus.

Resin Particle Dispersion Liquid (1C): 500 parts

Coloring Agent Particle Dispersion Liquid (1C): 40 parts

Anionic surfactant (TaycaPower): 2 parts

These materials are put in the round stainless steel-made flask and after adjusting the pH to 3.5 by adding 0.1 N nitric acid, 30 parts of an aqueous nitric acid solution having a polyaluminum chloride concentration of 10 mass % is added. Subsequently, the mixture is dispersed at 30° C. by using a homogenizer (ULTRA-TURRAX T50, manufactured by IKA), and thereafter, the temperature is raised at a rate of 1° C./30 min in an oil bath for heating to grow the particle diameter of aggregate particles.

On the other hand, 150 parts of Resin Particle Dispersion Liquid (1C) is put in the vessel A that is a polyester-made bottle, and 25 parts of Release Agent Particle Dispersion Liquid (1C) is put in the vessel B. Then, the liquid feed rate of the tube pump A and the liquid feed rate of the tube pump B are set to 0.70 parts/1 min and 0.14 parts/1 min, respectively, and when the temperature in the round stainless steel-made flask under the formation of aggregate particles reaches 35.0° C., the tube pumps A and B are driven to start feed of respective dispersion liquids. As a result, a mixed dispersion liquid wherein a resin particle and a release agent particle are dispersed therein is fed from the vessel A to the round stainless steel-made flask under the formation of aggregate particles while gradually increasing the concentration of the release agent particle.

The resulting mixture is held for 30 minutes from the time when feed of respective dispersion liquids to the flask is completed and the temperature in the flask reaches 48° C., and a second aggregate particle is thereby formed.

Thereafter, 50 parts of Resin Particle Dispersion Liquid (1C) is slowly added, and the mixture is held for 1 hour. After adjusting the pH to 8.5 by adding an aqueous 0.1 N sodium hydroxide solution, the mixture is heated to 85° C. while continuously stirring, held for 5 hours, then cooled to 20° C. at a rate of 20° C./min, filtered, thoroughly washed with ion-exchanged water, and dried to obtain Toner Particle (1C) having a volume average particle diameter of 6.0 μm.

[Preparation of Toner]

100 Parts of Toner Particle (1C) and 0.7 parts of dimethyl silicone oil-treated silica particle (RY200, produced by Nippon Aerosil Co., Ltd.) are mixed using a Henschel mixer to obtain Toner (1C).

[Preparation of Developer]

Ferrite particle (average particle diameter: 50 μm): 100 parts

Toluene: 14 parts

Styrene/methyl methacrylate copolymer (copolymerization 3 parts ratio: 15/85):

Carbon black: 0.2 parts

These components except for the ferrite particle are dispersed by a sand mill to prepare a dispersion liquid, and this dispersion liquid is put in a vacuum deaeration-type kneader together with the ferrite particle, stirred while reducing the pressure, and dried to obtain a carrier.

Thereafter, 8 parts of Toner (1C) is mixed per 100 parts of the carrier above to obtain Developer (1C).

Example 2C

Toner Particle (2C) is obtained in the same manner as in Example 1C except that in the production of Toner Particle (1C), the liquid feed rate of the tube pump A and the liquid feed rate of the tube pump B are set to 0.70 parts/1 min and 0.11 parts/1 min, respectively, and the tube pumps A and B are driven when the temperature in the flask reached 31.0° C. The volume average particle diameter of Toner Particle (2C) obtained is 6.0 μm. Thereafter, Toner (2C) and Developer (2C) are obtained in the same manner as in Example 1C by using Toner Particle (2C).

Example 3C

Toner Particle (3C) is obtained in the same manner as in Example 1C except that in the production of Toner Particle (1C), the liquid feed rate of the tube pump A and the liquid feed rate of the tube pump B are set to 0.70 parts/1 min and 0.16 parts/1 min, respectively, and the tube pumps A and B are driven when the temperature in the flask reaches 37.5° C. The volume average particle diameter of Toner Particle (3C) obtained is 6.0 μm. Thereafter, Toner (3C) and Developer (3C) are obtained in the same manner as in Example 1C by using Toner Particle (3C).

Example 4C

Toner Particle (4C) is obtained in the same manner as in Example 1C except that in the production of Toner Particle (1C), the liquid feed rate of the tube pump A and the liquid feed rate of the tube pump B are set to 0.70 parts/1 min and 0.11 parts/1 min, respectively, and the tube pumps A and B are driven when the temperature in the flask reaches 33.0° C. The volume average particle diameter of Toner Particle (4C) obtained is 6.0 μm. Thereafter, Toner (4C) and Developer (4C) are obtained in the same manner as in Example 1C by using Toner Particle (4C).

Example 5C

Toner Particle (5C) is obtained in the same manner as in Example 1C except that in the production of Toner Particle (1C), the liquid feed rate of the tube pump A and the liquid feed rate of the tube pump B are set to 0.70 parts/1 min and 0.16 parts/1 min, respectively, and the tube pumps A and B are driven when the temperature in the flask reaches 36.5° C. The volume average particle diameter of Toner Particle (5C) obtained is 6.0 μm. Thereafter, Toner (5C) and Developer (5C) are obtained in the same manner as in Example 1C by using Toner Particle (5C).

Example 6C

Toner Particle (6C) is obtained in the same manner as in Example 1C except that in the production of Toner Particle (1C), the liquid feed rate of the tube pump A and the liquid feed rate of the tube pump B are set to 0.53 parts/1 min and 0.11 parts/1 min, respectively, and the tube pumps A and B are driven when the temperature in the flask reaches 33.0° C. The volume average particle diameter of Toner Particle (6C) obtained is 6.0 μm. Thereafter, Toner (6C) and Developer (6C) are obtained in the same manner as in Example 1C by using Toner Particle (6C).

Example 7C

Toner Particle (7C) is obtained in the same manner as in Example 1C except that in the production of Toner Particle (1C), the liquid feed rate of the tube pump A and the liquid feed rate of the tube pump B are set to 0.85 parts/1 min and 0.17 parts/1 min, respectively, and the tube pumps A and B are driven when the temperature in the flask reaches 36.5° C. The volume average particle diameter of Toner Particle (7C) obtained is 6.0 μm. Thereafter, Toner (7C) and Developer (7C) are obtained in the same manner as in Example 1C by using Toner Particle (7C).

Example 8C

Toner Particle (8C) is obtained in the same manner as in Example 1C except that in the production of Toner Particle (1C), the liquid feed rate of the tube pump A and the liquid feed rate of the tube pump B are set to 0.55 parts/1 min and 0.11 parts/1 min, respectively, and the tube pumps A and B are driven when the temperature in the flask reaches 29.0° C. The volume average particle diameter of Toner Particle (8C) obtained is 6.0 μm. Thereafter, Toner (8C) and Developer (8C) are obtained in the same manner as in Example 1C by using Toner Particle (8C).

Example 9C

Toner Particle (9C) is obtained in the same manner as in Example 1C except that in the production of Toner Particle (1C), the liquid feed rate of the tube pump A and the liquid feed rate of the tube pump B are set to 0.84 parts/1 min and 0.17 parts/1 min, respectively, and the tube pumps A and B are driven when the temperature in the flask reaches 38.5° C. The volume average particle diameter of Toner Particle (9C) obtained is 6.0 μm. Thereafter, Toner (9C) and Developer (9C) are obtained in the same manner as in Example 1C by using Toner Particle (9C).

Example 10C

Toner Particle (10C) is obtained in the same manner as in Example 1C except that in the production of Toner Particle (1C), Resin Particle Dispersion Liquid (2C) is used in place of Resin Particle Dispersion Liquid (1C), the liquid feed rate of the tube pump A and the liquid feed rate of the tube pump B are set to 030 parts/1 min and 0.14 parts/1 min, respectively, and the tube pumps A and B are driven when the temperature in the flask reaches 35.0° C. The volume average particle diameter of Toner Particle (10C) obtained is 6.0 μm. Thereafter, Toner (10C) and Developer (10C) are obtained in the same manner as in Example 1C by using Toner Particle (10C).

Example 11C

Toner Particle (11C) is obtained in the same manner as in Example 1C except that in the production of Toner Particle (1C), Resin Particle Dispersion Liquid (3C) is used in place of Resin Particle Dispersion Liquid (1C), the liquid feed rate of the tube pump A and the liquid feed rate of the tube pump B are set to 0.70 parts/1 min and 0.14 parts/1 min, respectively, and the tube pumps A and B are driven when the temperature in the flask reaches 35.0° C. The volume average particle diameter of Toner Particle (11C) obtained is 6.0 μm. Thereafter, Toner (11C) and Developer (11C) are obtained in the same manner as in Example 1C by using Toner Particle (11C).

Example 12C

Toner Particle (12C) is obtained in the same manner as in Example 1C except that in the production of Toner Particle (1C), Resin Particle Dispersion Liquid (6C) is used in place of Resin Particle Dispersion Liquid (1C), the liquid feed rate of the tube pump A and the liquid feed rate of the tube pump B are set to 0.70 parts/1 min and 0.14 parts/1 min, respectively, and the tube pumps A and B are driven when the temperature in the flask reaches 35.0° C. The volume average particle diameter of Toner Particle (12C) obtained is 6.0 μm. Thereafter, Toner (12C) and Developer (12C) are obtained in the same manner as in Example 1C by using Toner Particle (12C).

Example 13C

Toner Particle (13C) is obtained in the same manner as in Example 1C except that in the production of Toner Particle (1C), Resin Particle Dispersion Liquid (7C) is used in place of Resin Particle Dispersion Liquid (1C), the liquid feed rate of the tube pump A and the liquid feed rate of the tube pump B are set to 030 parts/1 min and 0.14 parts/1 min, respectively, and the tube pumps A and B are driven when the temperature in the flask reaches 35.0° C. The volume average particle diameter of Toner Particle (13C) obtained is 6.0 μm. Thereafter, Toner (13C) and Developer (13C) are obtained in the same manner as in Example 1C by using Toner Particle (13C).

Comparative Example 1C

Toner Particle (C1C) is obtained in the same manner as in Example 1C except that in the production of Toner Particle (1C), the liquid feed rate of the tube pump A and the liquid feed rate of the tube pump B are set to 0.70 parts/1 min and 0.11 parts/1 min, respectively, and the tube pumps A and B are driven when the temperature in the flask reaches 30.0° C. The volume average particle diameter of Toner Particle (C1C) obtained is 6.0 μm. Thereafter, Toner (C1C) and Developer (C1C) are obtained in the same manner as in Example 1C by using Toner Particle (C1C).

Comparative Example 2C

Toner Particle (C2C) is obtained in the same manner as in Example 1C except that in the production of Toner Particle (1C), the liquid feed rate of the tube pump A and the liquid feed rate of the tube pump B are set to 0.70 parts/1 min and 0.11 parts/1 min, respectively, and the tube pumps A and B are driven when the temperature in the flask reaches 38.0° C. The volume average particle diameter of Toner Particle (C2C) obtained is 6.0 μm. Thereafter, Toner (C2C) and Developer (C2C) are obtained in the same manner as in Example 1C by using Toner Particle (C2C).

Comparative Example 3C

Toner Particle (C3C) is obtained in the same manner as in Example 1C except that in the production of Toner Particle (1C), the liquid feed rate of the tube pump A and the liquid feed rate of the tube pump B are set to 0.50 parts/1 min and 0.11 parts/1 min, respectively, and the tube pumps A and B are driven when the temperature in the flask reaches 32.5° C. The volume average particle diameter of Toner Particle (C3C) obtained is 6.0 μm. Thereafter, Toner (C3C) and Developer (C3C) are obtained in the same manner as in Example 1C by using Toner Particle (C3C).

Comparative Example 4C

Toner Particle (C4C) is obtained in the same manner as in Example 1C except that in the production of Toner Particle (1C), the liquid feed rate of the tube pump A and the liquid feed rate of the tube pump B are set to 0.90 parts/1 min and 0.17 parts/1 min, respectively, and the tube pumps A and B are driven when the temperature in the flask reaches 37.0° C. The volume average particle diameter of Toner Particle (C4C) obtained is 6.0 μm. Thereafter, Toner (C4C) and Developer (C4C) are obtained in the same manner as in Example 1C by using Toner Particle (C4C).

Comparative Example 5C

Toner Particle (C5C) is obtained in the same manner as in Example 1C except that in the production of Toner Particle (1C), Resin Particle Dispersion Liquid (4C) is used in place of Resin Particle Dispersion Liquid (1C), the liquid feed rate of the tube pump A and the liquid feed rate of the tube pump B are set to 0.70 parts/1 min and 0.14 parts/1 min, respectively, and the tube pumps A and B are driven when the temperature in the flask reaches 35.0° C. The volume average particle diameter of Toner Particle (C5C) obtained is 6.0 μm. Thereafter, Toner (C5C) and Developer (C5C) are obtained in the same manner as in Example 1C by using Toner Particle (C5C).

Comparative Example 6C

Toner Particle (C6C) is obtained in the same manner as in Example 1C except that in the production of Toner Particle (1C), Resin Particle Dispersion Liquid (5C) is used in place of Resin Particle Dispersion Liquid (1C), the liquid feed rate of the tube pump A and the liquid feed rate of the tube pump B are set to 0.70 parts/1 min and 0.14 parts/1 min, respectively, and the tube pumps A and B are driven when the temperature in the flask reaches 35.0° C. The volume average particle diameter of Toner Particle (C6C) obtained is 6.0 μm. Thereafter, Toner (C6C) and Developer (C6C) are obtained in the same manner as in Example 1C by using Toner Particle (C6C).

<Various Measurements>

With respect to the toner of the developer obtained in each of Examples and Comparative Examples, the mode value and skewness of the distribution of the eccentricity degree B of the release agent domain were measured according to the methods described above. The results thereof are shown in Table 3.

<Evaluation>

The following evaluations are performed using the developer obtained in each of Examples and Comparative Examples. The results thereof are shown in Table 3.

[Evaluation of Sheet Front-Edge Color Difference and Rubbing-Induced Color Gamut Reduction]

The following operation and image formation are performed in an environment of temperature: 25° C./humidity: 60%.

As the image forming apparatus to form an image for evaluation, an apparatus obtained by modifying 700 Digital Color Press manufactured by Fuji Xerox Co., Ltd. to enable outputting an unfixed image even in the edge part of paper is prepared, the developer is put in the developer bottle, and a replenishing toner (the same toner as the toner contained in the developer) is put in the toner cartridge. Consecutively, an allover solid image with a secondary color density of 200% having no front-edge margin is formed on coated paper (J COAT paper, produced by Fuji Xerox Co., Ltd., product name: J COAT, basis weight: 95 g/m$^2$, paper thickness: 97 μm, ISO brightness: 88%), and outputting is continuously carried out on 100 sheets by setting the fixing temperature to 180° C. and the process speed to 220 mm/see. The following evaluations are performed on the image obtained on 100th sheet.

—Evaluation of Sheet Front-Edge Color Difference—

The image obtained on 100th sheet is measured for L* value, a* value and b* value in each of the recording medium's front-edge part and the recording medium's rear-edge part of the image by using a reflection spectrodensitometer (trade name: Xrite-939 manufactured by X-Rite Inc.). Based on the measurement results, the sheet front-edge color difference ($\Delta E_{AB}$ value) is determined by the method described above.

The $\Delta E_{AB}$ value is in the practically allowable range if it is 6 or less, and is preferably 3 or less.

—Evaluation of Rubbing-Induced Color Gamut Reduction—

The image obtained on 100th sheet is measured for L* value, a* value and b* value in the recording medium central part of the image by using a reflection spectrodensitometer (trade name: Xrite-939 manufactured by X-Rite Inc.) and thereafter, the recording medium central part of the image is cut into a size of 220 mm×30 mm to make a test piece and evaluated by using white cotton fabric as a scraper and using a Gakushin-type color fastness to rubbing tester (manufactured by Yasuda Seiki Seisakusho Ltd.). After rubbing in 100 reciprocations under a load of 1.96 N, the L* value, a* value and b* value are again measured. Based on the measurement results, the color gamut reduction ($\Delta E_{CD}$ value) is determined by the method described above.

The $\Delta E_{CD}$ value is in the practically allowable range if it is 6 or less, and is preferably 3 or less.

TABLE 3

| | Distribution of Eccentricity | | Weight Average | Evaluation | |
|---|---|---|---|---|---|
| | Degree B of Release Agent Domain | | Molecular Weight of | Sheet Front-Edge Color | Rubbing-Induced Color Gamut |
| | Mode Value | Skewness | Toner Particle | Difference | Reduction |
| Example 1C | 0.80 | −0.80 | 40000 | 1.1 | 0.8 |
| Example 2C | 0.65 | −0.80 | 40000 | 3.9 | 1.2 |
| Example 3C | 0.90 | −0.80 | 40000 | 1.4 | 3.5 |
| Example 4C | 0.75 | −0.80 | 40000 | 3.0 | 1.1 |
| Example 5C | 0.85 | −0.80 | 40000 | 1.4 | 2.9 |
| Example 6C | 0.80 | −1.10 | 40000 | 5.9 | 1.4 |
| Example 7C | 0.80 | −0.50 | 40000 | 1.3 | 5.8 |
| Example 8C | 0.65 | −1.08 | 40000 | 6.0 | 2.8 |
| Example 9C | 0.90 | −0.51 | 40000 | 2.8 | 5.9 |
| Example 10C | 0.80 | −0.80 | 30000 | 2.5 | 5.9 |
| Example 11C | 0.80 | −0.80 | 100000 | 5.9 | 2.1 |
| Example 12C | 0.80 | −0.80 | 35000 | 1.9 | 3.0 |
| Example 13C | 0.80 | −0.80 | 60000 | 2.9 | 2.3 |
| Comparative Example 1C | 0.60 | −0.80 | 40000 | 6.3 | 3.1 |
| Comparative Example 2C | 0.95 | −0.80 | 40000 | 2.2 | 6.4 |

TABLE 3-continued

| | Distribution of Eccentricity | | Weight Average | Evaluation | |
|---|---|---|---|---|---|
| | Degree B of Release Agent Domain | | Molecular Weight of | Sheet Front-Edge Color | Rubbing-Induced Color Gamut |
| | Mode Value | Skewness | Toner Particle | Difference | Reduction |
| Comparative Example 3C | 0.80 | −1.15 | 40000 | 6.5 | 2.8 |
| Comparative Example 4C | 0.80 | −0.45 | 40000 | 3.5 | 6.4 |
| Comparative Example 5C | 0.80 | −0.80 | 25000 | 1.9 | 6.1 |
| Comparative Example 6C | 0.80 | −0.80 | 110000 | 6.6 | 2.1 |

As seen from the results above, in Examples, good results are obtained in the evaluation of sheet front-edge color difference and rubbing-induced color gamut reduction as compared with Comparative Examples.

Examples 1D to 5D Comparative Examples 1D to 6D (Measuring Method of Volume Average Particle Diameter of Colored Particle and Volume Average Particle Diameter or Number Average Particle Diameter of External Additive)

A volume average particle diameter of colored particles and a volume average particle diameter or number average particle diameter of an external additive are measured using a Coulter Multisizer II (manufactured by Beckman Coulter, Inc.). ISOTON-II (manufactured by Beckman Coulter, Inc.) is used as an electrolytic solution.

At the measurement, first of all, a measurement sample in an amount of 0.5 mg or more and 50 mg or less is added to 2 mL of a 5% aqueous solution of, as a dispersant, a surfactant, preferably a sodium a alkylbenzenesulfonate. This mixture is added to the electrolytic solution in an amount of 100 mL or more and 150 mL or less. This electrolytic solution having the sample suspended therein is subjected to a dispersing treatment for about one minute by using an ultrasonic disperser, and a particle size distribution of particles having a particle diameter in the range of 2 μm or more and 60 μm or less is measured using a 100-μm aperture as an aperture diameter by the Coulter Multisizer Type II. The number of particles to be sampled is made to be 50,000.

A cumulative distribution of the number or the volume is drawn from the small diameter side with respect to the particle size range (channel) divided on the basis of the thus measured particle size distribution, and a particle diameter at an accumulation of 50% is defined as a number average particle diameter or a volume average particle diameter.

(Preparation of Toner)

<Synthesis of Non-Crystalline Polyester Resin>

A heat dried two-necked flask is charged with, as raw materials, 90 parts by mole of polyoxyethylene (2,0)-2,2-bis(4-hydroxyphenyl)propane, 10 parts by mole of ethylene glycol, 80 parts by mole of terephthalic acid, and 20 parts by mole of isophthalic acid and, as a catalyst, dibutyltin oxide; after introducing a nitrogen gas into the container to keep it in an inert atmosphere and raising the temperature, the contents are subjected to a cocondensation polymerization reaction at 150 to 230° C. for about 12 hours; and thereafter, the pressure is gradually reduced at 210 to 250° C., thereby synthesizing a non-crystalline polyester resin (1).

A weight average molecular weight (Mw) of the non-crystalline polyester resin (1) is 23,200. An acid value of the non-crystalline polyester resin (1) is 14.2 KOHmg/g. In addition, a glass transition temperature (Tg) of the non-crystalline polyester resin (1) was 62° C.

(Preparation of Metatitanic Acid Particle)

Metatitanic acid particles used in the Examples are shown below.

Metatitanic acid particle (1): Crystallite diameter 12.5 nm
Metatitanic acid particle (2): Crystallite diameter 15.7 nm
Metatitanic acid particle (3): Crystallite diameter 14.0 nm
Metatitanic acid particle (4): Crystallite diameter 11.0 nm
Metatitanic acid particle (5): Crystallite diameter 18.2 nm <Preparation of Metatitanic Acid Particle (1)>

An ilmenite ore ($FeTiO_3$) is heated and dissolved in concentrated sulfuric acid to separate an iron powder, thereby obtaining $TiOSO_4$. Furthermore, a precipitate of $TiO(OH)_2$ is produced by thermal hydrolysis. This is filtered and repeatedly washed with water. Thereafter, a polycarboxylic acid in an amount of 10 ppm (by mass) relative to $TiO(OH)_2$ and water in an amount of 100 times (by mass) are added, and the mixture are thoroughly stirred and then dried at 150° C. Subsequently, the resultant is heated and burnt under a condition at 500° C. for 80 minutes, thereby obtaining titanium oxide. Subsequently, the obtained titanium oxide is dispersed in water, and isobutylmethoxysilane in an amount of 5®% by weight relative to the solid is added dropwise at a temperature of 25° C. while stirring. Subsequently, this is filtered and repeatedly washed with water. The obtained titanium oxide having been subjected to a surface treatment with isobutylmethoxysilane is dried at 150° C.

The metatitanic acid particle (1) shows a maximum diffraction peak at a Bragg angle 2θ of 27.5° in the CuKα characteristic X-ray diffraction and has a crystallite diameter as calculated from the peak of 12.5 nm.

<Preparation of Metatitanic Acid Particle (2)>

Metatitanic acid particle (2) is prepared in the same manner as that in the metatitanic acid particle (1), except that in the preparation of the metatitanic acid particle (1), the drying time is changed to 135 minutes, and the addition amount of the polycarboxylic acid is changed to 8 ppm.

The metatitanic acid particle (2) shows a maximum diffraction peak at a Bragg angle 2θ of 27.5° in the CuKα characteristic X-ray diffraction and has a crystallite diameter as calculated from the peak of 15.7 nm.

<Preparation of Metatitanic Acid Particle (3)>

Metatitanic acid particle (3) is prepared in the same manner as that in the metatitanic acid particle (1), except that in the preparation of the metatitanic acid particle (1), the drying time is changed to 100 minutes.

The metatitanic acid particle (3) shows a maximum diffraction peak at a Bragg angle 2θ of 27.5° in the CuKα characteristic X-ray diffraction and has a crystallite diameter as calculated from the peak of 14.0 nm.

<Preparation of Metatitanic Acid Particle (4)>

Metatitanic acid particle (4) is prepared in the same manner as that in the metatitanic acid particle (1), except that in the preparation of the metatitanic acid particle (1), the drying temperature is changed to 490° C., the drying time is changed to 75 minutes, and the addition amount of the polycarboxylic acid is changed to 15 ppm.

The metatitanic acid particle (4) shows a maximum diffraction peak at a Bragg angle 2θ of 27.5° in the CuKα characteristic X-ray diffraction and has a crystallite diameter as calculated from the peak of 11.0 nm.

<Preparation of Metatitanic Acid Particle (5)>

Metatitanic acid particle (5) is prepared in the same manner as that in the metatitanic acid particle (1), except that in the preparation of the metatitanic acid particle (1), the drying temperature is changed to 520° C., the drying time is changed to 150 minutes, and the addition amount of the polycarboxylic acid is changed to 0 ppm.

The metatitanic acid particle (5) shows a maximum diffraction peak at a Bragg angle 2θ of 27.5° in the CuKα characteristic X-ray diffraction and has a crystallite diameter as calculated from the peak of 181 nm.

(Preparation of Silica Particle)

Silica particles used in the Examples is shown below.

Silica particle (1): Volume average particle diameter 65 am

Silica particles (2): Volume average particle diameter 180 nm

Silica particles (3): Volume average particle diameter 130 nm

Silica particles (4): Volume average particle diameter 40 nm

Silica particles (5): Volume average particle diameter 230 nm

<Preparation of Silica Particle (1)>

150 parts of tetramethoxysilane is stirred at 280 rpm in the presence of 100 parts of ion-exchanged water and 100 parts of a 25% by weight alcohol while adding dropwise 150 parts of 25% by weight ammonia water at 30° C. over 5 hours. A silica gel suspension liquid obtained in this reaction is centrifuged to separate into the wet silica gel, the alcohol, and the ammonia water. Furthermore, after drying the separated wet silica gel at 120° C. for 2 hours, 100 parts of silica and 500 parts of ethanol are put into an evaporator, and the contents are stirred for 15 minutes while keeping the temperature at 40° C. Subsequently, dimethyldimethoxysilane in an amount of 10 parts based on 100 parts of silica is added, and the contents are further stirred for 15 minutes. Finally, the temperature is raised to 90° C., and the methanol is dried under reduced pressure. The thus treated material is taken out and further dried in vacuo at 120° C. for 30 minutes. The dried silica is pulverized to obtain silica particle (1) having a volume average particle diameter of 65 nm.

<Preparation of Silica Particle (2)>

Silica particle (2) having a volume average particle diameter of 180 nm is obtained in the same preparation method as that in the silica particle (1), except that in the preparation of the silica particle (1), the addition of the 25% by weight ammonia water is performed by stirring at 150 rpm while adding dropwise 150 parts of the ammonia water over 5 hours.

<Preparation of Silica Particle (3)>

Silica particle (3) having a volume average particle diameter of 130 nm is obtained in the same preparation method as that in the silica particle (1), except that in the preparation of the silica particle (1), the addition of the 25% by weight ammonia water is performed by stirring at 205 rpm while adding dropwise 150 parts of the ammonia water over 5 hours.

<Preparation of Silica Particle (4)>

Silica particle (4) having a volume average particle diameter of 40 nm is obtained in the same preparation method as that in the silica particle (1), except that in the preparation of the silica particle (1), the addition of the 25% by weight ammonia water is performed by stirring at 305 rpm while adding dropwise 150 parts of the ammonia water over 5 hours.

<Preparation of Silica Particle (5)>

Silica particle (5) having a volume average particle diameter of 230 nm is obtained in the same preparation method as that in the silica particle (1), except that in the preparation of the silica particle (1), the addition of the 25% by weight ammonia water is performed by stirring at 95 rpm while adding dropwise 150 parts of the ammonia water over 5 hours.

<Preparation of Release Agent Dispersion Liquid>

| | |
|---|---|
| Paraffin wax (HNP-9, manufactured by Nippon Seiro Co., Ltd., melting point: 75° C.) | 50 parts |
| Anionic surfactant (NEOGEN RK, manufactured by Dai-ichi Kogyo Seiyaku Co., Ltd.) | 0.5 parts |
| Ion-exchanged water | 200 parts |

The foregoing components are mixed, heated at 95° C., and dispersed using a homogenizer (ULTRA-TURRAX T50, manufactured by IKA). Thereafter, the resultant is subjected to a dispersing treatment using a Manton-Gaulin high-pressure homogenizer (manufactured by Gaulin), thereby preparing a release agent dispersion liquid having a release agent dispersed therein (solid content: 20%). A volume average particle diameter of the release agent in the release agent dispersion liquid is 0.23 μm.

<Preparation of Colorant Dispersion Liquid>

| | |
|---|---|
| Cyan pigment (Pigment Blue 15:3 (copper phthalocyanine), manufactured by Dainichiseika Color & Chemicals Mfg., Co., Ltd.) | 1,000 parts |
| Anionic surfactant (NEOGEN R, manufactured by Dai-ichi Kogyo Seiyaku Co., Ltd.) | 15 parts |
| Ion-exchanged water | 9,000 parts |

The foregoing components are mixed and dispersed for one hour by using a high-pressure counter collision disperser, ULTIMAIZER (HJP30006, manufactured by Sugino Machine Limited), thereby obtaining a colorant dispersion liquid wherein a colorant (cyan pigment) is dispersed therein. In the colorant dispersion liquid, a volume average particle diameter of the colorant (cyan pigment) is 0.16 μm, and a solid content is 20% by weight.

Example 1D

<Preparation of Colored Particle (1)>

—Mixing Step—

| | |
|---|---|
| Non-crystalline polyester resin dispersion liquid (1) | 267 parts |
| Colorant dispersion liquid | 25 parts |
| Release agent dispersion liquid | 40 parts |
| Anionic surfactant (TAYCA POWER, manufactured by Tayca Corporation) | 2.0 parts |

The above-described respective raw materials are put into a cylindrical stainless steel container and dispersed and mixed for 10 minutes by using a homogenizer (ULTRA-TURRAX T50, manufactured by IKA) at a rotation number of the homogenizer of 4,000 rpm while applying a shear force. Subsequently, 2.0 parts of a 10% nitric acid aqueous solution of polyaluminum chloride (PAC) (incidentally, a content of nitric acid is 0.05 N) as an aggregating agent is gradually added dropwise, and the contents are dispersed and mixed for 15 minutes at a rotation number of the homogenizer of 5,000 rpm, thereby preparing a raw material dispersion liquid.

—Aggregation Step—

Thereafter, the raw material dispersion liquid is transferred into a polymerizer equipped with a stirring device and a thermometer and started to be heated by a heating mantle, thereby promoting the growth of the aggregated particles at 42° C. On that occasion, a pH of the raw material dispersion liquid is controlled to a range of 3.2 or more and 3.8 or less by using a 0.3 N nitric acid or 1 N sodium hydroxide aqueous solution. The raw material dispersion liquid is allowed to stand for about 2 hours while keeping in the foregoing pH range, thereby forming aggregated particles. A volume average particle diameter of the resulting aggregated particles is 5.4 μm.

—Fusion Step—

Subsequently, 100 parts of the non-crystalline polyester resin dispersion liquid (1) is additionally added to the raw material dispersion liquid, thereby allowing the resin particles of the non-crystalline polyester resin (1) to attach onto the surfaces of the aggregated particles. Furthermore, the raw material dispersion liquid is subjected to temperature rise to 44° C., and the aggregated particles are arranged using an optical microscope and Multisizer II while confirming the size and form of the particles. Thereafter, in order to fuse the aggregated particles, a sodium hydroxide aqueous solution is added dropwise to the raw material dispersion liquid to control at a pH of 7.5, and the raw material dispersion liquid is then subjected to temperature rise to 95° C. Thereafter, the raw material dispersion liquid is allowed to stand for 3 hours to fuse the aggregated particles. After continuing the fusion of the aggregated particles by an optical microscope, the colored particle dispersion liquid is cooled at a temperature drop rate of 1.0° C./min.

—Washing Step—

Subsequently, the colored particle dispersion liquid is filtered, and the colored particles after solid-liquid separation are dispersed in ion-exchanged water at 30° C. in an amount of 20 times relative to the colored particle solid amount and stirred for 20 minutes, followed by filtration. This step is repeated five times, thereby confirmed that a conductivity of the filtrate is 25 μS. The colored particles are filtered and dried by a freezing drying machine, thereby obtaining colored particle (1).

—External Addition Step—

100 parts of the colored particle, 1.84 parts of the metatitanic acid particle (1), and 0.98 parts of the silica particle (1) are put into a Henschel mixer and mixed at a rotation number of 2,200 rpm for 2.5 minutes. Furthermore, the mixture is sieved with a 45 μm-sieving net, thereby obtaining an externally added toner (1).

Examples 2D to 5D and Comparative Examples 1D to 4D

<Preparation of Externally Added Toners (2) to (9)>

Externally added toners (2) to (9) are prepared in the same manner as that in the externally added toner (1), except that the metatitanic acid particle and the silica particle are changed to those described in Table 4, respectively.

TABLE 4

| | Externally added toner (1) | Metatitanic acid particle | Silica particle |
|---|---|---|---|
| Example 1D | Externally added toner (2) | Metatitanic acid particle (1) | Silica particle (1) |
| Example 2D | Externally added toner (3) | Metatitanic acid particle (2) | Silica particle (1) |
| Example 3D | Externally added toner (4) | Metatitanic acid particle (1) | Silica particle (2) |
| Example 4D | Externally added toner (5) | Metatitanic acid particle (2) | Silica particle (2) |
| Example 5D | Externally added toner | Metatitanic acid particle (3) | Silica particle (3) |
| Comparative Example 1D | Externally added toner (6) | Metatitanic acid particle (3) | Silica particle (4) |
| Comparative Example 2D | Externally added toner (7) | Metatitanic acid particle (4) | Silica particle (3) |
| Comparative Example 3D | Externally added toner (8) | Metatitanic acid particle (3) | Silica particle (5) |
| Comparative Example 4D | Externally added toner (9) | Metatitanic acid particle (5) | Silica particle (3) |

<Preparation of Carrier>

1,000 parts of Mn—Mg ferrite (volume average particle diameter: 50 μm, shape factor SF1: 120, manufactured by Powdertech Co., Ltd.) is put into a kneader, a solution prepared by dissolving 150 parts of a perfluorooctyl methyl acrylate-methyl methacrylate copolymer (polymerization ratio: 20/80, Tg: 72° C., weight average molecular weight: 72,000, manufactured by Soken Chemical and Engineering Co., Ltd.) in 700 parts of toluene is added, and the contents are mixed at ordinary temperature for 20 minutes. Thereafter, the mixture is heated to 70° C. and dried under reduced pressure, and then taken out to obtain a coated carrier. Furthermore, the obtained coated carrier is sieved with a mesh having an opening of 75 μm to remove a coarse powder, thereby obtaining a carrier. A shape factor SF1 of the carrier is 122.

<Preparation of Developer>

Each of the obtained externally added toners (1) to (9) and the carrier are put in a proportion of the externally added toner to the carrier of 5/95 (weight ratio) into a V-blender, thereby obtaining developers (1) to (9), which are then evaluated.

<Evaluation>

A modified 700 Digital Color Press (manufactured by Fuji Xerox Co., Ltd.) including the obtained electrostatic charge image developer is used. The evaluation is carried out under the same condition after allowing the toner and the apparatus under respective conditions of temperature and relative humidity for one day.

[Density Variation]

Condition 1: After standing under a low temperature and low humidity environment (at 10° C. and 15%) for one day, the evaluation is commenced under the same environment.

Condition 2: After standing under a high temperature and high humidity environment (at 28° C. and 85%) for one day, the evaluation is commenced under the same environment.

Under each of the above-described conditions, a patch is prepared, and an image density is confirmed (density 1). Subsequently, after continuously printing an image having an area coverage (density) of 1% on 100,000 sheets, a patch is again prepared, and image density is confirmed (density 2).

The image density is measured using an image densitometer X-RITE938 (manufactured by X-RITE Inc.).

A value of Δ density expressed by the following equation is calculated from the density 1 and density 2, and the evaluation is made according to the following criteria.

$$\Delta\text{density}=|(\text{density 1})-(\text{density 2})|$$

G1: 0<Δ density≤0.2

G2: 0.2<Δ density≤0.3

G3: 03<Δ density

<Evaluation of Color Streaks>

A modified 700 Digital Color Press (manufactured by Fuji Xerox Co., Ltd.) including the obtained electrostatic charge image developer is allowed to stand under a high temperature and high humidity environment (at 28° C. and 85%) for one day, and an image having an area coverage of 1% is continuously printed on 100,000 sheets.

With respect to 100 sheets of 99,900 to 100,000 sheets, the generation of color streaks was visually observed and evaluated according to the following criteria.

G1: No generation of color streaks

G2: 0 sheet<generation of color streaks≤5 sheets

G3: 5 sheets<generation of color streaks

TABLE 5

| | Developer | Metatitanic acid Crystallite diameter (nm) | Silica Particle diameter (nm) | Density variation: Low temperature and low humidity environment | Density variation: High temperature and high humidity environment | Color streaks |
|---|---|---|---|---|---|---|
| Example 1D | Developer (1) | 12.5 | 65 | G1 | G2 | G1 |
| Example 2D | Developer (2) | 15.7 | 65 | G2 | G2 | G1 |
| Example 3D | Developer (3) | 12.5 | 180 | G1 | G1 | G2 |
| Example 4D | Developer (4) | 15.7 | 180 | G2 | G1 | G1 |
| Example 5D | Developer (5) | 14.0 | 130 | G1 | G1 | G1 |
| Comparative Example 1D | Developer (6) | 14.0 | 40 | G1 | G3 | G1 |
| Comparative Example 2D | Developer (7) | 11.0 | 130 | G1 | G1 | G3 |
| Comparative Example 3D | Developer (8) | 14.0 | 230 | G1 | G1 | G3 |
| Comparative Example 4D | Developer (9) | 18.2 | 130 | G3 | G1 | G1 |

What is claimed is:

1. An electrostatic image-developing toner comprising a toner particle which comprises:

a binder resin having a glass transition temperature from 50° C. to 80° C.;

a coloring agent;

a release agent having a melting temperature of 85° C. to 120° C.; and silica treated with a silicone oil as an external additive, the toner particle having a core-shell structure consisting of a core part and a shell layer formed by aggregation-coalescence method, the core part of the toner particle having a sea-island structure including a sea part containing the binder resin and a plurality of island parts containing the release agent, wherein:

a mode value of a distribution of an eccentricity degree B of the plurality of release agent-containing island parts, represented by the following Formula (1), is from 0.75 to 1.00 and a skewness of the distribution of the eccentricity degree B is from −1.30 to −0.50:

$$\text{Eccentricity degree } B=2d/D \qquad \text{Formula (1)}$$

in Formula (1), D is an equivalent-circle diameter (μm) of the toner particle in a cross-sectional observation of the toner particle, and d is a distance (μm) from the gravity center of the toner particle to the gravity center of one of the plurality of release agent-containing island parts in the cross-sectional observation of the toner particle;

the toner particle has a shape factor SF1 from 110 to 150; and the shape factor SF1 is defined as $SF1=(ML^2/A)\times(\pi/4)\times100$, wherein ML represents the absolute maximum length of the toner particle, and A represents the projected area of the toner particle.

2. The electrostatic image-developing toner as claimed in claim 1, wherein the binder resin is a polyester resin.

3. The electrostatic image-developing toner as claimed in claim 2, wherein an alcohol constituent component of the polyester resin contains an alkylene oxide adduct of bisphenol A.

4. The electrostatic image-developing toner as claimed in claim 1, wherein a content of the binder resin is from 40 mass % to 95 mass % based on the entire toner particle.

5. The electrostatic image-developing toner as claimed in claim 1, wherein a content of the coloring agent is from 1 mass % to 30 mass % based on the entire toner particle.

6. The electrostatic image-developing toner as claimed in claim 1, wherein a melting temperature of the release agent is from 90° C. to 100° C.

7. The electrostatic image-developing toner as claimed in claim 6, wherein the release agent contains a hydrocarbon-based wax.

8. The electrostatic image-developing toner as claimed in claim 1, wherein a content of the release agent is from 1 mass % to 20 mass % based on the entire toner particle.

9. The electrostatic image-developing toner as claimed in claim 1, wherein a content of the external additive is from 0.01 mass % to 5 mass % based on the toner particle.

10. The electrostatic image-developing toner as claimed in claim 1, wherein the toner particle has a volume average particle diameter of from 2 μm to 10 μm.

11. An electrostatic image developer comprising the electrostatic image-developing toner claimed in claim 1.

12. The electrostatic image developer as claimed in claim 11, containing a carrier coated with a coating resin.

13. The electrostatic image developer as claimed in claim 12, wherein the coating resin contains an electrically conductive particle.

14. The electrostatic image developer as claimed in claim 13, wherein the electrically conductive particle is carbon black.

15. A toner cartridge storing the electrostatic image-developing toner claimed in claim 1, which is attached to and detached from an image forming apparatus.

* * * * *